US005782179A

United States Patent [19]

Kagawa et al.

[11] Patent Number: 5,782,179

[45] Date of Patent: Jul. 21, 1998

[54] AUTOMATIC STENCIL FEEDING AND MAKING DEVICE

[75] Inventors: Hideyuki Kagawa, Sendai; Mituru Takahashi, Shiroishi, both of Japan

[73] Assignee: Tohoku Ricoh Co., Ltd., Miyagi-ken, Japan

[21] Appl. No.: 690,547

[22] Filed: Jul. 31, 1996

[30] Foreign Application Priority Data

| | | | |
|---|---|---|---|
| Jul. 31, 1995 | [JP] | Japan | 7-195308 |
| Jul. 31, 1995 | [JP] | Japan | 7-195310 |
| Jun. 8, 1996 | [JP] | Japan | 8-170040 |

[51] Int. Cl.[6] ..... B41C 1/14

[52] U.S. Cl. ..... 101/128.4; 101/477

[58] Field of Search ..... 101/116, 117, 101/118, 121, 122, 128.21, 128.4, 477

[56] References Cited

U.S. PATENT DOCUMENTS

| | | | |
|---|---|---|---|
| 4,957,378 | 9/1990 | Shima | 101/128.4 |
| 5,375,516 | 12/1994 | Hasegawa | 101/128.4 |
| 5,558,019 | 9/1996 | Kawai et al. | 101/128.4 |
| 5,613,437 | 3/1997 | Motoe et al. | 101/128.4 |
| 5,640,904 | 6/1997 | Sato et al. | 101/128.4 |

FOREIGN PATENT DOCUMENTS

| | | | |
|---|---|---|---|
| 16787 | 1/1984 | Japan | 101/128.4 |
| 59-16792 | 1/1984 | Japan . | |
| 63-178134 | 11/1988 | Japan . | |
| 6-32041 | 2/1994 | Japan . | |
| 6-227110 | 8/1994 | Japan . | |
| 7-17013 | 1/1995 | Japan . | |
| 7-101135 | 4/1995 | Japan . | |
| 7-125400 | 5/1995 | Japan . | |

*Primary Examiner*—Stephen R. Funk
*Attorney, Agent, or Firm*—Oblon, Spivak, McClelland, Maier & Neustadt, P.C.

[57] ABSTRACT

In a stencil printer, a master making device has a body and a roll holding section. To load the roll holding section with a new stencil roll, the operator should only pull out the roll holding section from the body of the device. The operator sets the new roll in the roll holding section and pushes the holding section into the device body as far as a preselected operative position. Then, rotary drive apparatus rotates the roll in a direction for paying out the leading edge of a stencil. At the same time, peeling apparatus adjoins or contacts the periphery of the roll in accordance with the varying diameter of the roll and automatically peels off the leading edge of the stencil from the roll. The leading edge is paid out toward master making apparatus. The stencil can therefore be surely paid out and brought to a stand-by position. This facilitates the loading of the stencil and allows it to be fully automatically paid out from the roll. The printing operation is simple and frees the operator from troublesome manipulation. The roll holding section can be moved into and out of the device body without requiring a document reading section arranged on the top of the printer to be slid. The device is therefore simple, light weight, and low cost, compared to a printer having a conventional master making device.

86 Claims, 28 Drawing Sheets

AUTOMATIC STENCIL FEEDING AND MAKING DEVICE

BACKGROUND OF THE INVENTION

The present invention relates to a master making device for a stencil printer and a stencil for use therewith.

A stencil printer with a thermosensitive digital master making capability is extensively used as a simple printer. The stencil printer is operable with a thermosensitive stencil having a thermoplastic resin film. In the stencil printer, a thermal head selectively cuts or perforates the stencil in accordance with image data. After the cut stencil or master has been wrapped around a print drum, ink is fed from the inside of the drum. The ink oozes out to the master via the porous wall of the drum. A sheet is pressed against the surface of the drum by a press roller or similar pressing means with the intermediary of the master. As a result, the ink is transferred from the drum to the sheet via perforations formed in the master, thereby forming an image on the sheet. The thermal head has a number of heating elements arranged in the main scanning direction corresponding to the axial direction of the drum. The heating elements selectively generate heat under selective current supply control, thereby cutting the corresponding portions of the stencil.

Japanese Utility Model Laid-Open Publication No. 63-178134, for example, teaches a stencil printer having a master making section and a document reading section for reading image data from a document. The document reading section is arranged above the master making section. With this arrangement, the printer is capable of performing image reading and master making consistently therein. When the printer runs out of the stencil, a new stencil is replenished into the printer by hand, as follows.

First, the document reading section positioned on the top of the printer is slid away from its operative or regular position, so that the entire master making section is visible from above the printer. Usually, a stencil is wound round a core in the form of a roll in order to save limited space available in the printer. The stencil roll is loaded in a roll support section included in the master making section from above the printer. Subsequently, the leading edge of the roll is pulled out from the roll and then cut at a preselected length or in a preselected shape. After the piece cut away from the stencil has been removed from the printer, the leading edge of the stencil is paid out to a preselected position. Thereafter, the document reading section is restored to its operative position.

The conventional stencil printer having the above configuration has various problems left unsolved, as follows. The roll replacing procedure described above is complicated and troublesome and needs expertness, i.e., a full-time operator. Because the stencil is often implemented by a relatively thin thermosensitive resin film, it is likely that the leading edge of the stencil is broken or bent when paid out from the roll.

To pay out the stencil from the roll, it is a common practice to rotate a core or shaft positioned at the center of the roll. Therefore, when the roll is new and has the maximum outside diameter, a great torque is required in order to rotate the core. The great torque not only increases the size of a drive mechanism but also often results in defective torque transmission.

In the event of the replacement of the roll, the document reading section must be slid away from its operative position, as stated earlier. This kind of construction increases the mechanical strength and weight required of the portion for mounting the document reading section as well as the number of structural parts. The result is an increase in the costs for machining and assembling the printer.

The amount of the stencil of the roll remaining on the core reaches a preselected limit amount in due course of time. Then, the entire roll must be entirely taken out of the master making section and discarded together with the core. As a result, the cost of supplies including the stencil and forming part of the running cost of the printer is increased.

SUMMARY OF THE INVENTION

It is therefore an object of the present invention to provide a master making device for a stencil printer and facilitating the loading of a stencil and capable of paying out the stencil without resorting to manual operation.

It is another object of the present invention to provide a master making device for a stencil printer and capable of surely paying out a stencil from a stencil roll.

It is still another object of the present invention to provide a master making device for a stencil printer allowing the operator to set a stencil roll therein without sliding a document reading section, thereby obviating an increase in mechanical strength and weight of a portion for mounting the reading device as well as an increase in the number of parts.

It is a further object of the present invention to provide stencil for a stencil printer and capable of reducing the cost of supplies for use with a master making device.

In accordance with the present invention, a master making device has a body. A stencil storing section stores a stencil in the form of a roll while allowing it to be paid out from the roll. A master making section makes a master out of the stencil paid out from the roll. A cutting device cuts off the master. A roll holding section is movable into and out of the body and sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll.

Also, in accordance with the present invention, a master making device is adapted for a stencil printer. A stencil storing section stores a stencil in the form of a roll while allowing it to be paid out from the roll. A master making section makes a master out of the stencil paid out from the roll. A cutting device cuts off the master. A roll holding section sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll. The roll holding section and master making section are constructed into a single master making unit movable into and out of a body of the stencil printer.

Further, in accordance with the present invention, a master making device has a body. A stencil storing section stores a stencil in the form of a roll while allowing it to be paid out from the roll. A master making section makes a master out of the stencil paid out from the roll. A cutting device cuts off the master. A roll holding section is movable into and out of the body and sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll. A platen pressure control section causes the master making section to selectively contact the stencil. An operation sensing device is mounted on the body for determining the time for the rotary drive device to start operating. A leading edge sensing device is located at a position toward which the leading edge of the stencil is paid out, and senses the leading edge of the stencil. A controller is connected at its input side to the operation sensing device and leading edge sensing device and at its output side to the rotary drive device and platen pressure control section. The controller causes, in response to an output signal of the operation sensing device, the rotary drive device to continuously pay out the leading edge of the stencil peeled off from the roll until the leading edge sensing device senses the leading edge, and then in response to an output signal of the leading edge sensing device, drives the platen pressure control section to set up a condition in which the master making section is capable of pressing the stencil.

Further, in accordance with the present invention, a master making device is adapted for a stencil printer. A stencil storing section stores a stencil in the form of a roll while allowing it to be paid out from the roll. A master making section makes a master out of the stencil paid out from the roll. A cutting device cuts off the master. A roll holding section sets the roll thereon. A rotary drive device causes the roll set on the roll holding section to rotate in a stencil pay-out direction for paying out the leading edge of the stencil toward the master making section. A peeling member peels the leading edge of the stencil from the roll by adjoining or contacting the circumference of the roll in accordance with the varying diameter of the roll. A platen pressure control section causes the master making section to selectively contact the stencil. An operation sensing device is mounted on a body of the stencil printer for determining the time for the rotary drive device to start operating. A leading edge sensing device is located at a position toward which the leading edge of the stencil is paid out, and senses the leading edge of the stencil. A controller is connected at its input side to the operation sensing device and leading edge sensing device and at its output side to the rotary drive device and platen pressure control section. The roll holding seciton and master making section are constructed into a single master making unit movable into and out of a body of the stencil printer. The controller causes, in response to an output signal of the operation sensing device, the rotary drive device to continuously pay out the leading edge of the stencil peeled off from the roll until the leading edge sensing device senses the leading edge, and then in response to an output signal of the leading edge sensing device, drives the platen pressure control section to set up a condition in which the master making section is capable of pressing the stencil.

Further, in accordance with the present invention, a master making device has a body. A stencil storing section stores a stencil in the form of a roll while allowing it to be paid out from the roll. A master making section makes a master out of the stencil paid out from the roll. A cutting device cuts off the master. A roll holding section is movable into and out of the body and sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll. A platen pressure control section causes the master making section to selectively contact the stencil. An operation setting device allows the time for the rotary drive device to start operating to be set. A leading edge sensing device is located at a position toward which the leading edge of the stencil is paid out, and senses the leading edge of the stencil. A controller is connected at its input side to the operation setting device and leading edge sensing device and at its output side to the rotary drive device and platen pressure control section. The controller causes, in response to an output signal of the operation setting device, the rotary drive device to continuously pay out the leading edge of the stencil peeled off from the roll until the leading edge sensing device senses the leading edge, and then in response to an output signal of the leading edge sensing means, drives the platen pressure control section to set up a condition in which the master making section is capable of pressing the stencil.

Further, in accordance with the present invetion, a master making device is adapted for a stencil printer. A stencil storing section stores a stencil in the form of a roll while allowing it to be paid out from the roll. A master making section makes a master out of the stencil paid out from the roll. A cutting device cuts off the master. A roll holding sections sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll. A platen pressure control section causes the master making section to selectively contact the stencil. An operation setting device allows the time for the rotary drive means to start operating to be set. A leading edge sensing device is located at a position toward which the leading edge of the stencil is paid out, and senses the leading edge of the stencil. A controller is connected at its input side to the operation setting device and leading edge sensing device and at its output side to the rotary drive device and platen pressure control section. The roll holding section and master making section are constructed into a single master making unit movable into and out of a body of the stencil printer. The controller causes, in response to an output signal of the operation setting device, the rotary drive device to continuously pay out the leading edge of the stencil peeled off from the roll until the leading edge sensing device senses the leading edge, and then in response to an output signal of the leading edge sensing device, drives the platen pressure control section to set up a condition in which the master making section is capable of pressing the stencil.

Further, in accordance with the present invention, a master making device has a body. A stencil storing section stores a stencil in the form of a roll while allowing it to be paid out from the roll. A master making section makes a master out of the stencil paid out from the roll. A cutting device cuts off the master. A roll holding section is movable into and out of the body and sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll. A stencil conveying member conveys the leading edge of the stencil peeled off from the roll while contacting the peeling member.

In addition, in accordance with the present invention, a master making device is adapted for a stencil printer. A stencil storing section stores a stencil in the form of a roll while allowing it to be paid out from the roll. A master making section makes a master out of the stencil paid out from the roll. A cutting section cuts off the master. A roll holding section sets the roll thereon. A rotary drive device causes the roll set on the roll holding section to rotate in a stencil pay-out direction for paying out the leading edge of the stencil toward the master making section. A peeling member peels off the leading edge of the stencil from the roll by adjoining or contacting the circumference of the roll in accordance with the varying diameter of the roll. A stencil conveying member conveys the leading edge of the stencil peeled off from the roll while contacting the peeling member. The roll holding section and master making section are constructed into a single unit movable into and out of a body of the stencil printer.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
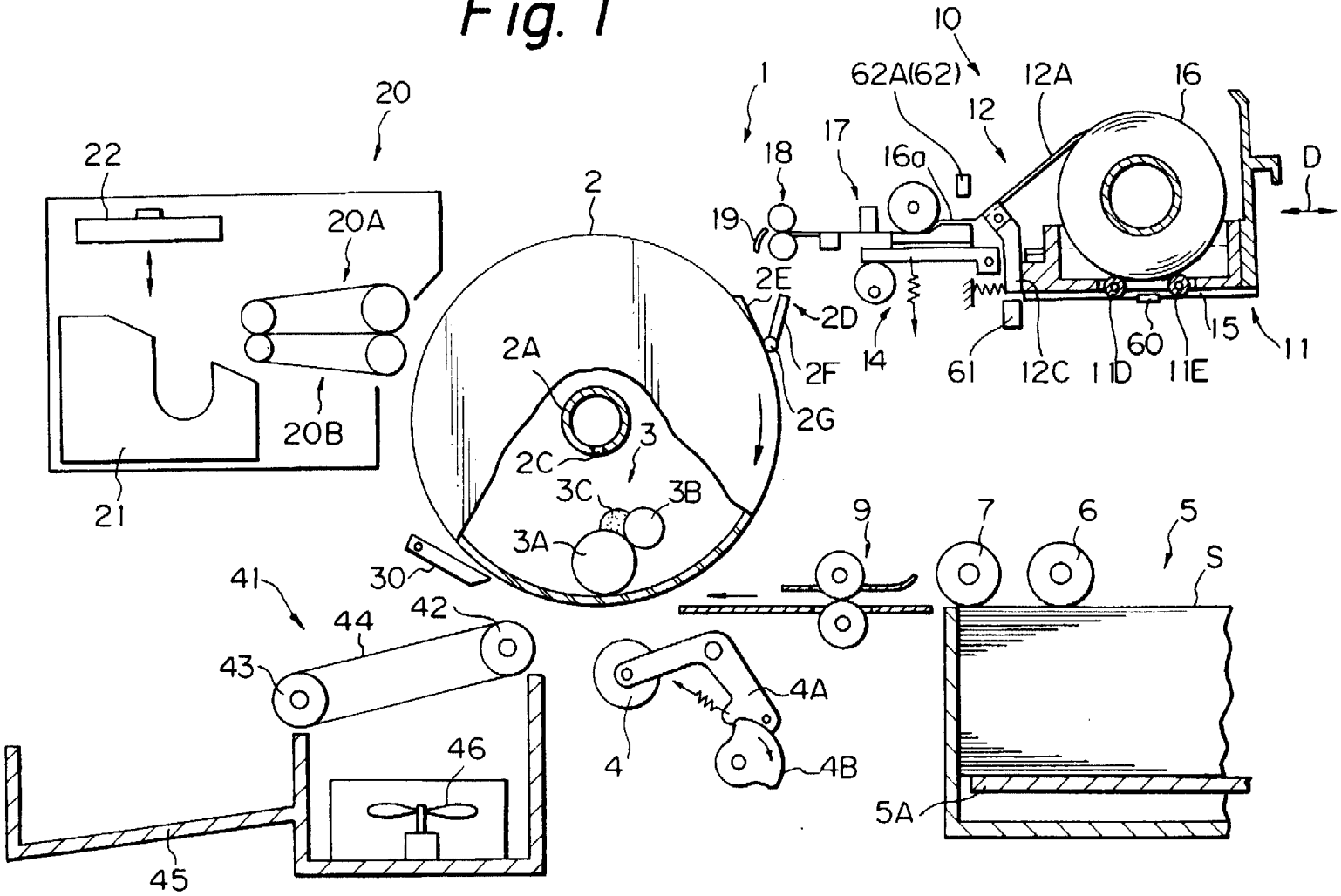
FIG. 1 shows the general construction of a stencil printer to which a first embodiment of the master making device in accordance with the present invention is applied.

Preferred embodiments of the present invention will be described with reference to the accompanying drawings. In the drawings, various component parts are selectively omitted for the sake of illustration. As for each pair of parts which do not need distinction, only one of them will be described, as the case may be. Regarding the description of the individual part and its position, the terms "front" and "rear" respectively refer to the downstream side and upstream side in a stencil transport direction or master pay-out direction. The right-hand side and left-hand side in the widthwise direction of a stencil, as seen in the stencil transport direction, will sometimes be respectively referred to as "right (rear in a direction perpendicular to the sheets surfaces of the drawings)" and "left (front as seen in the same direction)". In the embodiments and their modifications, identical parts and elements are designated by identical reference numerals and will not be repeatedly described in order to avoid redundancy.

First, a stencil printer to which the present invention is applied and operable with a cut stencil or master will be described with reference to FIG. 1. As shown, the stencil printer, generally 1, has a printing section including a print drum 2, a sheet feeding device 5, a master making device 10, a master discharging device 20, and a sheet discharging device. Among them, the master making device 10 is unique to the present invention. The other devices including the sheet feeding device 5 and master discharging device 20 are conventional.

The print drum 2 is reversibly rotatable about a shaft 2A. Specifically, the drum 2 is rotated clockwise in the event of printing, but counterclockwise in the event of the discharge of a used master. The drum 2 has a conventional structure and function for wrapping a cut or perforated stencil therearound. A number of pores are formed in the drum 2 except for a part thereof. A thin mesh screen, not shown, is provided on the outer periphery of the drum 2. The mesh screen may be implemented by synthetic fibers or metal, as desired.

A damper 2D for clamping the leading edge of a master is mounted on the part of the drum 2 where the pores are not formed. The damper 2D has a stage 2E and a clamp member 2F. The stage 2E has a master laying surface extending along one line parallel to the axis of the drum 2. The clamp member 2F is rotatable about a pivot shaft 2G toward and away from the stage 2E. The stage 2E is formed of a magnetic material while the clamp member 2F is implemented by a rubber magnet. After the leading edge of a master has been positioned on the stage 2E, the clamp member 2F is moved toward the stage 2E in order to clamp the master. The portion of the master following the leading edge adheres to the surface of the drum 2 due to the viscosity of ink fed to the surface of the drum 2 from an ink supply mechanism 3.

The ink supply mechanism 3 is disposed in the drum 2 and positioned substantially immediately below the shaft 2A. An ink roller 3A and a doctor roller 3B are the major components of the mechanism 3. The ink roller 3A is formed of metal and located to face a rotatable press roller 4, which will be described, with the intermediary of the drum 2. The ink roller 3A rotates in contact with the inner periphery of the drum 2 at a peripheral speed synchronous to the peripheral speed of the drum 2. Ink is deposited on the ink roller 3A in an amount regulated by the doctor roller 3B and fed to the pores of the drum 2 and mesh screen by the roller 3A. Specifically, ink is dropped from an opening 2C formed in the shaft 2A to a wedge-shaped space or ink well 3C formed by the rollers 3A and 3B. The ink roller 3A plays the role of a backup roller at the same time. When the press roller 4 is pressed against the drum 2, the backup roller 3A protects the drum 2 from deformation.

The press roller 4 is located below the ink roller 3A and faces it with the intermediary of the drum 2. The press roller 4 is rotatably supported by each of opposite free ends of a rotatable arm 4A and movable toward and away from the drum 2. The other free end of the arm 4A is held in pressing contact with the contour of a sector cam 4B. A drive section, not shown, causes the sector cam 4B to rotate in synchronism with the feed of a sheet S from the sheet feeding device 5. While the sheet S is not fed from the device 5, the drive section causes the cam 4B to face the end of the arm 4A at its larger diameter portion.

Specifically, when the sheet S is fed from the sheet feeding device 5, the cam 4B rotates until its smaller diameter portion faces the end of the arm 4A, thereby causing the arm 4A to rotate clockwise, as viewed in FIG. 1. As a result, when the sheet S arrives at the gap between the drum 2 and the press roller 4, the roller 4 is raised and pressed against the outer periphery of the drum 2. As the sheet S is pressed against the drum 2 via the master, the ink is transferred to the sheet S via the perforations of the master. In this sense, the position where the press roller 4 is pressed against the drum 2 defines an image transfer position.

The sheet feeding device 5 is located at the right of the press roller 4, as viewed in FIG. 1. The device 5 has a pick-up roller 6, a separator roller 7 and a pair of registration rollers 9 sequentially arranged in an intended direction of sheet feed. Sheets S are stacked on a tray SA. The pick-up roller 6 is movable into contact with the top sheet S of the stack relative to the sheet S. On contacting the top sheet S, the roller 6 drives it in the direction of paper feed indicated by an arrow in FIG. 1. The tray 5A is elevatable to cause the sheet S to contact the roller 6. When the tray 5A is to be replenished with sheets, it is lowered to form a replenishing space above it. The separator roller 7 is also rotatable in contact with the top sheet S. To allow only the top sheet S to be fed, the coefficient of friction between the separator roller 7 and the top sheet S is selected to be greater than the coefficient of friction between the sheets S. The registration rollers 9 face each other with the intermediary of a sheet feed path. These rollers 9 drive the sheet S toward the previously mentioned image transfer position at a predetermined timing.

Assume that the tray 5A is raised until the top sheet S contacts the pick-up roller 6. Then, the pick-up roller 6 i s rotated in response to a signal output from a sensor, not shown. While the pick-up roller 6 feeds the sheet S toward the registration roller pair 9, the separator roller 7 separates the top sheet S from the underlying sheets. The sheet S is brought to a stop when its leading edge abuts against the roller pair 9. At the time when press roller 4 is pressed against the drum 2, the roller pair 9 again drives the sheet S toward the image transfer position, i.e., to between the drum 2 and the press roller 4 such that its print start position meets an image formed in the master. Then, a conventional printing operation is effected to form an image on the sheet S.

The master making device 10 embodying the present invention is located at the right of and above the drum 2. Let this embodiment be referred to as a first embodiment. A master or stencil transport path extends from the right to the left of the master making device 10, as viewed in FIGS. 1 and 2. The right side and left side of the master transport path or master transport direction will be sometimes referred to simply as "right" and "left", respectively. Also, the upstream side and downstream side in the above direction will be sometimes referred to as "rear" and "front", respectively.

Figure 2:
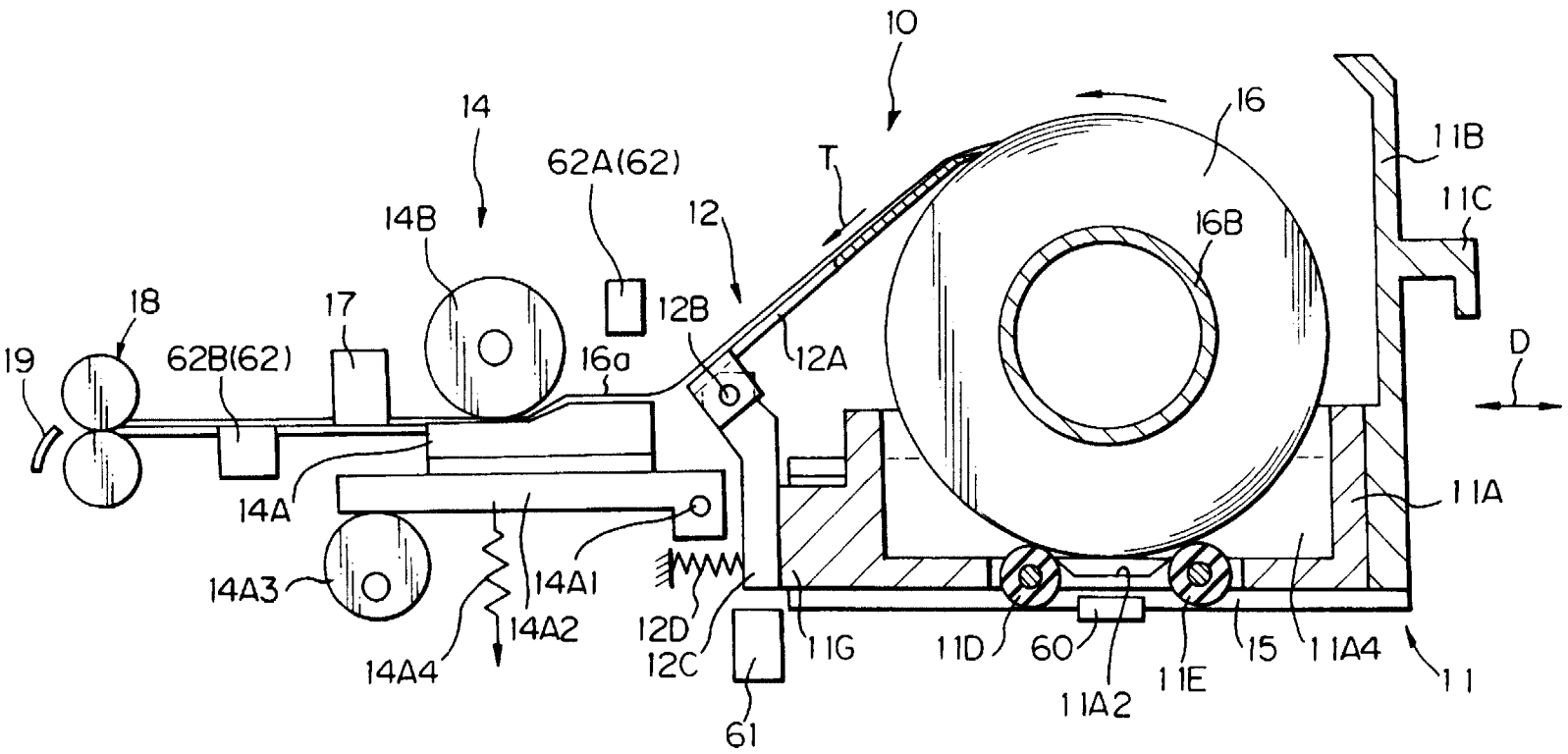
FIG. 2 is an partly sectional enlarged front view of the master making device shown in FIG. 1.
Figure 3:
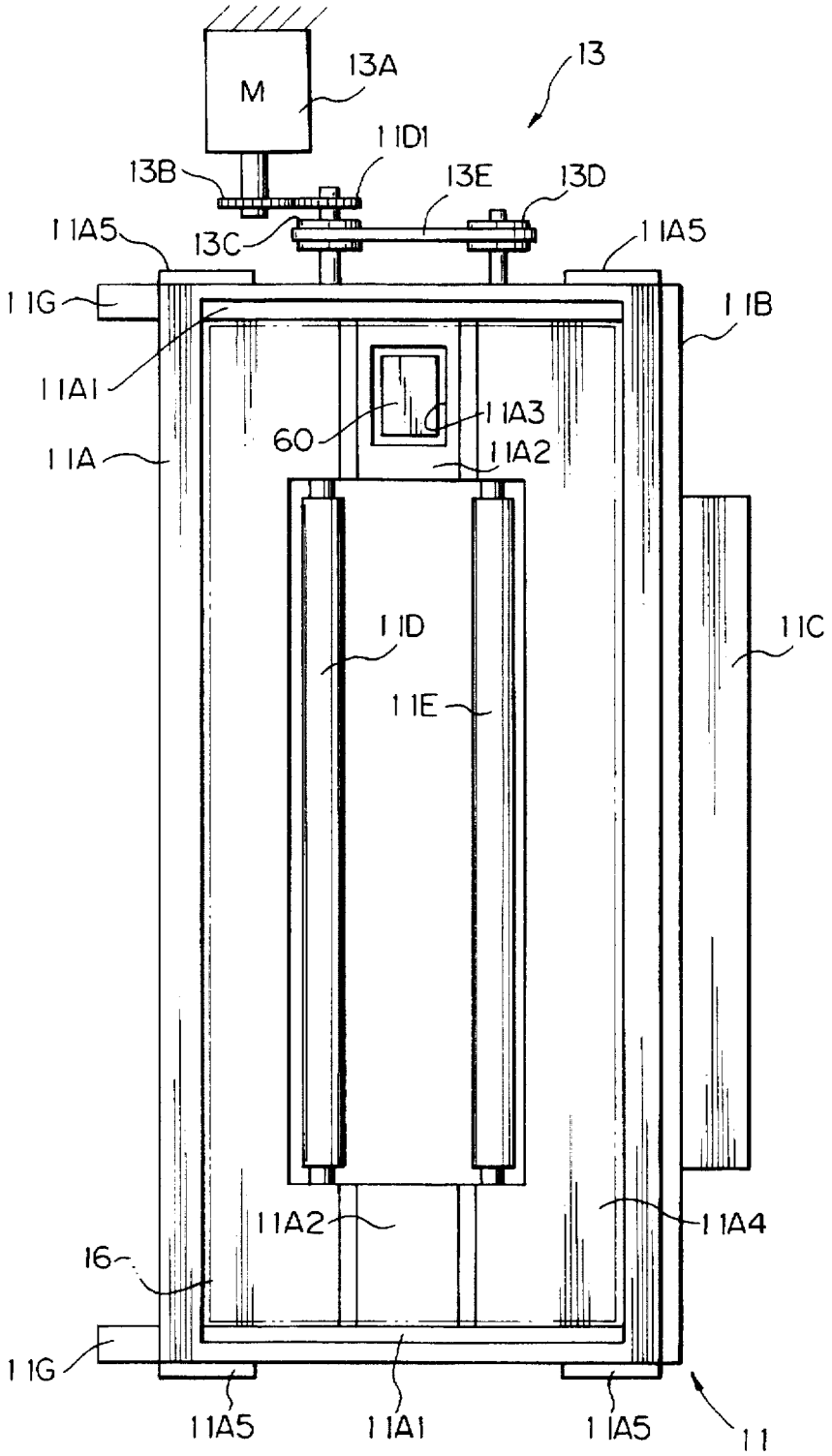
FIG. 3 is a plan view of showing a roll holding section included in the first embodiment.
Figure 4:
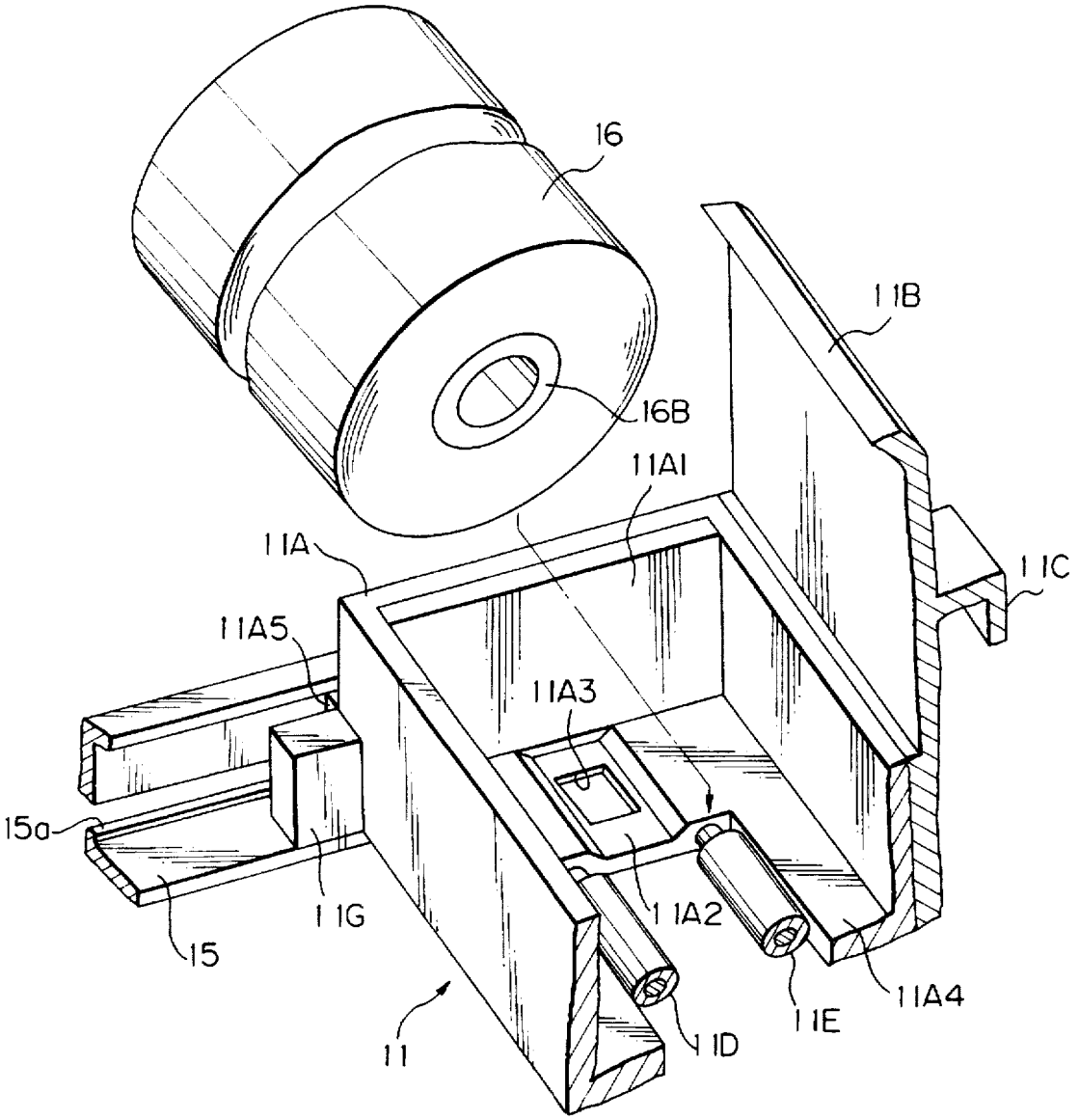
FIG. 4 is a fragmentary perspective view of the roll holding section shown in FIG. 3.

As shown in FIGS. 2, 3 and 4, the master making device mainly consists of a roll holding section 11, stencil peeling means 12, a stencil drive section 13, and a platen pressure control section 14. This embodiment has an arrangement for automatically stripping off the leading edge of a stencil **16*a* from a stencil roll 16 and paying it out. The roll holding section 11 is mounted on the body of the device 10 and can be pulled out of the body, as desired. The roll holding section 11 has stencil storing means, which will be described, for storing the roll 16. Rotary drive means, which will be described, is associated with the stencil storing means in order to cause the roll 16 to rotate in the direction in which the leading edge of the stencil 16*a* is paid out toward master making means which will be described. Peeling means, which will be described, contacts or adjoins the circumferential surface of the roll 16 in accordance with the varying diameter of the roll 16, thereby stripping off the leading edge of the stencil 16*a* from the roll 16**.

The stencil **16*a* has a laminate structure comprising a thermoplastic resin film permeable to light and as thin as 1 micron to 2 microns, and a porous substrate adhered to the resin film. The substrate is implemented by Japanese paper fibers or synthetic fibers or a combination thereof. The stencil 16a is cut or perforated by heat generated by a thermal head or similar heating device. Advantageously, the stencil 16a** has a thickness between 3 microns and 60 microns.

Figure 10:
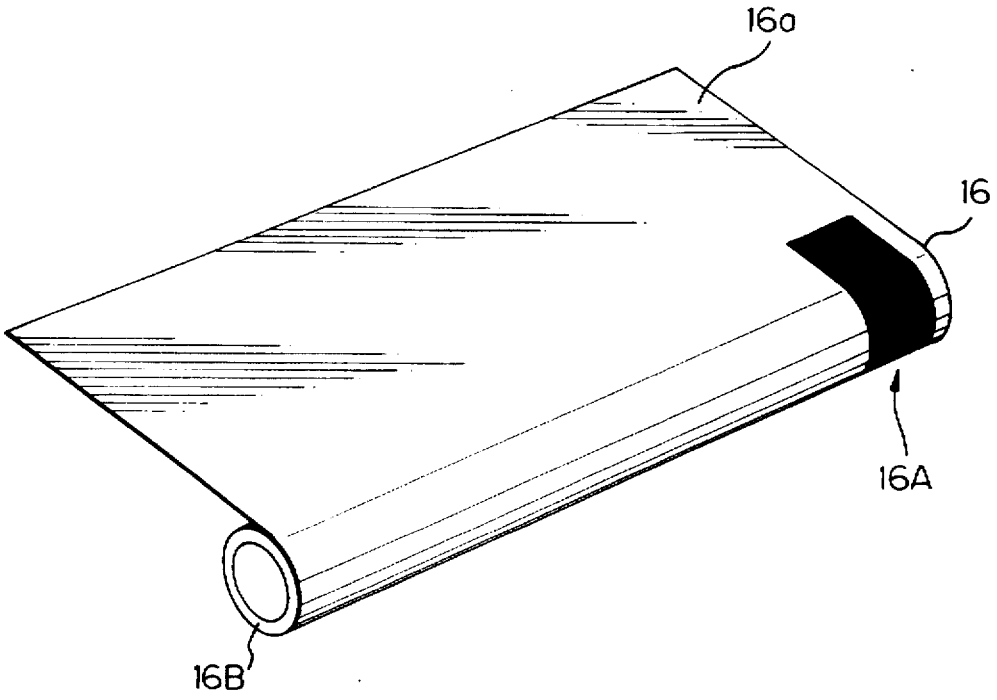
FIG. 10 is a perspective view showing a specific configuration of a stencil roll applicable to the first embodiment.

As shown in FIG. 4, the stencil 16a is wound round a tubular core 16B identical in width with the stencil 16a. It has been customary with a stencil roll to wind a stencil round a core extending out from the axially opposite ends of the roll. By contrast, in the illustrative embodiment, the stencil 16a is wound round the tubular core 16B whose opposite ends are flush with the ends of the roll 16. As shown in FIG. 10, the roll 16 includes a low reflectance portion 16A extending from its preselected limit diameter position which is the end of the usable length to the end in the direction of winding. To form such a portion 16A, the roll 16 may be painted black by way of example. The roll 16 is put in a cavity 11 A4 formed in a roll holder 11A such that the leading edge of the stencil 16a can be paid out toward the drum 2.

A pair guide members 15 are positioned in the master making device 10, and each is channel-shaped as viewed in a section, as best shown in FIG. 4. The guide members or channels 15 extend over a preselected length in the stencil transport direction at both sides of the stencil transport path with their open ends facing each other. The guide members 15 are respectively affixed to a right and a left side wall, not shown, included in the device 10. The right guide member, or rear guide member in the direction perpendicular to the sheet surface, is formed with an elongate slot 15a in its lower portion. The slot 15a extends over the range in which the roll holding section 11 is movable. Drive rollers 11D and 11E which will be described have shafts protruding to the right-hand side of the device 10 through the slot 15a.

The roll holding section 11 has a pair of friction members 11A1, a closure member 11B, a handle 11C, presser portions 11G and projections 11A5 in addition to the roll holder 11A and drive rollers 11D and 11E. The stencil storing means having the previously stated structure and function is implemented by the friction members 11A1 and drive rollers 11D and 11E. The presser portions 11G and projections 11A5 are formed of, e.g., synthetic resin integral with each other and suitably reinforced by the insertion of sheet metal. The roll holder 11A is a box having openings at its top and bottom and allows the roll 16 to be loaded therein. The cavity 11A4 of the roll holder 11A is capable of receiving a part of the lower half of the roll 16.

As shown in FIGS. 3 and 4, the right and left side walls of the roll holder 11A are each formed with the projections 11A5 having a rectangular section and received in the open end of the respective guide member or channel 15. Specifically, two projections 11A5 are formed on each side wall of the roll holder 11A. The two projections 11A5 of each side wall are received in the respective guide member 15 and smoothly slidable therein, so that the roll holder 11A is movable over a predetermined range between the upstream side and the downstream side of the master transport path. Stated another way, the roll holding section 11 is slidable between an operative position for allowing the stencil 16a to be paid out from the roll 16 and an inoperative position for allowing the roll 16 to be loaded in the holding section 11 by hand. The inoperative position includes a position where the holding section 11 is pulled out of the device 10.

The friction members 11A1 are respectively provided on the inner surfaces of the roll holder 11A facing each other in the direction perpendicular to a stencil pay-out direction T which is identical with the stencil transport direction. When the roll 16 is loaded in the roll holder 11A, the friction members 11A1 face and contact the opposite ends of the roll 16. The friction members 11A1 may be formed of rubber or sponge rubber by way of example. When the stencil 16a is paid out from the roll 16, the friction members 11A1 contacting the roll 16 position it in the widthwise direction of the stencil 16a. At the same time, the friction members 11A1 generate resistance due to friction opposite in direction to the pay-out of the stencil 16a. As a result, back-tension acts on the stencil 16a being paid out from the roll 16 and thereby prevents the stencil 16a from slackening.

Because the friction members 11A1 position the roll 16 loaded in the cavity 11A4 of the roll holder 11A, it is only necessary for the operator to drop the roll 16 into the cavity 11A4. This eliminates the need for positioning relying on the previously stated conventional core configuration.

Consequently, the tubular core 16B needs a minimum amount of material and therefore a minimum of cost.

The closure member 11B is positioned at the rear portion of the roll holder 11A and forms a part of an end wall. The handle 11C is positioned on the rear or outer surface of the closure member 11B. By holding the handle 11C, the operator may move the roll holder 11A in opposite directions, as indicated by an arrow D. Specifically, the operator may pull the roll holder 11A to the right, as viewed in FIG. 2, out of the device 10 in order to load it with the roll 16, and then push the holder 11A into the device 10 in the opposite direction. The presser portions 11G are positioned at the right and left edges of the end wall of the roll holder 11A opposite to the closure member 11B. The presser portions 11G are selectively engageable with a peeler support member 12C which will be described.

Figure 9:
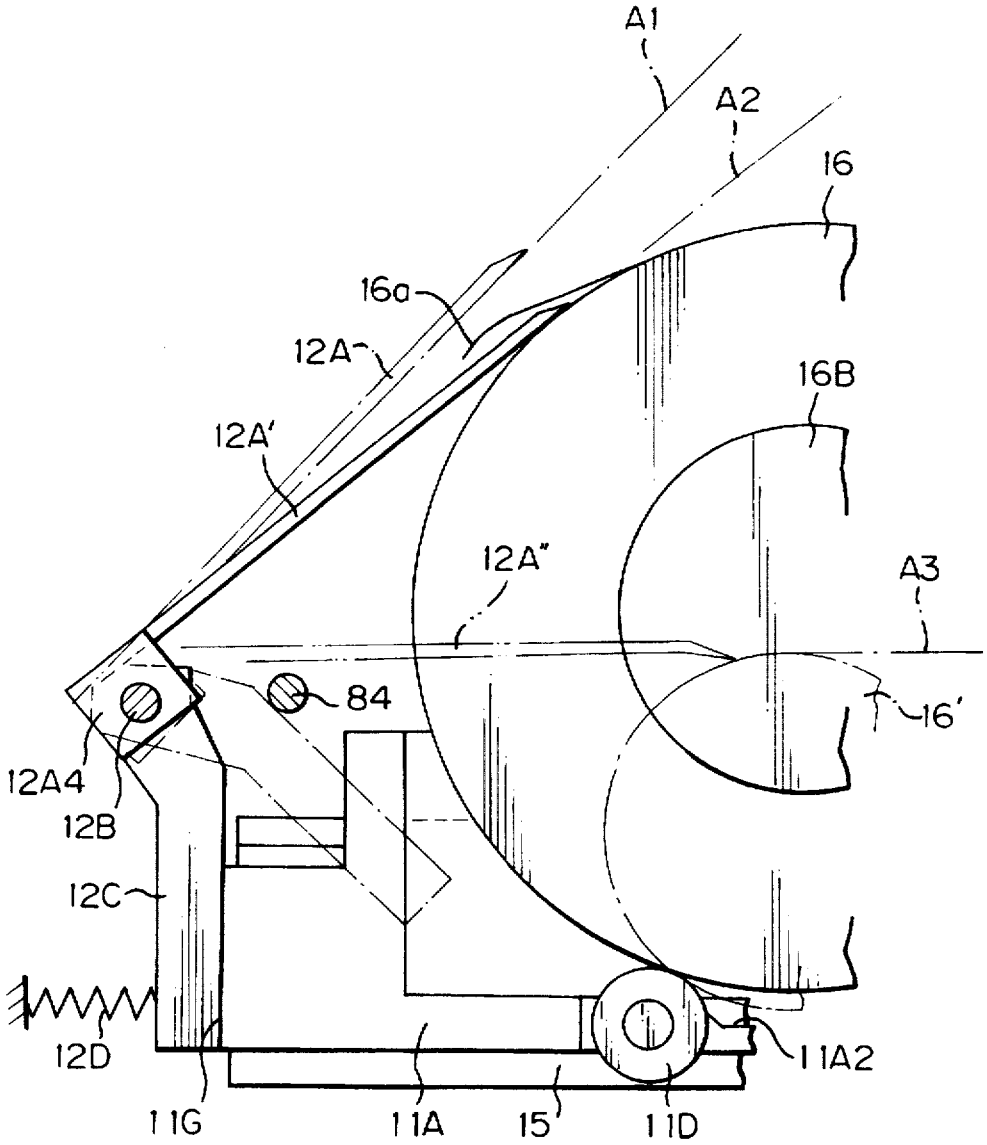

As shown in FIGS. 3 and 4, the bottom wall of the roll holder 11A is formed with a window 11A3 in the vicinity of the right guide member 15. When the roll holder 11A is pushed into the device 10 as far as the previously mentioned operative position, stencil sensing means 60 which will be described faces the window 11A3. Recesses 11A2 are formed in the bottom wall of the roll holder 11A around the window 11A3 and around a portion opposite to the window 11A3. As the stencil 16a is sequentially paid out from the roll 16, the diameter of the roll 16 sequentially decreases. As shown in FIG. 9, when the roll 16 changes into a roll 16' having a limit diameter substantially equal to the outside diameter of the core 16B, the recesses 11A2 serve to prevent the bottom wall from interfering with the roll 16'.

The detailed configurations of the roll holder 11A, friction members 11A1 and so forth are not shown in the figures. Of course, the portions of such members which are likely to contact the stencil 16a when the roll 16 is loaded in the cavity 11A4 are rounded, tapered or otherwise machined so as not to damage the stencil 16a.

The drive rollers 11D and 11E are so positioned as to contact the circumference of the roll 16 when the roll 16 is loaded in the cavity 11A4. The drive rollers 11D and 11E constitute the stencil storing means, as stated earlier. At the same time, the rollers 11D and 11E play the role of rotary drive means for causing the roll 16 to rotate in the direction for paying out the leading edge of the stencil 16a toward the master making means. The drive rollers 11D and 11E are rotatable with the opposite ends of their shafts rotatably supported by the bottom wall portion of the roll holder 11A. A motor 13A (see FIG. 3) is included in the stencil drive section 13 and causes the drive rollers 11D and 11E to rotate, as will be described specifically later. The drive rollers 11D and 11E are formed of rubber, sponge rubber or similar material having a coefficient of friction lying in a preselected range. With such a coefficient of friction, the drive rollers 11D and 11E are capable of rotating the roll 16 while contacting the circumference of the roll 16.

The drive rollers 11D and 11E are parallel to each other and spaced in the stencil pay-out direction T by a preselected center angle with respect to the axis of rotation of the roll 16. Specifically, the drive rollers 11D and 11E are positioned such that when the core 16B of the roll 16 falls to the vicinity of the recesses 11A2 due to the decreasing diameter of the roll 16, the circumference of the roll 16 contacts the drive rollers 11D and 11E at even positions with respect to the axis of the roll 16. Further, assume the roll 16' has substantially only the core 16B due to the consumption of the stencil 16*a*. Then, the drive rollers 11D and 11E rotatably support the circumference of the core 16B.

The stencil drive section 13 has a construction and function for causing the roll 16 to rotate. As shown in FIG. 3 in detail, the stencil drive section 13 has a drive gear 13B, a driven gear 11D1, pulleys 13C and 13D and a belt 13E in addition to the drive rollers 11D and 11E and motor 13A. The motor 13A is mounted on the right side wall of the device 10 adjoining the inoperative position of the roll holding section 11. The gear 13B is mounted on the output shaft of the motor 13A. When the stencil 16*a* is to be paid out from the roll 16 set in the roll holder 11A, the motor 13A is rotated in the direction opposite to the stencil pay-out direction T and then rotated in the direction T, as will be described specifically later. The pulleys 13C and 13D are respectively affixed to the shafts of the drive rollers 11D and 11E while the belt 13E is passed over the pulleys 13C and 13D. The driven gear 11D1 is mounted on the shaft of the roller 11D and brought into mesh with the drive gear 13B when the roll holder 11A is inserted into the device 10 as far as the operative position. The output torque of the motor 13A is transmitted to the pulley 13D via the drive gear 13B, driven gear 11D1, pulley 13C, and belt 13E. As a result, the drive rollers 11D and 11E are caused to rotate in the same direction.

As shown in FIG. 2, peeling means 12 is located at a position corresponding to the operative position of the roll holder 11A. The peeling means 12 mainly consists of a pallet-like peeler 12A and the previously mentioned peeler support member 12C. The peeler 12A adjoins or contacts the circumference of the roll 16 whose diameter sequentially changes, thereby peeling off the leading edge of the stencil 16*a* from the roll 16. The peeler 12A is supported by the peeler support member 12C.

Specifically, as shown in FIG. 9, the peeler 12A is angularly movable between a contact position (solid line and dash-and-dots line) where its free end contacts the roll 16 and a non-contact position (dash-and-dot line) where the free end is spaced from the roll 16. The peeler 12A is movably supported by the peeler support member 12C, a compression spring 12D and the presser portions 11G via a shaft 12B. As shown in FIGS. 5–8, the peeler 12A is formed with bearing portions 12A4 at its right and left ends. The bearing portions 12A4 each has a hole 12A3. The shaft 12B is passed through the holes 12A3 for allowing the peeler 12A to angularly move in the above-mentioned manner.

The peeler 12A and peeler support members 12C have their base ends supported by the common shaft 12B. The shaft 12B is fixedly supported by the right and left side walls of the device 10. The peeler 12A is implemented as a thin elastic member except for the base end including the bearing portions 12A4. The peeler 12A is formed of metal, resin or similar elastic material. The elasticity of the peeler 12A i s preselected such that when the free end of the peeler 12A contacts the circumference of the roll 16, it does not damage the stencil 16*a*. That is, when the free end of the peeler 12A contacts the roll 16, it elastically deforms so as not to exert an unusual load on the stencil 16*a*.

Figure 5:
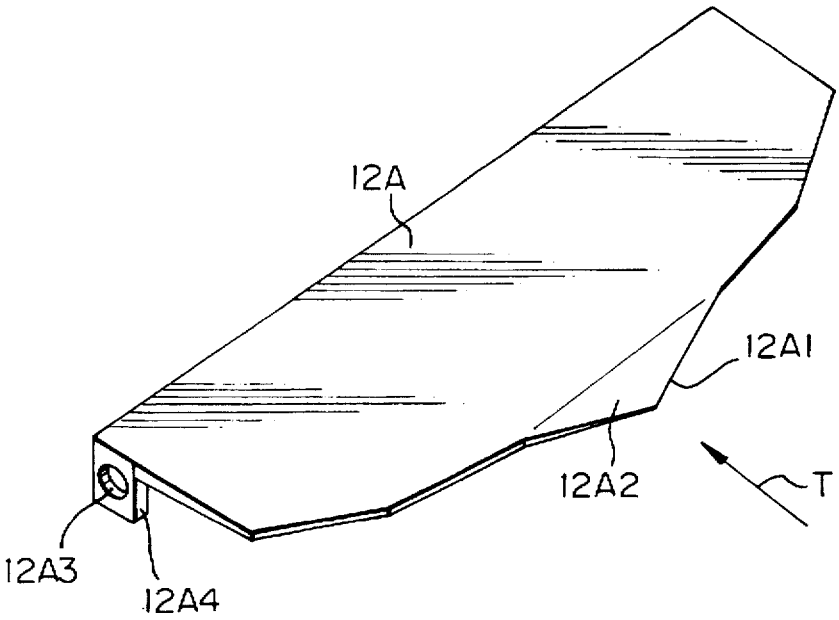
FIG. 5 is a perspective view showing a specific configuration of a peeler included in the first embodiment.

As shown in FIG. 5, the peeler 12A has a projection 12A1 at its intermediate portion in the widthwise direction of the roll 16. The projection 12A1 extends from the opposite sides of the peeler 12A in the widthwise direction of the roll 16 to the upstream side in the stencil pay-out direction T. As shown in FIGS. 5 and 9, the projection 12A1 forms an inclined portion 12A2 inclined toward the circumference of the roll 16. The inclined portion 12A2 is capable of contacting or adjoining the circumference of the roll 16 due to the weight of the peeler 12A. Specifically, as seen in a plan view, the peeler 12A is sequentially flared from the upstream side to the downstream side in the stencil pay-out direction T. With this configuration, the peeler 12A first peels off the intermediate portion of the leading edge of the stencil 16*a* in the widthwise direction of the stencil 16*a*, and then sequentially peels off the other portion of the leading edge up to the opposite side edges while guiding the peeled portion.

The projection 12A1 is formed as thin as possible in relation to the stencil 16*a*, preferably 3 microns to 50 microns. In the above condition, when the free end of the peeler 12A contacts or adjoins the circumference of the roll 16, it sequentially peels off the stencil 16*a* from the center toward the opposite side edges in the widthwise direction of the roll 16. This successfully reduces the resistance acting on the stencil 16*a* and thereby surely separates the stencil 16*a* from the roll 16. In addition, because the free end of the peeler 12A is inclined toward the the roll 16, only the inclined portion 12A2 faces the the roll 16 and faces the inner surface of the leading edge of the stencil 16*a* separated from the roll 16. This reduces the area over which the peeler 12A contacts the roll 16 and thereby reduces the resistance acting on the stencil 16*a*, while easily turning up the leading edge of the stencil 16*a* away from the roll 16.

The compression spring 12D is anchored at one end to the peeler support member 12C and at the other end to a stationary member included in the body of the device 10. The peeler 12A is therefore usually biased away from the circumference of the roll 16. A stop 84 shown only in FIG. 9 is affixed to the right side wall above the guide member 15. When the peeler support member 12C is rotated toward the roll 16 due to the bias of the spring 12D, the stop 84 stops the peeler support member 12C at such a position that the support member 12C can be pressed by the presser portions 11G of the roll holder 11A brought to its operative position.

The peeling means 12 having the above configuration is operated as follows. When the roll holder 11A is inserted into the device 10 as far as its operative position, the presser members 11G press the lower ends of the peeler support member 12C. As a result, the support member 12C moves the peeler 12A toward the circumference of the roll 16 against the action of the spring 12D. At this instant, if the free end of the peeler 12A contacts the circumference of the roll 16, then it is apt to damage the surface of the stencil 16*a*. In light of this, if the stencil 16*a* is of the kind elastic enough for its leading edge to rise by itself, then the peeler 12A may adjoin the circumference of the roll 16 at a distance which allows it to turn up the leading edge of the stencil 16*a*.

Assume that the free end of the peeler 12A adjoins the circumference of the roll 16 at some distance, as stated above. Then, it is possible to maintain such a distance by, e.g., sensing the varying outside diameter of the roll 16 with sensing means, not shown, and shifting the free end of the peeler 12A in response to the output of the sensing means. On the other hand, assume that the stencil 16a is of the kind not elastic enough for its leading edge to rise by itself. Then, the free end of the peeler 12A should preferably contact the surface of the stencil 16a under low pressure. This is why the free end of the peeler 12A is so configured as to contact the roll 16 due to the weight of the peeler 12A.

The peeler 12A serves not only as the peeling means but also as stencil guide means. When the leading edge of the stencil 16a is paid out from the roll 16, it slides on the upper surface of the peeler 12A toward the position where a thermal head 14A and a platen roller 14B face each other at the platen pressure control section 14.

When the roll holder 11A is pulled out of the device 10, the peeler support member 12C is rotated counterclockwise by the spring 12D to move the peeler 12A to the position labeled A1 in FIG. 9.

When the roll holder 11A is set at its operative position in the device 10, the presser portions 11G of the roll holder 11A cause the ends of the peeler support member 12C to rotate clockwise against the action of the spring 12D. As a result, the peeler 12A can move to a position where it contacts the circumference of the roll 16 due to its own weight, without regard to the varying outside diameter of the roll 16. As shown in FIG. 9, when the roll 16 has the maximum outside diameter, the peeler 12A (labeled 12A' for convenience) takes a position A2; when the former has the minimum outside diameter or limit diameter, the latter (labeled 12A" for convenience) takes a position A3. For this purpose, the support member 12C has a peeler support configuration shown in FIGS. 6 and 7. FIGS. 7 and 8 show how the ends of the support member 12C are pushed by the presser members 11G of the roll holder 11A against the action of the spring 12D when the roll holder 11A is inserted into the device 10.

Figure 6:
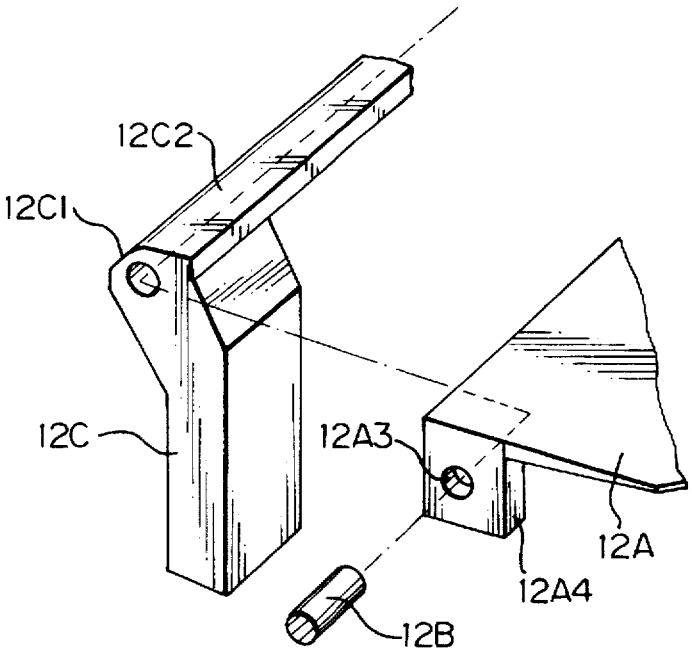
FIG. 6 is a fragmentary exploded perspective view of stencil peeling means included in the first embodiment.
Figure 7:
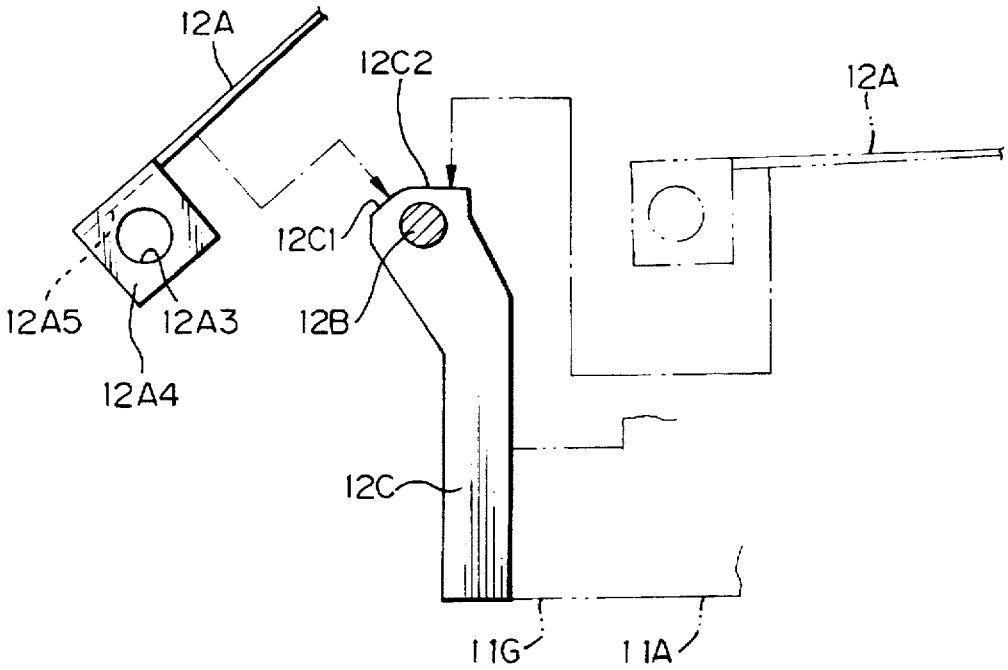
FIG. 7 is a schematic exploded view showing an essential part of the stencil peeling means.
Figure 8:
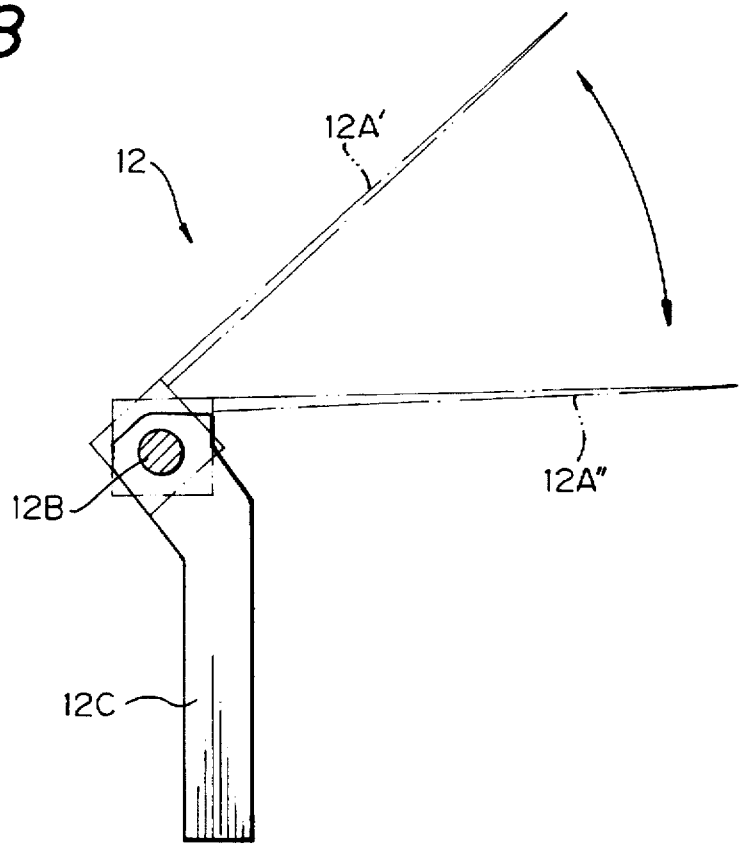
FIGS. 8 and 9 are schematic views showing the construction and operation of an essential part of the stencil peeling means.

As shown in FIGS. 6 and 7, the peeler support member 12C has an inclined surface 12C1 and a horizontal surface 12C2 at its upper end for supporting a receiving surface 12A5 included in the peeler 12A. The two surfaces 12C1 and 12C2 are contiguous with each other about the axis of the shaft 12B. The surfaces 12C1 and 12C2 are connected to each other by a rounded surface having a radius of rotation whose center is the axis of the shaft 12B, so that the free end of the peeler 12A is rotatable. The surface 12C1 allows the free end of the peeler 12A to contact the roll 16 having the maximum outside diameter. The surface 12C2 allows the free end of the peeler 12A to contact the roll 16' (see FIG. 9) having the minimum outside diameter.

The peeler support member 12C has a generally gate-like configuration, as seen in the stencil transport direction. Specifically, the inclined surface 12C1 and horizontal surface 12C2 extend in the widthwise direction of the stencil 16a below the stencil transport path. Posts extend downward from the right and left ends of the contiguous surfaces 12C1 and 12C2.

When the posts of the peeler support member 12C are pushed by the presser portions 11G of the roll holder 11A, the support member 12C is brought to a substantially upright position, as indicated by a solid line in FIG. 9. In this condition, the peeler 12A is freely rotatable in accordance with the varying outside diameter of the roll 16 (between A2 and A3 shown in FIG. 9) independently of the support member 12C. When the presser portions 11G are released from the support member 12C, the support member 12C is rotated about the shaft 12B to an inclined position indicated by a dash-and-dot line in FIG. 9. At this instant, the peeler 12A is inclined to the position A1 shown in FIG. 9, while the surface 12A5 is moved on the surface 12C2 of the support member 12C.

Such a configuration of the surface of the support member 12C allows the peeler 12A to angularly move in accordance with the diameter of the roll 16 varying from the maximum diameter to the minimum diameter.

As shown in FIG. 2, the platen pressure control section 14 is located downstream of the peeling means 12 in the stencil pay-out direction T. The control section 14 has the master making means consisting of the thermal head 14A and platen roller 14B. The thermal head 14A has a conventional function of selectively cutting or perforating the stencil 16a sequentially paid out from the roll 16 by heat. The head 14A is selectively moved into or out of contact with the platen roller 14B by a mechanism which will be described. The platen roller 14B is rotatable to convey the stencil 16a paid out from the roll 16 or the master 16a cut by the head 14A to the downstream side of the stencil transport path, while urging it against the head 14A. This function of the platen roller 14B is also conventional.

The platen roller 14B facing the thermal head 14A is rotated by a platen motor, not shown, via a drive transmission mechanism, not shown, as has been customary with a master making device. The platen motor may be implemented by a stepping motor by way of example. The head 14A and roller 14B are selectively moved into or out of contact with each other in order to exert a pressure on the stencil 16a or cancel it.

Head support arm 14A2 is rotatable about a shaft 14A1 supported by the previously mentioned opposite side walls. The thermal head 14A is affixed to one surface of the free end of the head support arm 14A2. The other surface or rear of the free end of arm 14A2 rests on an eccentric cam 14A3. A cam motor 14A30 (see FIG. 11) is affixed to the right side wall and causes the eccentric cam 14A3 to rotate. Tension springs 14A4 are each anchored at one end to the free end portion of the arm 14A2 and at the other end to the respective side wall, so that the arm 14A2 is constantly biased counterclockwise, as viewed in FIG. 2. The cam 14A3 therefore constantly contacts the rear of the arm 14A2.

The cam or pressure cancelling member 14A3 has a smaller diameter portion contacting the rear of the head support arm 14A2 when the master making device 10 is not operated. In this condition, the head 14A on the arm 14A2 is spaced from the stencil transport path, cancelling the pressure to act on the stencil 16a. When the head 14A is brought into contact with the platen roller 14B, the roller 14B is rotated by the platen motor in the direction in which the stencil 16a is paid out from the roll 16.

The platen pressure control section 14 having the above construction is operated as follows. To perforate the master 16a paid out from the roll 16, the eccentric cam 14A3 is rotated to bring its larger diameter portion into contact with the rear of the head support arm 14A2. The larger diameter portion urges the arm 14A2 and therefore the head 14 A rotates clockwise, as viewed in FIG. 2. As a result, the head 14A contacts the platen roller 14B. In this condition, the platen roller 14B conveys the stencil 16a while pressing it against the head 14A. The head 14A perforates the stencil 16a in the mainscanning and subscanning directions by selectively heating it. It is to be noted that the mainscanning and subscanning directions respectively correspond to the lengthwise direction of the platen roller 14B and the stencil pay-out direction T perpendicular thereto.

While the embodiment moves the head 14A toward the platen roller 14B, the roller 14B may, of course, be moved toward the head 14A, if desired.

At the time when the leading edge of the stencil 16a is paid out from the roll 16 to the head 14A, the cam 14A3 may be continuously rotated for a short period of time. This allows the head 14A to repeatedly move into and out of contact with the platen roller 14B with the intermediary of the stencil 16a. If the roller 14B is rotated in the stencil pay-out direction T in interlocked relation to the above repeated movement of the head 14A, then the stencil 16a located at the platen pressure control section 14 is pulled toward the downstream side intermittently. As a result, creases and other deformation of the stencil 16a can be removed on the basis of the friction acting on the opposite ends of the roll 16 in the cavity 11A4 of the roll holder 11A.

When the master making device 10 is not operated, the smaller diameter portion of the cam. 14A3 is held in contact with the rear of the head support arm 14A2. In this condition, the head 14A is spaced from the platen roller 14B so as to cancel the pressure acting on the stencil 16a.

As shown in FIGS. 1 and 2, a cutting device 17 is located on the stencil transport path downstream of the platen pressure control section 14. The cutting device 17 cuts the perforated stencil or master 16a and the leading edge and trailing edge of the stencil 16a. For the cutting device 17, use may be made of a guillotine cutter or a rotary cutter.

A pair of rollers 18 and a guide 19 are positioned on the stencil transport path downstream of the cutting device 17. The guide 19 guides the master 16a or the stencil 16a toward the damper 2D of the drum 2. After the cutting device 17 has cut the stencil 16a at a predetermined length, the rollers 18 and guide 19 convey the cut stencil or master 16a until its leading edge arrives at the stage 2E from which the clamp member 2F has been spaced. Then, the clamp member 2F is closed to hold the leading edge of the master 16a in cooperation with the stage 2E. One of the rollers 18 is connected to a conveyor motor 18A (see FIG. 11) affixed to the right side wall and driven thereby. Alternatively, a gear may be mounted on the end of the shaft of the roller 18 and held in mesh with a drive gear mounted on the output shaft of the platen motor, in which case an electromagnetic clutch will be provided between the shaft of the roller 18 and the gear.

A document reading section, not shown, is disposed in the upper portion of the stencil printer 1 shown in FIG. 1. The document reading section has a scanning portion including a glass platen. Light issuing from a light source also included in the scanning portion is incident to a document laid on the glass platen. The resulting reflection from the document is routed through optics including mirrors and a lens to a CCD (Charge Coupled Device) or similar image sensor. In response, the image sensor generates image data and sends them to a control section which will be described. The master making device 10 perforates the stencil 16a in accordance with the above image data.

In FIG. 1, the master discharging device 20 is located above and at the left of the drum 2. The master discharging device 20 has an upper and a lower discharge member 20A and 20B and a box 21. The discharge members 20A and 20B adjoin the drum 2 and have belts contacting each other. The belts are each passed over a roller adjoining the drum 2 and a roller adjoining the box 21. The used master 16a is removed from the drum 2 by the the belts and conveyed to the box 21 thereby. The lower discharge member 20B is capable of moving toward the circumference of the drum 2 when the drum 2 is rotated counterclockwise for discharging the used master 16a. In this condition, the discharge member 20B is capable of receiving the trailing edge of the master 16a and conveying it toward the box 21.

A compressing member 22 is positioned above the box 21 and movable up and down. After the used master 16a has been discharged into the box 21, the compressing member 22 compresses it in order to prepare a space for accommodating the next used master 16a. When the box 21 is filled with such waste masters 16a, it is pulled out of the stencil printer 1 in order to discard them.

As shown in FIG. 1, a sheet separator 30 is positioned below and downstream of the drum 2 with respect to the clockwise rotation of the same (indicated by an arrow). The free end of the sheet separator 30 is movable toward and away from the circumference of the drum 2. The sheet separator 30 separates the sheet S from the drum 2 and causes it to reach a conveyor 41. The conveyor 41 has an endless belt 44 passed over a pair of rollers 42 and 43 and constitutes the sheet discharging device. The sheets separated from the drum 2 are conveyed by the belt 44 to a tray 45. A fan 46 is positioned below the surface of the belt 44 on which the sheet S is carried. The fan 46 serves to hold the sheet S on the belt 44 by suction. The tray 45 may be configured to be rotatable about a shaft between an upright position and a flat position relative to the wall of the printer 1.

Figure 11:
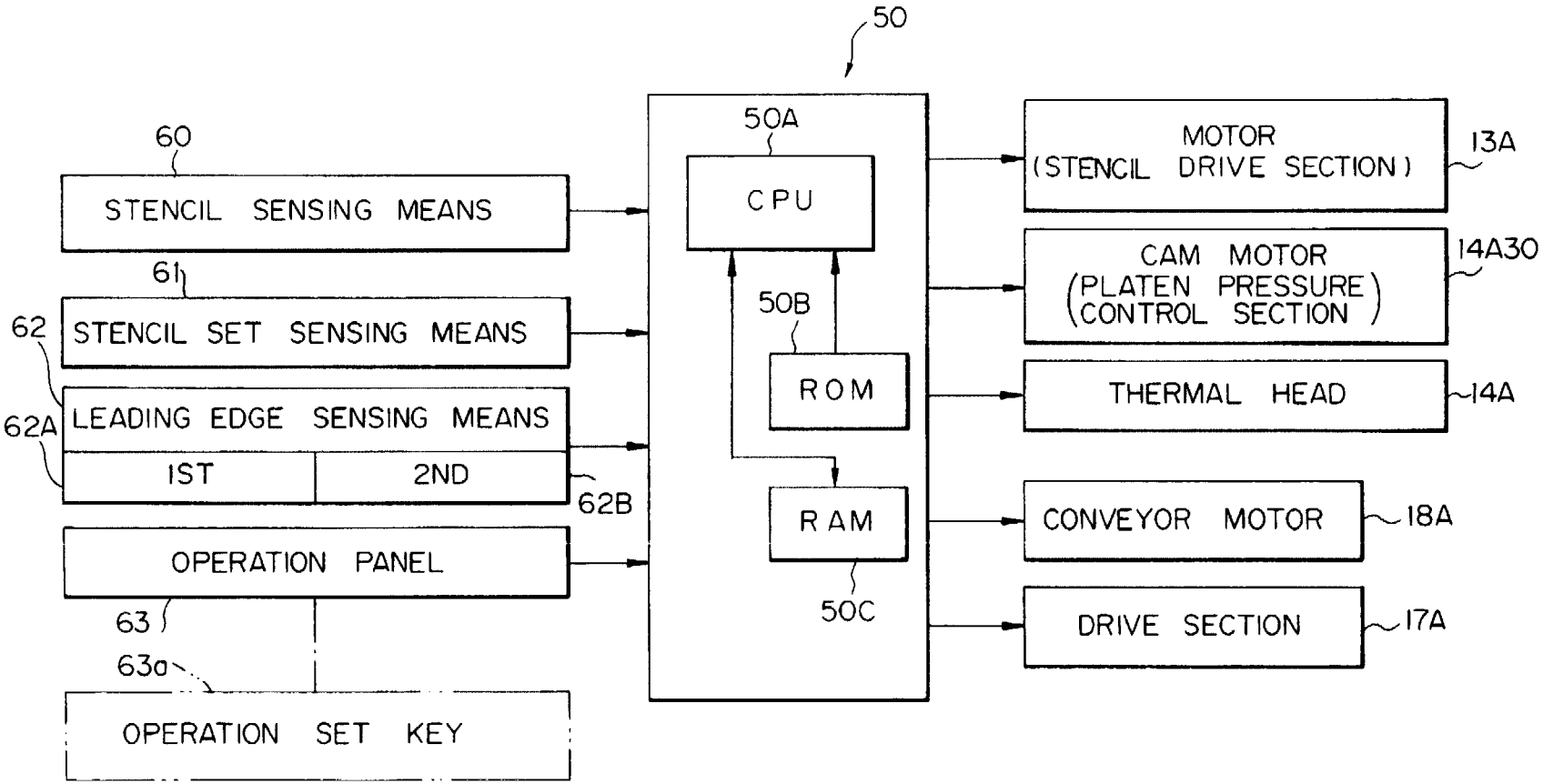
FIG. 11 is a block diagram schematically showing a controller included in the first embodiment.

Referring to FIG. 11, a controller 50 is shown which executes various kinds of control including the control over the master making device 10 based on the previously mentioned image data. As shown, the control section 50 has a CPU (Central Processing Unit) 5A, a ROM (Read Only Memory) 50B, and a RAM (Random Access Memory) 50C. The ROM 50B stores a basic program for controlling the sequence beginning with the reading of a document image and ending with the discharge of the sheet S. The RAM 50C is used to register data.

The part of the controller 50 relevant to the crux of the illustrative embodiment will be described hereinafter. The document reading section, stencil sensing means 60, stencil set sensing means 61, leading edge sensing means 62 and an operation panel 63 are each connected to the input side of the control section 50 via an I/O (Input/Output) interface, not shown. Connected to the output side of the control section 50 are the motor 13A of the stencil drive section 13, cam motor 14A30 of the platen pressure control section 14, platen motor for driving the platen roller 14B, thermal head 14A, conveyor motor 18A for driving the roller 18, and a drive section 17A for driving the cutting device 17. It is to be noted that an operation set key 63a enclosed by a dash-and-dots line are a control element which is not used in this embodiment.

As shown in FIGS. 1 and 2, the stencil sensing means 60 is implemented by a reflection type photosensor mounted on the bottom of the guide member 15 and having a light emitting element and a light-sensitive element. When the roll 16 is loaded in the cavity 11A4 of the roll holder 11A, the sensing means 60 senses the roll 16 on the basis of a reflection from the roll 16. Also, the sensing means 60 is responsive to the limit diameter of the roll 16. The roll 16 includes the black or low reflectance portion 16A, as described with reference to FIG. 10. When the roll 16 reaches the limit diameter due to the consumption of the stencil 16a, the sensing means 60 senses the low reflectance portion 16A and outputs a signal representative of the fall of reflectance. On receiving this signal, the controller 50 determines that the pay-out of the stencil 16a from the roll 16 must be stopped.

Assume that the roll holder 11A is inserted into the device 10 while pushing the peeler support member 12C with its presser portions 11G. Then, the stencil set sensing means, or first stencil set sensing means in the embodiment, 61 senses the movement of the peeler support member 12C. The free end of the support member 12C is provided with a reflection surface, not shown, for reflecting incident light. In the illustrative embodiment, the sensing means 61 is implemented by a reflection type photosensor capable of determining whether or not the above reflection surface is present. In addition, the sensing means 61 serves as operation sensing means for determining the time when the motor 13A of the stencil drive section 13 should start operating on the basis of the above movement of the peeler support member 12C, and feeding its output signal to the controller 50.

As shown in FIGS. 1 and 2, the leading edge sensing means 62 has first and second leading edge sensing means 62A and 62B. The first sensing means 62A is positioned on the stencil transport path upstream of the platen roller 14B while the second sensing means 62B is positioned downstream of the cutting device 17. The first and second sensing means 62A and 62B are both implemented by reflection type photosensors each having a light emitting element and a light-sensitive element. On detecting the leading edge of the stencil 16a, the sensing means 62A outputs a reference signal for driving the platen pressure control section 14. On detecting the leading edge of the stencil 16a, the sensing means 62B outputs a reference signal for causing the stencil 16a to be continuously paid out for a preselected period of time. The amount in which the stencil 16a is paid out in response to the output signal of the sensing means 62B is such that the leading edge of the perforated stencil or master 16a faces the damper 2D.

A cut start switch, numeral keys for entering a desired number of printings and so forth are arranged on the operation panel 63, although not shown in the figures. The cut start switch is pressed when a new perforated stencil or master 16a should be wrapped around the print drum 2. When this switch is pressed, the stencil 16a is automatically paid out from the roll 16 toward the platen pressure control section 14 and perforated. After the master 16a has been wrapped around the drum 2, a single sheet S is fed to the drum 2 while the ink is transferred to the sheet S via the perforations of the master 16a. As a result, a single trial printing i s produced. To start a sequence of printing operations, a print start switch, not shown, also provided on the operation panel 63 is pressed.

When the output signals of the stencil sensing means 60 and stencil set sensing means 61 are absent, the controller 50 does not energize the motor 13A of the stencil drive section 13. At the same time, the control section 50 causes the cam motor 14A30 of the platen pressure control section 14 to rotate the eccentric cam 14A3 until its smaller diameter portion contacts the head support arm 14A2, and deenergizes the platen motor associated with the platen roller 14B. In this condition, the thermal head 14A and platen roller 14B are spaced from each other and unable to convey or perforate the stencil 16a.

On receiving the output signals of the sensing means 60 and 61, the controller 50 energizes the motor 13A of the stencil drive section 13 and thereby allows the stencil 16a to be paid out from the roll 16. At this instant, the motor 13A is once rotated in the direction opposite to the direction for paying out the leading edge of the stencil 16a, and then rotated in the direction for paying it out, as mentioned earlier. With this scheme, it is possible to surely position the leading edge of the stencil 16a relative to the peeler 12A, and therefore to surely peel off the leading edge of the stencil 16a from the roll 16. For example, assume that the leading edge of the stencil 16a is positioned in the vicinity of, but downstream of, the peeler 12A. Then, the above reverse rotation of the motor 13A returns the leading edge of the stencil 16a to the position where it faces the peeler 12A. As a result, when the roll 16 is rotated in the stencil pay-out direction T, it is possible to reduce the interval up to the time when the leading edge of the stencil 16a is peeled off and separated from the roll 16.

When the first leading edge sensing means 62A senses the leading edge of the stencil 16a paid out from the roll 16, the controller 50 causes the stencil drive section 13 to continuously rotate the roll 16 for a preselected period of time and then stop the rotation. During the continuous rotation of the roll 16, the leading edge of the stencil 16a is moved to between the thermal head 14A and the platen roller 14B. At the same time, the controller 50 drives the cam motor 14A30 in order to move the head support arm 14A2 (FIG. 2) toward the platen roller 14B. As a result, the head 14A and platen roller 14B exert a pressure on the stencil 16a, i.e., nip it therebetween. Then, the platen roller 14B is rotated by the platen motor in order to convey the stencil 16a in cooperation with the head 14A.

On receiving the output signal of the second leading edge sensing means 62B, the controller 50 causes the platen motor and the motor 18A associated with the roller 18 to rotate a predetermined amount. This causes the leading edge of the stencil 16a to face the damper 2D.

Figure 16:
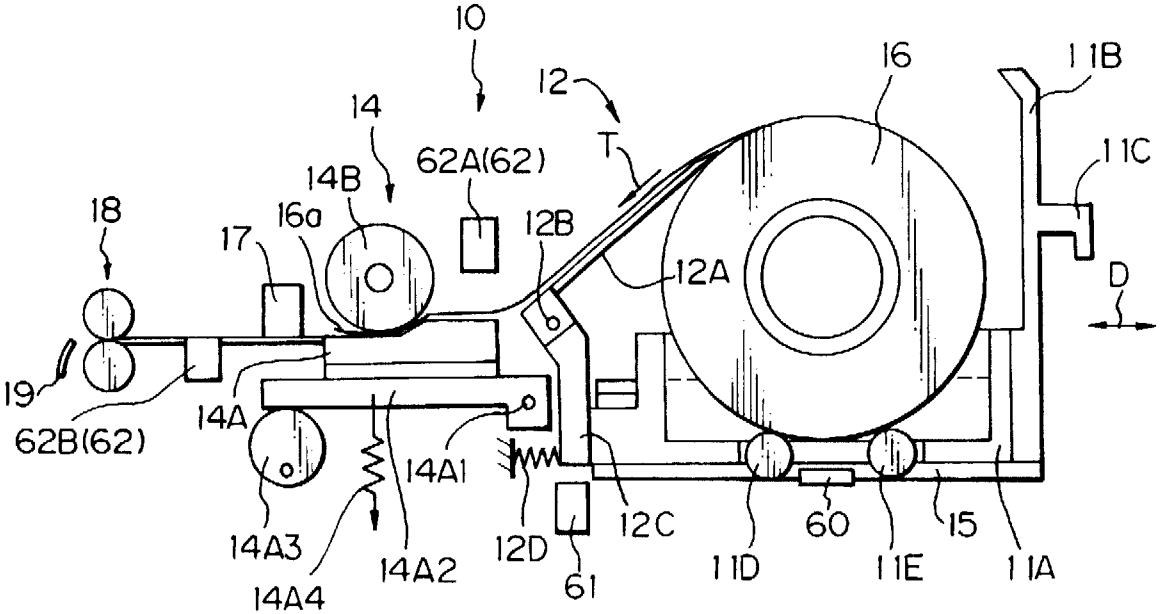
FIG. 16 schematically shows the master making device of FIG. 2 in a condition wherein the leading edge of the stencil is nipped by the thermal head and platen roller.
Figure 17:
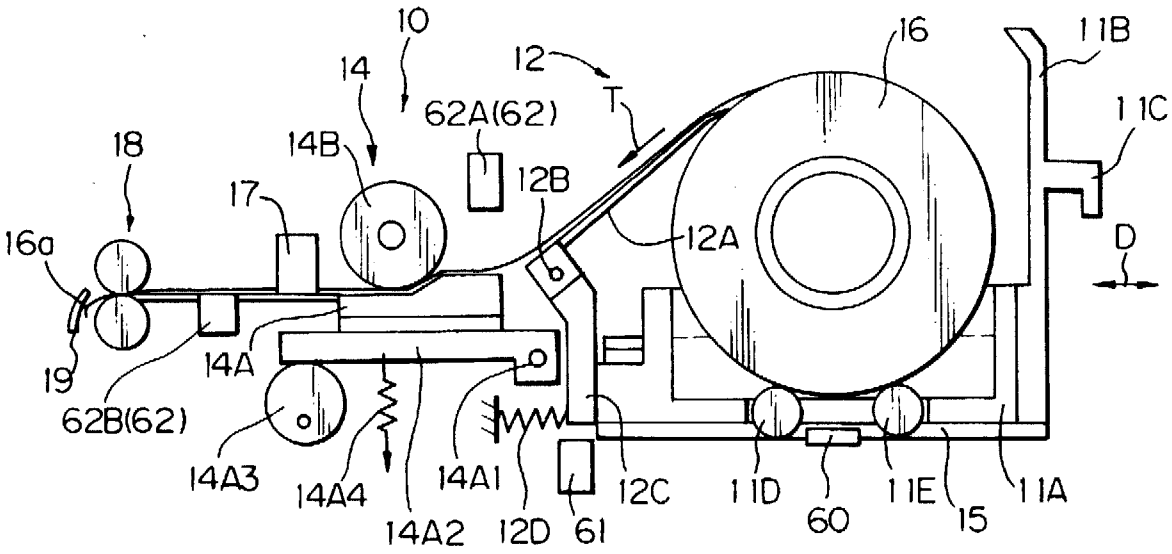
FIG. 17 schematically shows the device of FIG. 2 in a stand-by condition.
Figure 18:
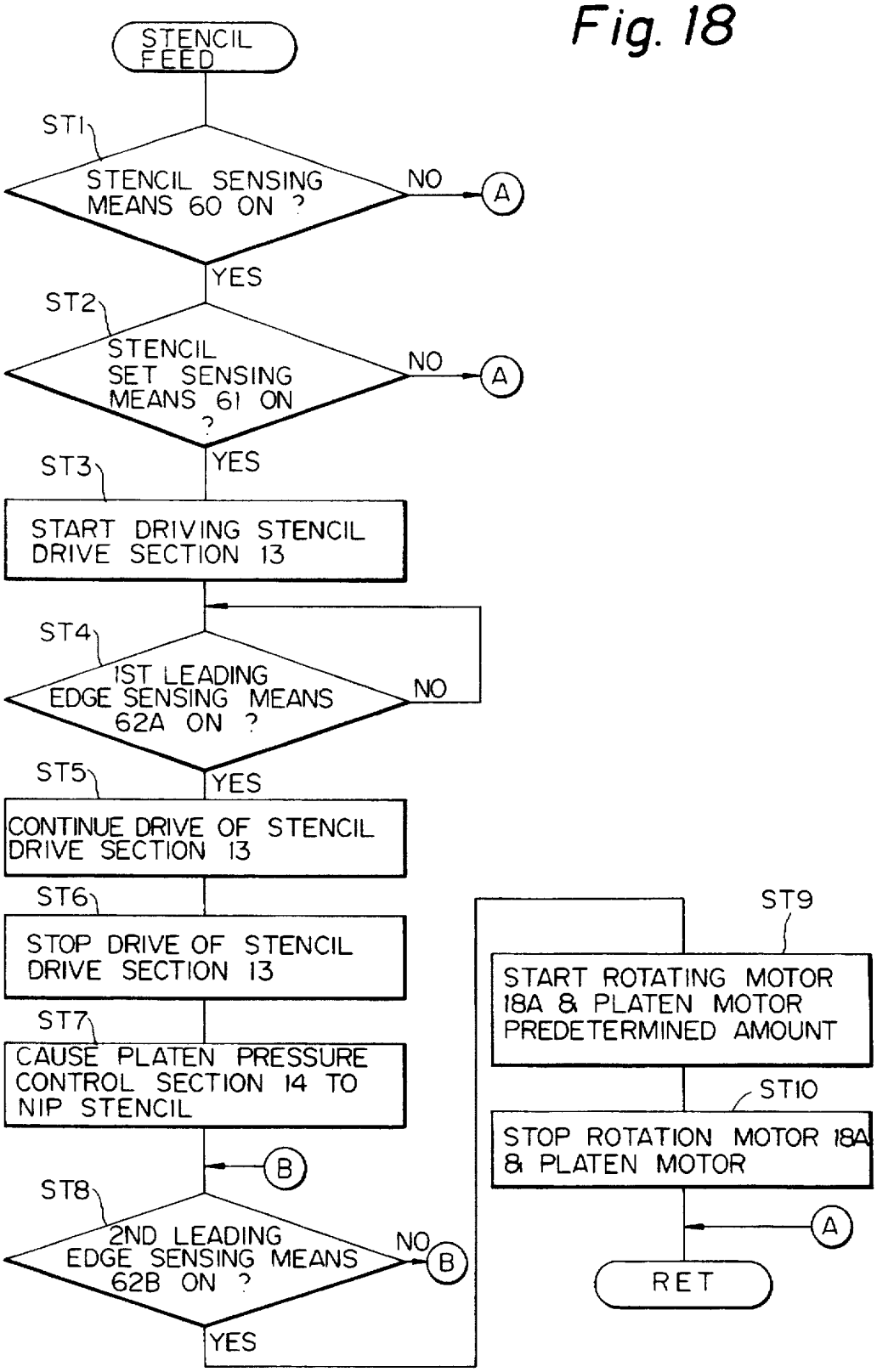
FIG. 18 is a flowchart demonstrating a specific operation of the controller shown in FIG. 11.

A reference will be made to FIGS. 12–17 demonstrating the pay-out of the stencil 16a from the roll 16 and FIGS. 18 and 19 demonstrating the operation of the controller 50. FIGS. 12–17 are slightly schematic, compared to FIG. 2 and other figures, to facilitate the understanding of the operation.

Figure 12:
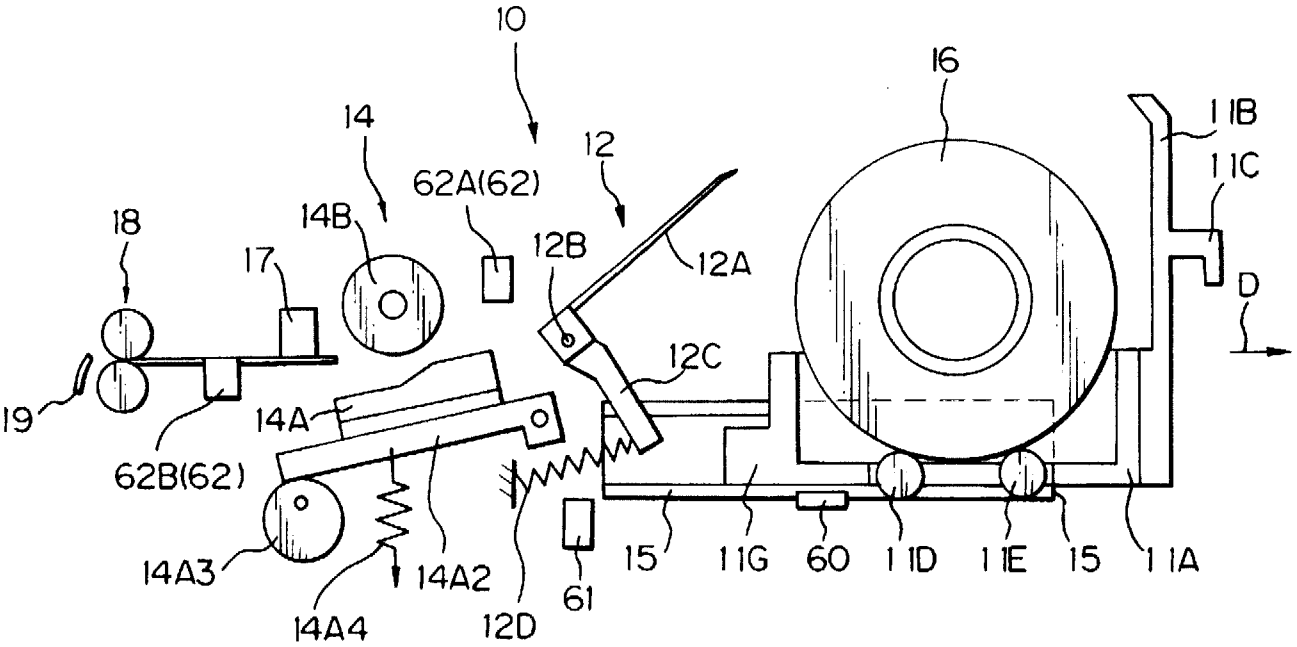
FIG. 12 schematically shows the master making device of FIG. 2 in its initial condition.

FIG. 12 shows a condition in which a new stencil roll 16 is to be loaded in the roll holder 11A. First, the operator pulls the roll holder 11A out of the device 10 by holding the handle 11 C. Whether or not the roll 16 existing in the roll holder 11A must be replaced is indicated by the output signal of the stencil sensing means 60 which is responsive to the low reflectance portion 16A of the stencil 16a, as stated earlier. On receiving the output signal of the sensing means 60 representative of the fall of reflection from the stencil 16a, the controller 50 sets up a condition for allowing the roll holder 11A to be pulled out.

In the platen pressure control section 14, the cam motor 14A30 rotates the eccentric cam 14A3 until its smaller diameter portion contacts the head support arm 14A2. As a result, the head 14A is released from the platen roller 14B and cancels the pressure acting on the stencil 16a. At the same time, the platen motor and therefore the platen roller 14B is caused to stop rotating. In addition, when the roll holder 11A is pulled out of the device 10, the presser portions 11G are released from the peeler support member 12C. As a result, the support member 12C is rotated counterclockwise, as viewed in FIG. 12, so that the free end of the peeler 12A is released from the roll 16. Under these conditions, the stencil 16a is smoothly entrained by the roll 16 to the outside of the device 10 without any resistance acting thereon.

Figure 13:
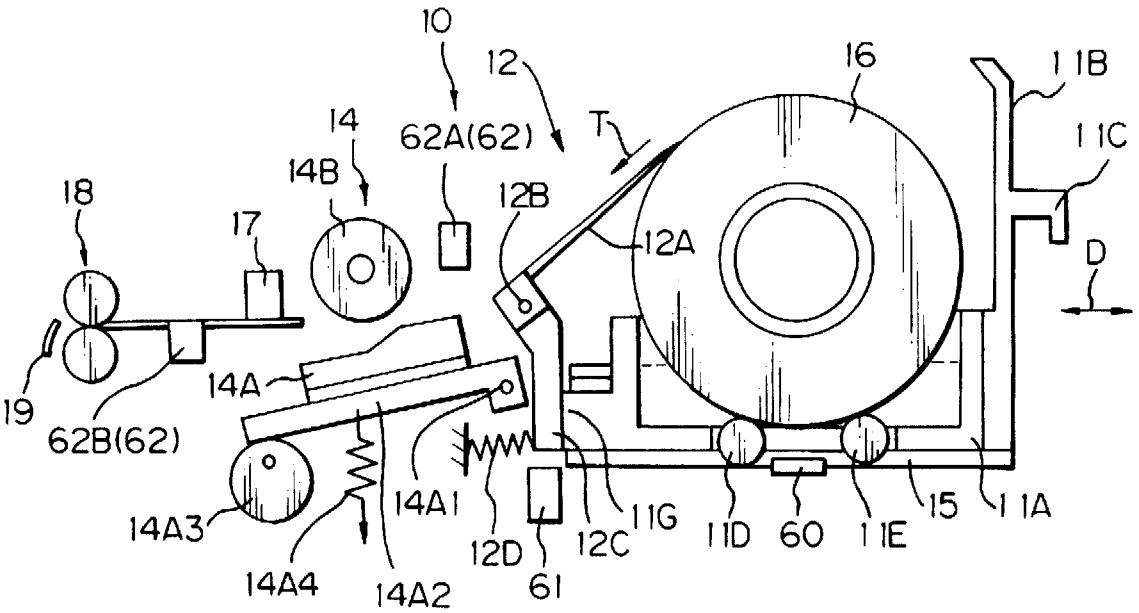
FIG. 13 schematically shows the master making device of FIG. 2 in a condition wherein the roll holding section is located at its operative position.

The operator pulls out the roll holder 11A loads it with a new roll 16 and again pushes the roll holder 11A into the device 10 as far as the operative position. As shown in FIG. 13, when the roll holder 11A reaches its operative position, the presser portions 11G cause the peeler support member 12C to rotate clockwise, as viewed in FIG. 13, until the peeler 12A contacts the preselected position of the roll 16. At the same time, the stencil sensing means 60 senses the new roll 16 while the stencil set sensing means 61 determines that the roll 16 has been set at the operative position.

Figure 14:
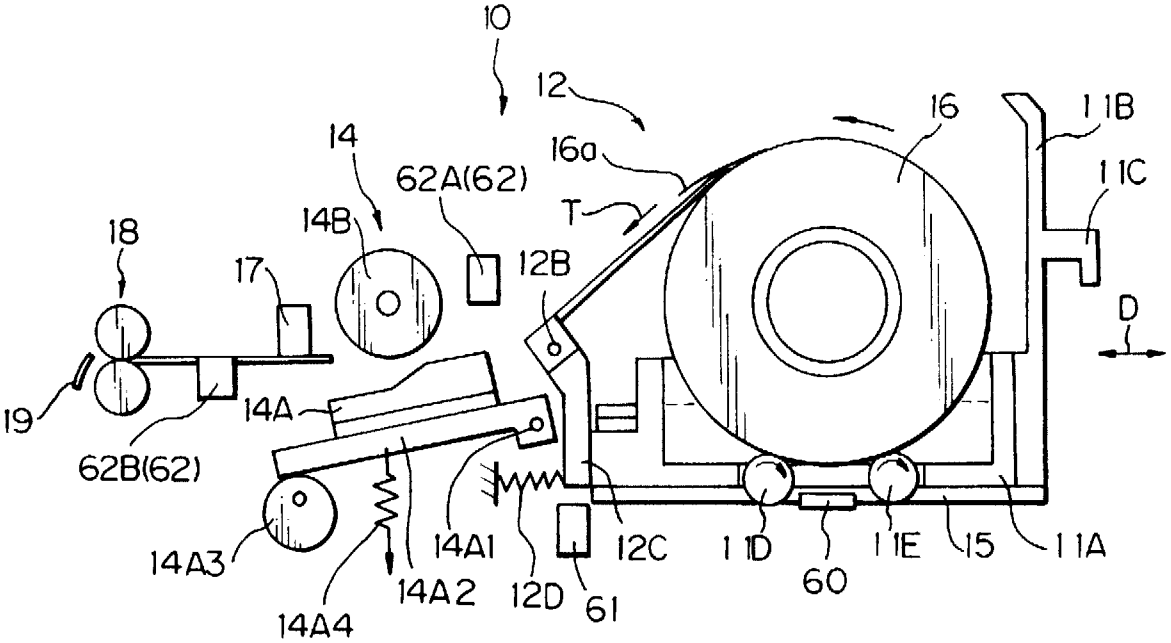
FIG. 14 schematically demonstrates the operation of the first embodiment to occur just after a stencil has been paid out from the roll.

When the operator presses the cut start switch, the controller 50 executes a procedure which will be described with reference to FIG. 18. First, the controller 50 determines whether or not it has received the output signals of the stencil sensing means 60 and stencil set sensing means 61 (steps ST1 and ST2). If the answers of the steps ST1 and ST2 are positive (Y), the controller 50 energizes the motor 13A for causing the stencil drive section 13 to operate (step ST3). Specifically, the motor 13A rotates the drive rollers 11D and 11E in the direction for paying out the leading edge of the stencil **16*a* from the roll 16. More specifically, the motor 13A rotates the drive rollers 11D and 11E in the direction (counterclockwise) opposite to the stencil pay-out direction T and then in the stencil-pay out direction T, as stated earlier and as shown in FIG. 14**.

Figure 15:
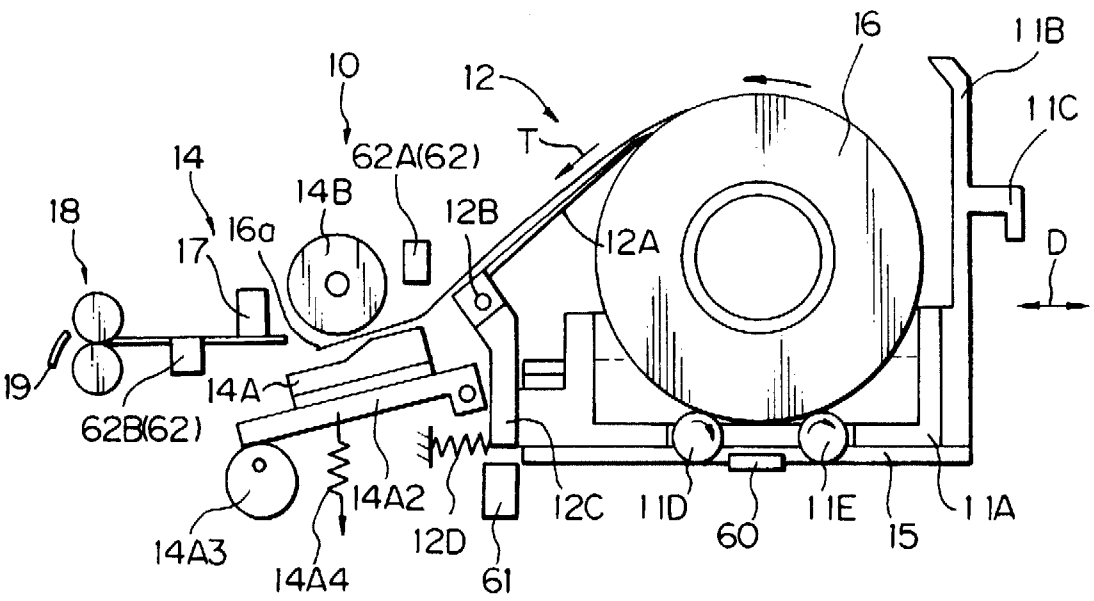
FIG. 15 schematically shows the master making device of FIG. 2 in a condition wherein the leading edge of the stencil has reached a position where a thermal head and a platen roller face each other.

As soon as the stencil drive section 13 starts operating, the controller 50 determines whether or not it has received the output signal of the first leading edge sensing means 62A (step ST4). If the answer of the step ST4 is Y, the controller 50 causes the stencil drive section 13 to continue its operation (step ST5). At this instant, the leading edge of the stencil **16*a* is allowed to reach the platen pressure control section 14. In the illustrative embodiment, when the rotation of the motor 13A is continued, the stencil 16*a* having its leading edge sensed by the sensing means 62A is conveyed by a distance of about 20 mm from the position where the leading edge is sensed by the sensing means 62A to the position it moves away from the nip between the platen roller 14B and the head 14A. The motor 13A is rotated in a preselected amount necessary for the leading edge of the stencil 16*a* to be conveyed toward the downstream side, as stated above. This is illustrated in FIG. 15**.

After the step ST5, the controller 50 causes the stencil drive section 13 to stop operating (step ST6). To determine the time for interrupting the rotation of the motor 13A, a rotary encoder or similar roll rotation sensing means, not shown, senses the preselected amount of rotation of the motor 13A and sends its output to the controller 50.

Subsequently, the controller 50 controls the platen pressure control section 14 (step ST7). Specifically, in the step ST7, the controller 50 causes the head 14A to contact the platen roller 14B in order to nip the stencil **16*a*. For this purpose, as shown in FIG. 16, the controller 50 drives the cam motor 14A30 such that the larger diameter portion of the cam 14A3 contacts the rear of the head support arm 14A2. As a result, the arm 14A2 rotates the head 14A toward the platen roller 14B. In this condition, the head 14A and platen roller 14B are capable of conveying the stencil 16*a* while nipping it therebetween. At this instant, the cam 14A3 is continuously rotated for a short period of time so as to repeatedly move the head 14A into and out of contact with the platen roller 14B with the intermediary of the stencil 16*a*. At the same time, the platen roller 14B is rotated clockwise, as viewed in FIG. 16, in order to convey the stencil 16*a* toward the downstream side. Consequently, the stencil 16*a* is pulled by the platen roller 14B** intermittently and freed from creases or similar deformation thereby.

During the operation following the step ST6, the stencil **16*a* is paid out from the roll 16 by the platen roller 14B, and the roll 16 is rotated while slipping on the rollers 11D and 11E**.

In the step ST7, every time the platen roller 14B is brought into contact with the head 14A, it pays out the stencil **16*a* from the roll 16. As soon as the leading edge of the stencil 16*a* is sensed by the second leading edge sensing means 62B (ST8), the sensing means 62B sends its output to the controller 50. In response, the controller 50 causes the platen motor and motor 18A to rotate a predetermined amount in order to bring the leading edge of the stencil 16*a* to the position where it faces the damper 2D (step ST9). This condition or stand-by condition is shown in FIG. 17. In this case, the stencil 16*a* moves 25 mm corresponding to the distance between the position of the platen pressure control section 14 and the position where the drum faces the damper 2D. Again, a rotary encoder or similar signal generating means senses the rotation of the platen motor, so that the time for stopping rotating the platen motor and motor 18A** can be determined.

After the step ST9, the controller 50 causes the platen motor and motor 18A to stop rotating on rotating a preselected amount (ST10).

Figure 19:
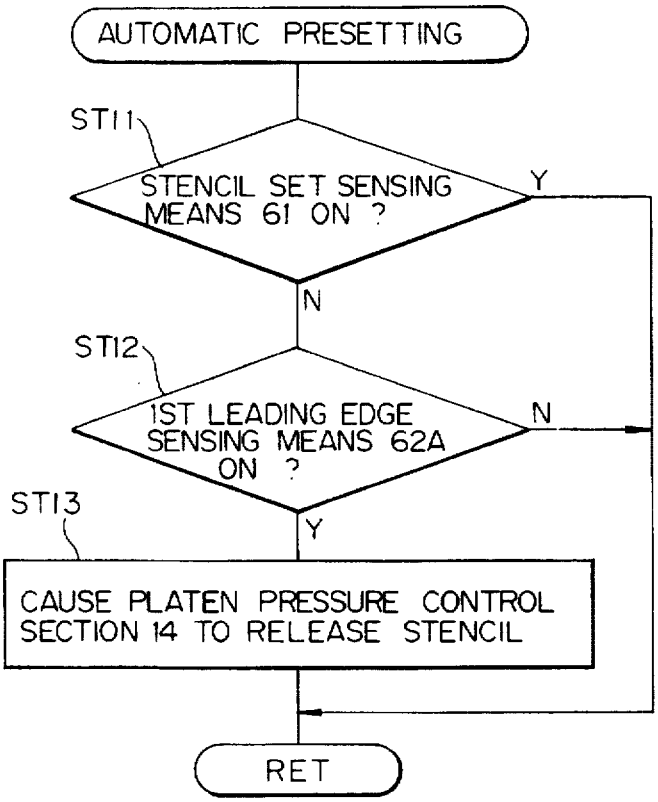
FIG. 19 is a flowchart demonstrating another specific operation of the controller.

FIG. 19 shows a procedure for cancelling the pressure acting on the stencil **16*a* in the platen pressure control section 14 (labeled AUTOMATIC RESETTING). When the roll holder 11A is moved outward away from its operative position, the procedure to be described cancels the pressure and allows the roll holder 11A to be smoothly pulled out. As shown, the controller 50 determines whether or not it has received the output signals of the stencil set sensing means 61 and first leading edge sensing means 62A (steps ST11 and ST 12). If the answer of the step ST11 is negative (N) and if the answer of the step S12 is Y, the controller 50 causes the platen pressure control section 14 to cancel the pressure acting on the stencil 16*a*** *(step ST13)*.

In the step ST 13, the cam motor 14A30 rotates the eccentric cam 14A3 until its smaller diameter portion contacts the rear of the head support arm 14A2. As a result, the head 14A is released from the platen roller 14B, so that the pressure acting on the stencil **16*a* is cancelled. Even if the stencil 16*a* is nipped when the roll holder 11A starts moving toward the outside of the device 10, tension acts on the stencil 16*a* and causes the roll 16 to rotate in the cavity 11A4 while loosening itself. Therefore, despite the pressure acting on the stencil 16*a*, the stencil 16*a* is prevented from being cut away from the roll 16**.

After the leading edge of the stencil **16*a* has been brought to the stand-by position facing the damper 2D, it is nipped by the clamp member 2F and stage 2E. Then, the head 14A selectively cuts or perforates the stencil 16*a* by heat while conveying it in cooperation with the platen roller 14B. The perforated part of the stencil, i.e., the master 16*a* is sequentially wrapped around the drum 2** being rotated clockwise either continuously or intermittently.

Subsequently, during the course of printing, every time the used master **16*a* is discharged from the drum 2, the stencil 16*a* is paid out from the roll 16, cut, and then wrapped around the drum 2** in order to effect another printing operation.

The embodiment described above has the following advantages. When a new roll 16 is loaded in the roll holding section 11, it is only necessary for the operator to push the roll holder 11A into the device 10 as far as the operative position. Then, the leading edge of the stencil **16*a* is automatically paid out from the roll 16 and cut. The peeler or peeling means 12A is implemented by a thin elastic member. Hence, when the peeler 12A is caused to contact the roll 16, it elastically deforms so as not to exert an unusual pressure on the roll 16. This protects the surface of the stencil 16***a* from scratches and prevents the stencil 16*a* from being torn off.

Further, the peeler 12A is sequentially inclined from the intermediate portion in the widthwise direction of the stencil 16*a* toward the opposite side edges of the stencil 16*a* downstream in the stencil pay-out direction T, adjoins or contacts the leading edge of the stencil 16*a*. The peeler 12A therefore sequentially peels off the stencil 16*a* from its center toward its opposite side edges. This prevents the peeler 12A from catching the leading edge of the stencil 16 a and thereby prevents the stencil 16*a* sequentially paid out from the roll 16 from jamming the transport path.

Moreover, the inclined portion 12A2 of the peeler 12A reduces the area over which the peeler 12A contacts the stencil 16*a* as far as possible. As a result, the peeler 12A is prevented from contacting the stencil 16*a* over an excessive area. This facilitates the guide for the stencil 16*a* being paid out from the roll 16 and thereby more surely separates the stencil 16*a* from the roll 16.

In addition, the peeler 12A is capable of contacting the roll 16 due to its own weight without resorting to special biasing means or the like.

Figure 20:
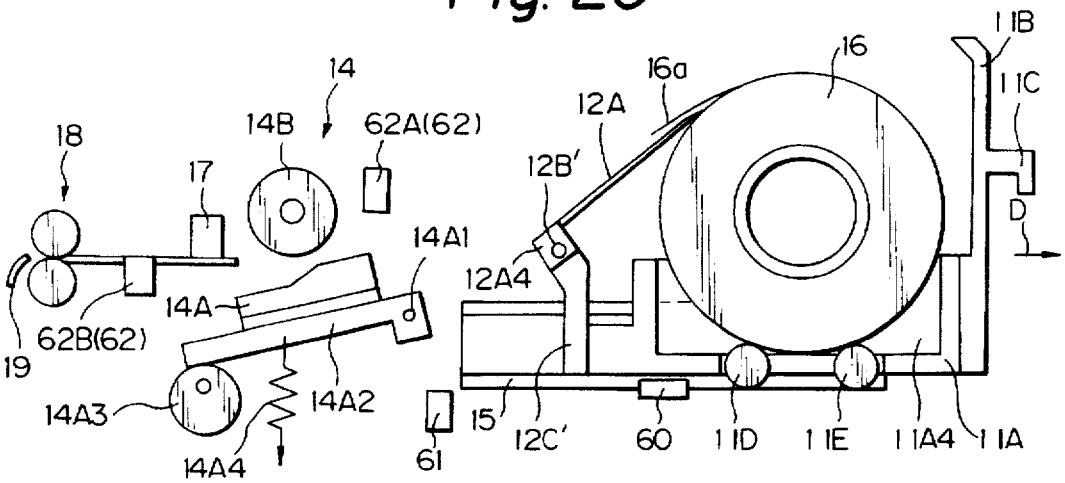
FIG. 20 is a view showing a first modification of the first embodiment.

Referring to FIG. 20, a first modification of the first embodiment will be described. In the first embodiment, after the roll 16 has been loaded in the cavity 11A4 of the roll holder 11A, the stencil drive section 13 is driven to automatically pay out the leading edge of the stencil 16*a* from the roll 16. If the automatic pay-out of the leading edge of the stencil 16*a* is not desired, the leading edge of the stencil 16*a* may be peeled off from the roll 16 and paid out by hand, as will be described with reference to FIG. 20.

In the first modification, the operator pulls the used roll holder 11A out of the device 10, loads it with a new roll 16, peels off the leading edge of the stencil 16*a* from the roll 16 by hand, pays it out toward the top of the peeler 12A, and then pushes the roll holder 11A into the device 10. This is followed by a procedure substantially identical with the procedure shown in FIG. 18 in response to the output signal of the stencil sensing means 60.

Specifically, as shown in FIG. 20, the peeler support member 12C is replaced with a peeler support member 12C'. The peeler support member 12C' is affixed to the portions of the roll holder 11A corresponding to the presser members 11G. The modification does not need the compression spring 12D. The support member 12C' is slidable along the guide members 15 together with the roll holder 11A. A shaft 12B' is affixed to the support member 12C' while the bearing portions 12A4 of the peeler 12A are rotatably mounted on the shaft 12B'. After the operator has pulled the roll holder 11A out of the device 10 in a direction D, the operator can peel off the leading edge of the stencil 16*a* from the roll 16 and pay it out toward the top of the peeler 12A.

Figure 21:
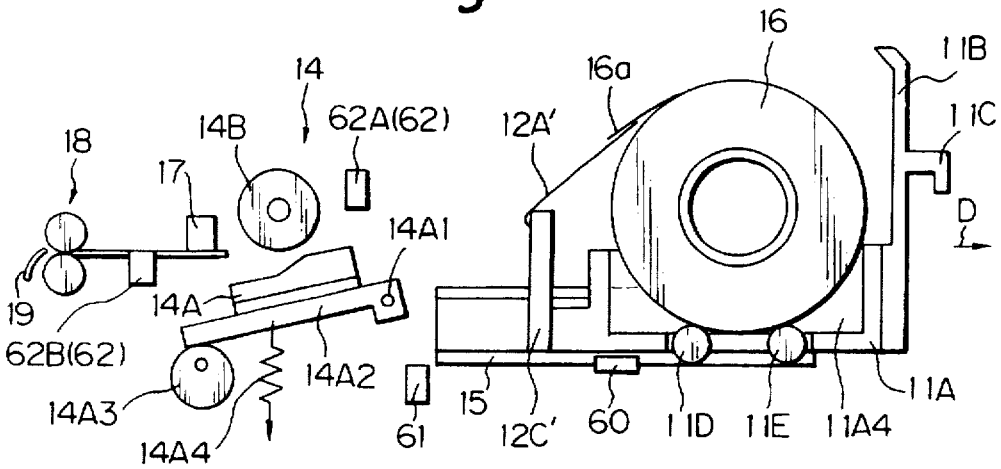
FIG. 21 shows a second modification of the first embodiment.

FIG. 21 shows a second modification of the first embodiment also based on the manual pay-out scheme. As shown, a peeler 12A' is affixed to the peeler support member 12C' which is affixed to one end of the roll holder 11A. The free end of the peeler 12A' is fixed in place in the vicinity of the circumference of the roll 16.

In any of the modifications shown in FIGS. 20 and 21, after the leading edge of the stencil 16*a* has been paid out a predetermined length from the roll 16 and then laid on the top of the peeler 12A or 12A', the roll holder 11A is pushed into the device 10. Then, a procedure similar to the procedure of FIG. 18 beginning with the step ST1 is executed. In this case, because the leading edge of the stencil 16*a* is laid on the top of the peeler 12A or 12A', the step ST3 for the reverse rotation of the drive rollers 11D and 11E is not effected.

If desired, the stencil sensing means 60 and stencil set sensing means 61 may be replaced with a sensor mounted on the device 10 and responsive to the movement of the closure member 11B to its closing position. Then, the sensor will be used as the operation sensing means for determining the time when the stencil 16*a* should begin to be paid out.

In the first embodiment, the stencil set sensing means 61 plays the role of the operation sensing means for causing the stencil drive section 13 to start paying out the stencil 16*a*. Alternatively, the stencil sensing means 60 may play the above role. This is because the stencil sensing means 60 determines whether or not the roll 16 is present, and in addition determines whether or not the roll 16 loaded in the cavity 14A4 is set at a preselected position in the device 10.

The above sensing means serving as the operation sensing means is omissible if the operation set key 63*a*, FIG. 11, is provided on the operation panel 63 to allow the operator to set the time when the stencil drive means 13 starts operating. In this case, the operator will press the key 63*a* after pushing the roll holder 11A into the device 10. Then, the controller 50 will cause the drive section 13 to start operating in response to a signal output from the key 63*a*.

In the first embodiment, the platen pressure control section 14 performs the operation for removing the creases of the stencil 16*a*. Specifically, when the first leading edge sensing means 62A senses the leading edge of the stencil 16*a*, the thermal head 14A and platen roller 14B are brought into and out of contact intermittently. However, this smoothing operation is not essential if, e.g., the leading edge of the stencil 16*a* is conveyed in parallel to the axial direction of the platen roller 14B, i.e., if the stencil 16*a* is free from creases. On the other hand, an arrangement may be made such that the head 14A and platen roller 14B remain in contact until the second leading edge sensing means 62B senses the leading edge of the stencil 16*a*, and the cam motor 14A30 is driven in response to the output signal of the sensing means 62B having sensed the leading edge, thereby causing the head 14A and platen roller 14B to contact intermittently for smoothing the stencil 16*a*. To smooth the stencil 16*a*, the contact of the head 14A and platen roller 14B should only be cancelled at least once.

Figure 22:
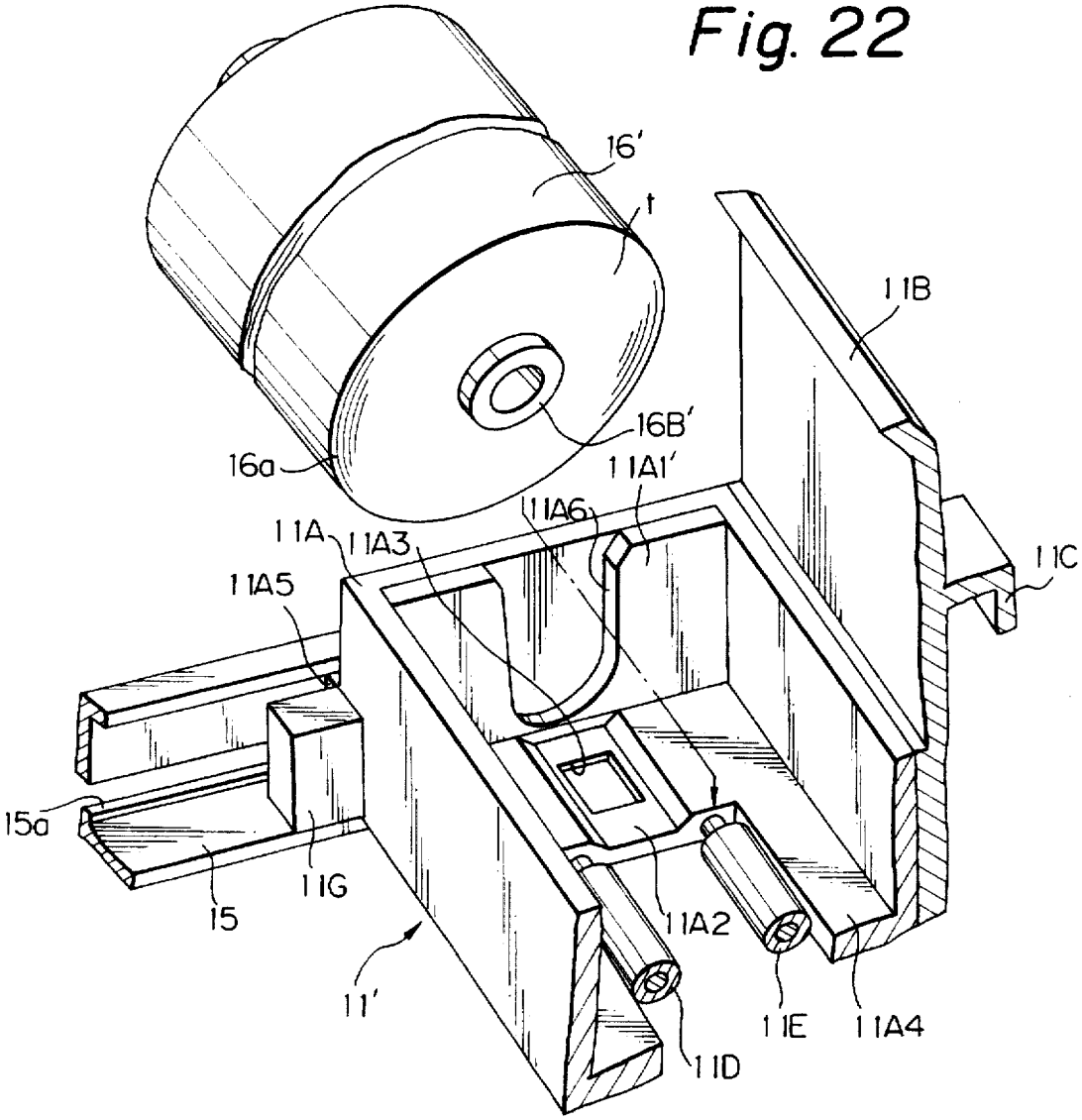
FIG. 22 is a fragmentary perspective view of a roll holding section included in the third modification of the first embodiment.

FIG. 22 shows a third modification of the first embodiment. The modification differs from the embodiment in that the stencil roll 16 is replaced with a conventional stencil roll 16', and in that the friction members 11A1 constituting the stencil storing means are replaced with friction members 11A' included in a roll holding section 11'. The friction members 11A1' are identical with the friction members 11A1 except for the shape. As shown, the roll 16' has a core 16B' on which the stencil 16*a* is wound. The core 16B' protrudes from the opposite ends t of the roll 16'.

The friction members 11A1' are also provided on the right and left inner surfaces of the roll holder 11A and constitute the stencil storing means in combination. The friction members 11A1' are each formed with a generally U-shaped notch 11A6 at its center in the front-and-rear direction. The protruding ends of the core 16B' are respectively received in the notches 11A6 of the friction members 11A1'. When the roll 16' is loaded in the roll holding section 11', the friction members 11A1' respectively contact the ends t of the roll 16' while the drive rollers 11D and 11E rotatably support the circumference of the roll 16'.

The notches 11A6 are each open at the top of the respective friction member 11A1' and sequentially reduced in width toward the bottom. The bottom of each notch 11A6 has a width substantially identical with the outside diameter of the core 16B'. The bottoms of the notches 11A6 are positioned such that the drive rollers 11D and 11E contact the circumference of the roll 16 at even positions with respect to the axis of the roll 16'.

In the above configuration, the roll 16' is guided by the notches 11A6 and evenly supported by the drive rollers 11D and 11E. When the roll 16' is loaded in the roll holding section 11', its circumference contacts the drive rollers 11D and 11E due to its own weight while its opposite ends t contact the friction members 11A1'. In this condition, when the drives rollers 11D and 11E are rotated to pay out the stencil 16*a*, friction occurs between the ends t of the roll 16' and the friction members 11A1', as in the first embodiment. As a result, tension is generated in the stencil 16*a* paid out from the roll 16'.

In the third modification, only if the operator puts the protruding ends of the core 16B' of the roll 16' in the notches 11A6, the circumference of the roll 16' is automatically positioned on the drive rollers 11D and 11E. This frees the operator from a special setting operation.

The friction members 11A1' are omissible if the inner walls of the roller holder 11A are formed with the notches 11A6 and if they are capable of contacting the ends t of the roll 16'. This will also successfully apply tension to the stencil 16*a* paid out from the roll 16'.

When the friction members 11A1' are omitted, it may be necessary to extend the core 16B' in the axial direction or to increase the thickness of the walls of the roll holder 11A1. This kind of structural limitation should preferably be eliminated. For example, assume that a clearance exists between each end t of the roll 16' and the adjoining inner surface of the roll holder 11A1. Then, a leaf spring, compression spring, sponge rubber or similar thin resilient or elastic member capable of contacting the end t of the roll 16' without regard to the outside diameter of the roll 16' may be positioned in the vicinity of the inner surface of the roll holder 11A1. The resilient or elastic member also exerts friction on the roll 16'.

In the third modification, the roll 16' may, of course, have a core protruding at one end t like the core 16B' and configured at the other end as in the first embodiment. In such a case, one of the friction members will be implemented as the friction member 11A1' while the other friction member will be implemented as the friction member 11A1.

Figure 23:
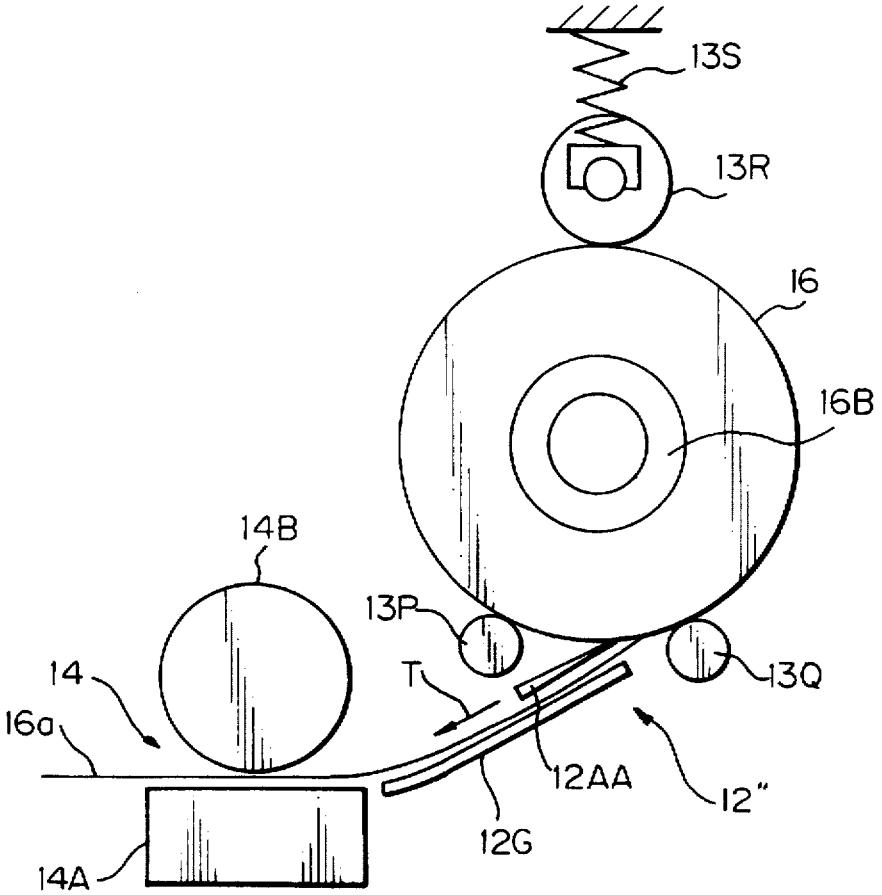
FIG. 23 shows a second embodiment of the present invention.

Referring to FIG. 23, a second embodiment of the present invention is shown. As shown, the second embodiment differs from the first embodiment mainly in that the drive rollers 11D and 11E are replaced with driven rollers 13P and 13Q contacting and driven by the circumference of the roll 16, in that a drive roller or frictional drive means 13R frictionally contacts the circumference of the roll 16 above the axis of the roll 16, and in that the peeling means 12 is replaced with peeling means 12". The drive roller 13R rotates the roll 16 in the direction for paying out the leading edge of the stencil 16*a* toward the master making means.

Further, the second embodiment differs from the first embodiment in that it pays out the leading edge of the roll 16 from below the roll 16. The driven rollers 13P and 13Q and friction members 11A1 (not shown in FIG. 23) constitute the master storing means in this embodiment.

The driven rollers 13P and 13Q contact the circumference of the roll 16 below the axis of the roll 16 at the same positions as the drive rollers 11D and 11E shown in FIG. 3. A compression spring 13S is anchored at one end to the upper portion of the closure member 11B (not shown in FIG. 23) and at the other end to the drive roller 13R. The drive roller 13R is therefore constantly biased in the direction in which it contacts the circumference of the roll 16. The drive roller 13R is formed of rubber, sponge or similar elastic material having a coefficient of friction lying in an adequate range. When the roll holding section 11 (not shown in FIG. 23) is set at its operative position, the drive roller 13R is caused to rotate the roll 16 by a motor, not shown, via a transmission mechanism including gears. The driven rollers 13P and 13Q are also formed of rubber, sponge or similar elastic material having a coefficient of friction and are driven by the roll 16 due to friction derived from the weight of the roll 16.

The peeling means 12" has a peeler 12AA in place of the peeler 12A. The peeler 12AA contacts the circumference of the roll 16 below the axis of the roll 16. Further, the peeler 12AA differs from the peeler 12A in that it faces the roll 16 in the tangential direction of the roll 16 and is constantly biased by a spring, not shown. The spring exerts an adequate pressure on the peeler 12AA such that the peeler 12AA contacts or adjoins the circumference of the roll 16 in accordance with the varying diameter of the roll 16. A guide member 12G is positioned below the peeler 12AA and faces it with the intermediary of the stencil 16*a* paid out from the roll 16. The guide member 12G guides the stencil 16*a* *toward the platen pressure control section 14.*

In operation, when the drive roller 13R is driven by the motor, it rotates the roll 16 in the stencil pay-out direction T with the result that the leading edge of the stencil 16*a* is moved toward the peeler 12AA. Because this embodiment causes the drive roller 13R to directly drive the roll 16, it obviates transmission losses and thereby reduces the output torque required of the motor, compared to the first embodiment including the drive transmission mechanism.

Figure 24:
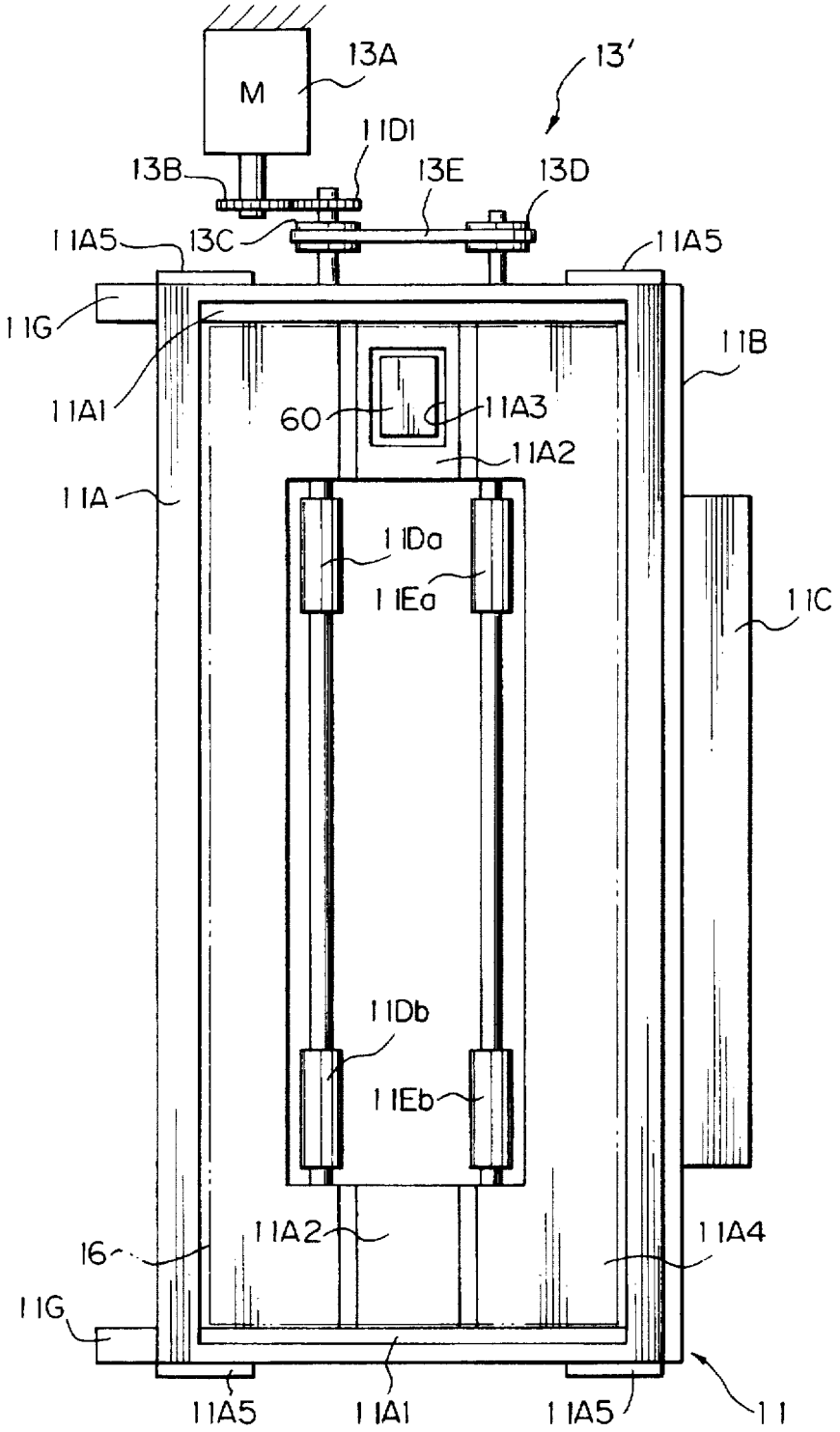
FIG. 24 is a plan view of a rotary drive section included in a fourth modification of the first embodiment.

FIG. 24 shows a fourth modification of the first embodiment. This modification is identical with the first embodiment except that the stencil drive section 13 with the drive rollers 11D and 11E is replaced with a stencil drive section 13' having drive rollers 11Da, 11Db, 11Ea and 11Eb contacting the circumference of the roll 16. The drive rollers 11Da and 11Db and drive rollers 11Ea and 11Eb are respectively the substitutes for the drive roller 11D and drive roller 11E playing the role of stencil storing means.

The drive rollers or roller elements 11Da and 11Db are separate from each other in the axial direction of the roll 16 and mounted on a single shaft in a spitting fashion. This is also true with the drive rollers or roller elements 11Ea and 11Eb. The shaft of the drive rollers 11Da and 11Db and that of the drive rollers 11Ea and 11Eb are each journalled to the bottom wall portion of the roll holder 11A. The motor 13A constituting a stencil drive section 13' rotates the drive rollers 11Da, 11Db, 11Ea and 11Eb in the direction for paying out the leading edge of the stencil 16*a*.

The drive rollers 11Da, 11Db, 11Ea and 11Eb are each formed of rubber, sponge or similar elastic material having a coefficient of friction lying in an adequate rage which allows them to rotate the roll 16. In this condition, the leading edge of the stencil 16*a* paid out from the roll 16 does not contact the entire drive rollers in the axial direction of the drive rollers, but contacts them only locally. Particularly, in this modification, the drive rollers 11Da–11Eb are not arranged in the axially intermediate portion, but arranged in the opposite end portions. In addition, the drive rollers 11Da–11Eb have their axial length reduced as far as possible.

The drive rollers 11Da and 11Db and drive rollers 11Ea and 11Eb are arranged at a preselected center angle with respect to the axis of rotation of the roll 16. Specifically, the drive rollers 11Da and 11Db and drive rollers 11Ea and 11Eb are positioned such that when the core 16B of the roll 16 falls to its lowermost position due to the full consumption of the stencil **16*a*, the circumference of the roll 16 contacts the two groups of drive rollers at even positions with respect to the axis of the roll 16. When only the core 16B of the roll 16 is left, the drive rollers 11Da–11Eb held in the above relationship support the core 16B** while allowing it to rotate.

The circumference of the roll 16 contacts the drive rollers 11Da–11Eb in the vicinity of the opposite ends t thereof in the axial direction. Therefore, the displacement of the roll 16 from the drive rollers 11Da–11Ea in the axial direction can be easily corrected. Further, assume that the leading edge of the stencil **16*a* is not peeled off from the roll 16 by the peeler 12A and is caused to rotate together with the roll 16. Then, if the roll 16 contacts the drive rollers over the entire axial dimension, then it is likely that the leading edge of the stencil 16*a* is turned over and bent. In the fourth modification, because the roller elements 11Da and 11Db and roller elements 11Ea and 11Eb are individually spaced from each other in the axial direction, the leading edge of the stencil 16*a* can enter the clearance between them. Hence, even if the leading edge of the stencil 16*a* is bent, it can again rise in the above clearance. This successfully straightens the leading edge of the stencil 16*a* and thereby obviates jams ascribable to the stencil 16*a*. In addition, the inertia of the drive rollers 11Da–11Eb** and therefore the resistance to the rotation is reduced.

In, e.g., the first and second embodiments and the first to fourth modifications, the roll holder 11A has an opening in its bottom. The drive rollers 11D and 11E and their shafts or the drive rollers 11Da–11Eb and their shafts are exposed in the above opening. Such a configuration does not increase the cost because the roller holder 11A can be simply implemented by punching or as a single molding of resin. However, it is likely that dust enters the roll holder 11A via the opening in the vicinity of the operative position of the holder 11A and contaminates the surface of the roll 16. In light of this, a cover may provided on the roll holder 11A to close the opening, while allowing only the drive rollers 11D and 11E or the drive rollers 11Da–11Eb to be exposed.

Figure 25:
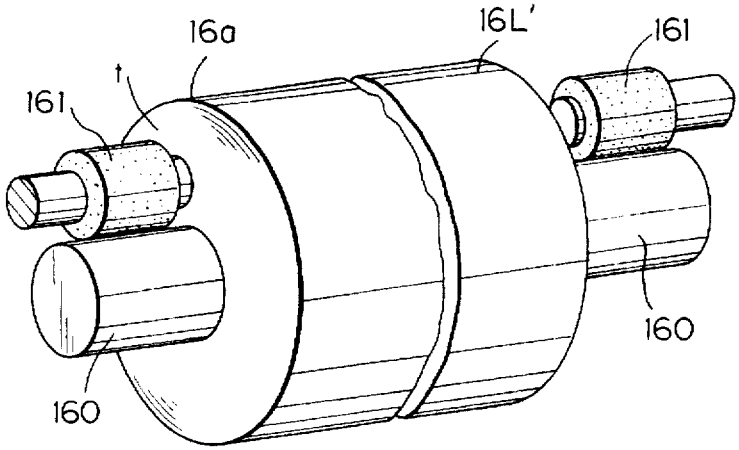
FIG. 25 is a fragmentary perspective view of drive rollers included in a fifth modification of the first embodiment.

FIG. 25 shows a fifth modification of the first embodiment and similar to the third modification except for the following. As shown, the stencil drive section 13 and drive rollers 11D and 11E are absent. The roll holder 11A has a different configuration. The roll 16' whose core 16B' protrudes from the opposite ends t of the roll 16' is replaced with a roll 16L' having a core 160 which protrudes from the opposite ends t of the roll 16L' more than the core 16B'. Drive rollers or frictional drive means 161 respectively contact the circumferences of the core 160 at the opposite ends of the core 160. A roll holder, not shown, is formed with generally U-shaped notches for rotatably supporting the opposite ends of the core 160 of the roll 16L'.

In FIG. 25, the core 160 is formed of synthetic resin having an ordinary mechanical strength and an adequate coefficient of friction. Friction members formed of, e.g., rubber and having a high coefficient of friction are wound round the circumference of the drive rollers 161. The drive rollers 161 respectively contact the opposite ends of the core 160 from the above via the friction members. A driven gear, not shown, similar to the driven gear 11D1 of the first embodiment is affixed to one end of the right drive roller 161. A drive gear similar to the drive gear 13B of the first embodiment is mounted on the drive motor 13A affixed to the right side wall of the body of the master making device, although not shown specifically. When the roll holder is brought to its operative position, the drive gear meshes with the driven gear. In FIG. 25, the drive transmission from the motor 13A to the left drive roller 161 is implemented by a connecting shaft, not shown, extending below the guide member 15 in the widthwise direction of the stencil **16*a***.

The fifth embodiment may be modified as follows. The configuration of the roll holder 11A included in the third modification is changed. The roll 16' is replaced with the roll 16L' of the fifth modification. The drive rollers 11D and 11E of the third modification are replaced with rollers contacting the circumference of the roll 16L' and driven thereby. The drive rollers or frictional drive means 161 contact the circumferences of the opposite ends of the core 160. In addition, a displacing mechanism is provided for allowing the drive rollers 161 to move downward in accordance with the varying diameter of the roll 16L'. A roll holding section, not shown, has a roll holder similar to the roll holder 11A except that it is formed with generally U-shaped grooves for supporting the core 160.

The drive rollers 161 are rotated by a motor, not shown, via the above displacing mechanism such that the stencil **16*a* is paid out from the roll 16L'**. The displacing mechanism will be described in relation to a third embodiment later.

In the fifth modification and its modified form, the drive rollers 161 frictionally contact the core 160 of the roll 16L' and transfer the rotation of the motor to the roll 16L'. Because the drive rollers 161 do not directly contact the surface of the stencil **16*a*, the surface of the stencil 16*a*** is free from damage.

In the fifth modification and its modified form, the rotation of the motor may be transferred only to one of the drive rollers 161, in which case the other roller 161 will be supported in a freely rotatable manner.

Figure 26:
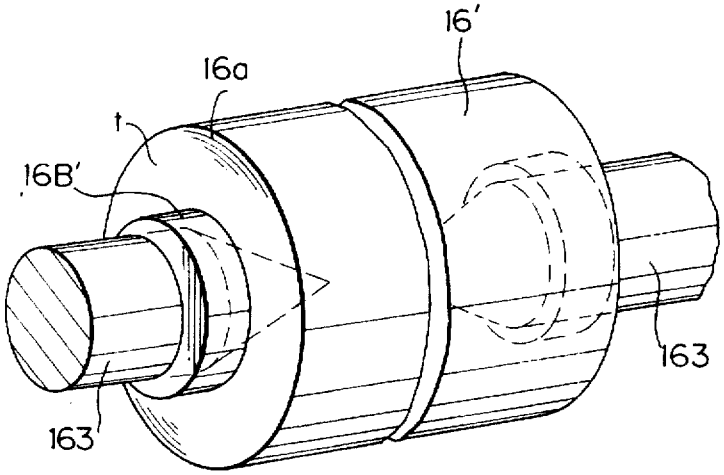
FIG. 26 is a fragmentary perspective view of drive shafts included in a sixth modification of the first embodiment.
Figure 27:
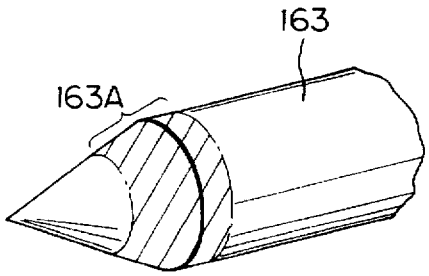
FIG. 27 is an enlarged perspective view of one of the drive shafts shown in FIG. 26.

FIGS. 26 and 27 show a sixth modification similar to the third modification except for the following. As shown, the stencil drive section 13 and drive rollers 11D and 11E are absent. The roll holder 11A has its configuration changed. Drive shafts or mating drive means 163 are each slidable in the widthwise direction of the stencil **16*a*. The drive shafts 163 are capable of mating with the inner periphery of the core 16B' at the opposite ends of the core 16B'. When the drive shafts 163 mate with the inner periphery of the core 16B', they rotate the roll 16 in the direction for paying out the leading edge of the stencil 16*a* toward the master making means. A roll holder, not shown, is similar to the roll holder 11A except that it is formed with generally U-shaped notches for rotatably supporting the core 160. The core 16B'** is rotatably received in the notches of the roll holder in the preselected position thereof.

As shown in FIG. 27, the drive shafts 163 each has a conical end in order to align the axis of the roll 16' with their axis when inserted into the core 16B'. A friction member 163A having a high coefficient of friction is formed on the periphery of the conical end over the axial area indicated by hatching in FIG. 27. Specifically, a piece of rubber or similar material having a high coefficient of friction is adhered to the above area of the drive shaft 163 in order to form the friction member 163A. The friction member 163A is so positioned as to contact the inner periphery of the core 16B'.

The drive shafts 163 may each be provided with a telescopic slidable structure capable so as to be held at a preselected extended position. A driven gear, not shown, similar to the driven gear 11D1 of the first embodiment is affixed to one end of one drive shaft 163. A drive gear, not shown, similar to the drive gear 13B is mounted on the output shaft of a motor, not shown, similar to the motor 13A mounted on the right side wall of the body of the master making device. When the roll holder is brought to its operative position, the drive gear meshes with the driven gear. The drive shafts 163 are driven by the motor, not shown, via a drive mechanism in the direction for paying out the stencil 16*a* from the roll 16'.

The sixth modification may be further modified as follows. The roll holder 11A of the third modification has its configuration changed. The drive rollers 11D and 11E of the third modification are replaced with drive rollers contacting and driven by the circumference of the roll 16'. The drive shafts 163 are slidable in the widthwise direction of the stencil 16*a* and serve as the mating drive means. The drive shafts 163 mate with the inner periphery of the core 16B' at the opposite ends of the core 16B' and rotate the roll 16' in the direction for paying out the leading edge of the stencil 16*a* toward the master making means. A displacing mechanism is provided for allowing the drive shafts 163 to move downward in accordance with the varying diameter of the roll 16'. A slide mechanism, not shown, is provided for allowing the drive shafts 163 to slide in the widthwise direction of the stencil 16*a*.

A roll holder for the above modification is similar to the roll holder 11A except that it is formed with generally U-shaped grooves for guiding the opposite ends of the core 16B' and receiving the drive shafts 163. In this configuration, the roll holder rotatably supports the core 16B' while the axially slidable drive shafts 163 are movable into the core 16B'. A motor, not shown, rotates the drive shafts 163 in the direction for paying out the stencil 16*a* from the roll 16.

In the sixth modification and its modified form, when the roll holder accommodating the roll 16' therein is moved to the operative position in the master making device 10, the drive shafts 163 are inserted into the core 16B' via the slide mechanism. As a result, the conical ends of the drive s hafts 163 pressingly contact the inner periphery of the core 166B'.

When the motor drives the drive shafts 163, the shafts 163 cause the roll 16' to rotate and thereby pay out the stencil 16*a* from the roll 16.

In the sixth modification and its modified form, the drive shafts 163 inserted into the core 16B' serve to align the axis of the roll 16' with their axis at the opposite ends of the roll 16'. This reduces the oscillation of the axis of the roll 16' and thereby allows the peeler 12A (see FIG. 2) to be accurately positioned relative to the circumference of the roll 16'. Moreover, the decrease in the oscillation of the roll 16' allows the peeler 12A to surely peel off the leading edge of the stencil 16*a* and separate it from the roll 16'. In addition, because the drive shafts 163 do not directly contact the surface of the stencil 16*a*, the stencil 16*a* is free from damage.

Again, the rotation of the motor may be transferred only to one of the drive shafts 163, in which case the other drive shaft 163 will be supported in a freely rotatable manner.

In the fifth and sixth modifications, the frictional drive means and mating drive means shown in FIGS. 25–27 are, of course, applicable not only to the master making device 10 of the present invention but also to to a conventional master making device including stencil drive members. In such a case, because the frictional drive means and mating drive means do not directly contact the surface of a stencil, the probability that the surface of the stencil is damaged is extremely low.

Figure 28:
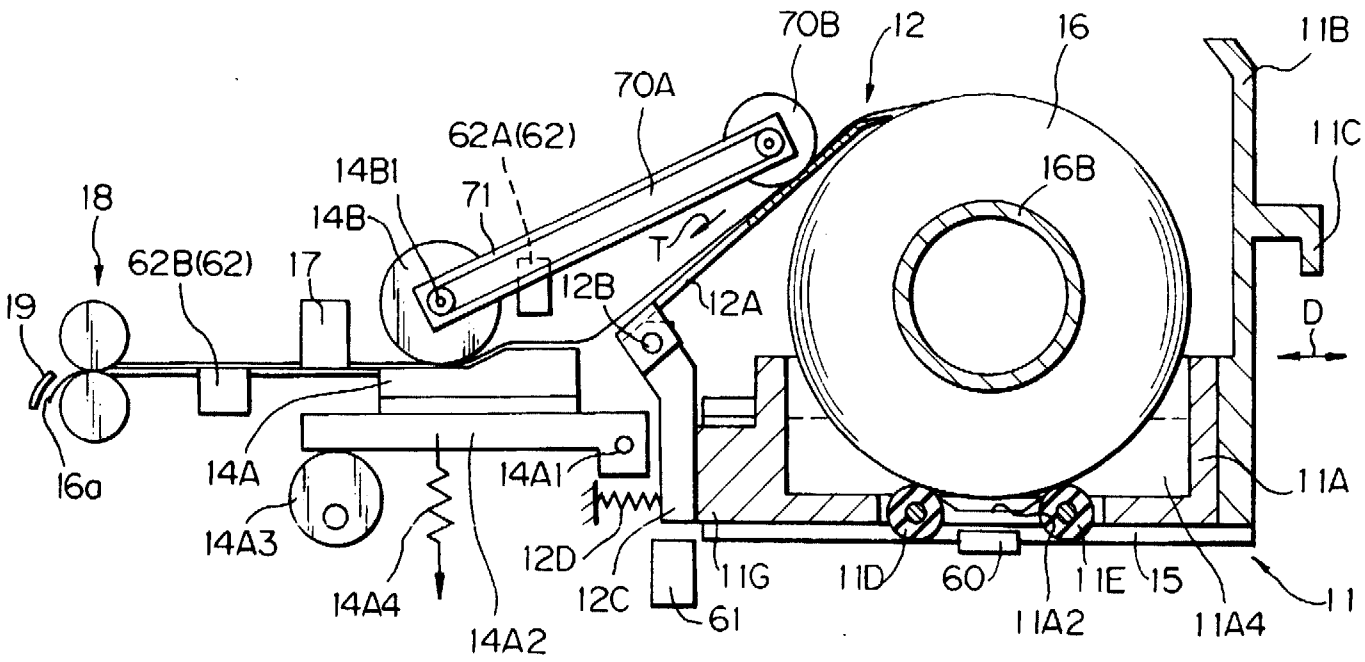
FIG. 28 shows a third embodiment of the present invention.
Figure 29:
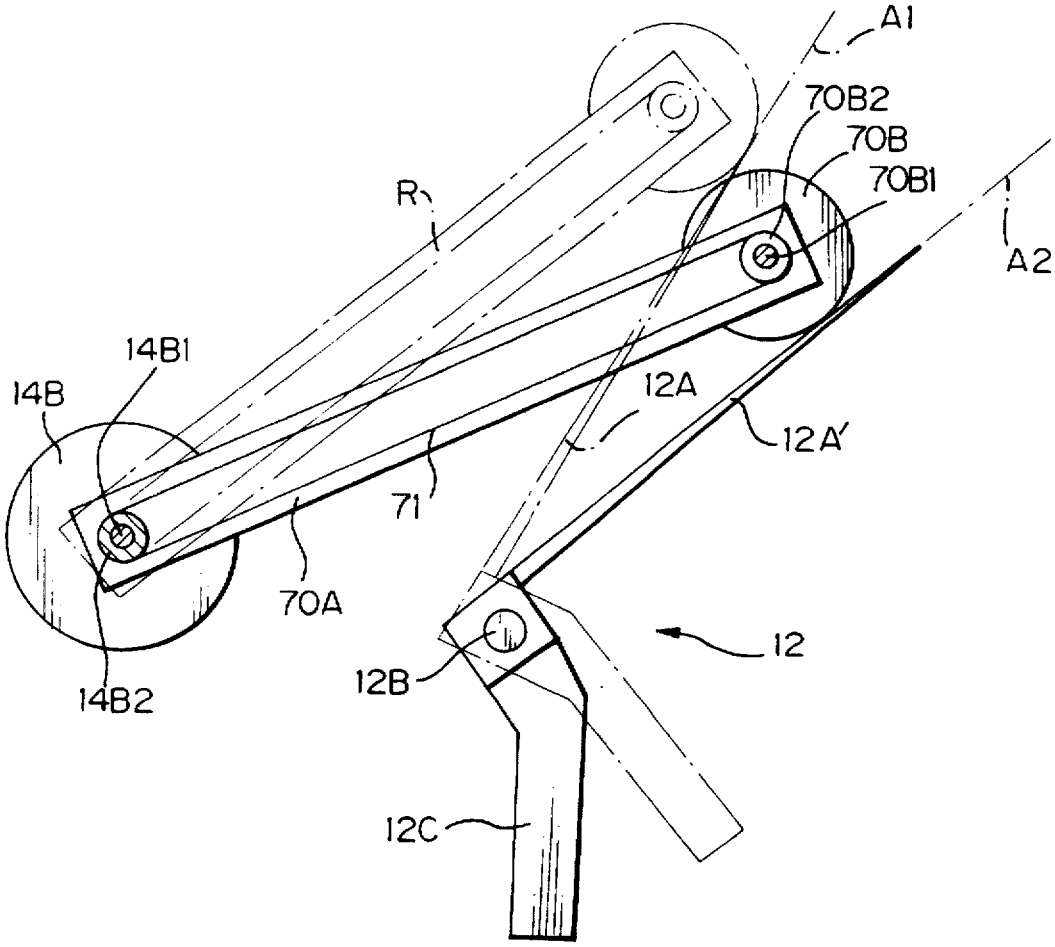
FIG. 29 shows the construction and operation of a feed roller included in the third embodiment together with associated members.

Referring to FIGS. 28 and 29, a third embodiment of the present invention will be described. This embodiment differs from the first embodiment mainly in that it includes a stencil feed roller or stencil feeding means 70B for feeding the leading edge of the stencil 16*a* peeled off from the roll 16. The stencil feed roller 70B is formed of rubber, sponge or similar material having a preselected coefficient of friction and is capable of conveying the stencil 16*a* in cooperation with the peeling means 12. The feed roller 70B is located in the vicinity of the free end of the peeler 12A. The feed roller 70B is rotatable via a support arm 70A, which will be described, between a position where it adjoins or contacts the circumference of the roll 16 via the peeler 12A (indicated by a solid line) and a position where it is spaced from the peeler 12A (indicated by a dash-and-dot line and labeled R in FIG. 29). Specifically, the feed roller 70B is movable in to and out of contact with the top of the peeler 12A shown in FIG. 5, i.e., the surface for laying the leading edge of the stencil 16*a* paid out from the roll 16.

The support arm 70A remains spaced from the peeler 12A up to the time when the roll holder 11A is inserted into the device 10 as far as its operative position. The support arm 70A contacts the peeler 12A at the same time as the peeler 12A contacts the roll 16. Why this kind of procedure is effective is as follows. Assume that the support arm 70A is rotated toward the roll 16 before the roll holder 11A is inserted toward its operative position in the device 10. Then, the roll 16 to be loaded in the cavity 11A4 is obstructed by the support arm 70A and peeler 12A with which the arm 70A is contacting. In addition, when the free end of the peeler 12A abuts against the roll 16, it is apt to damage the surface of the stencil 16*a*.

The support arm 70A is positioned between a rotary shaft 70B1 of the stencil feed roller 70B and a rotary shaft 14B1 of the platen roller 14B. The support arm 70A rotatably supports the feed roller 70B and is rotatable itself. A pair of such support arms 70A are respectively positioned at the right and left sides of the stencil transport path. The feed roller 70B is rotatably supported by and between the two support arms 70A together with its shaft 70B1.

A platen pulley 14B2 is mounted on the left shaft 14B1 of the platen roller 14B while a roller pulley 70B2 is mounted on the left shaft 70B1 of the feed roller 70B. A belt 71 is passed over the platen pulley 14B2 and roller pulley 70B2. A driven gear, not shown, is mounted on the left end of the platen pulley 14B2. A drive gear, not shown, is mounted on the left side wall of the device 10 and meshes with the driven gear when the roll holder 11A is brought to its operative position. The drive gear is connected to the platen motor via a transmission mechanism including a gear train and electromagnetic clutch.

In this embodiment, the platen motor is so driven as to rotate the platen roller 14B at a slightly higher peripheral speed than the roll 16 and feed roller 70B. That is, the peripheral speed of the platen roller 14B is slightly higher than that of the feed roller 70B which is slightly higher than that of the roll 16. As a result, the stencil 16*a* extending between the above members is held under predetermined tension.

A one-way clutch, not shown, intervenes between the free end of the support arm 70A and the shaft 70B1 of the feed roller 70B. The one-way clutch transmits the rotation of the roller drive means including the pulleys 14B2 and 70B2 and belt 71 to the feed roller 70B in the direction for paying out the stencil 16*a* from the roll 16. In this condition, the feed roller 70B is free to rotate in the direction for paying out the stencil 16*a*.

In operation, the roll 16 is so conditioned as to pay-out the leading edge of its stencil 16*a*. At the time when the peeler 12A is brought into contact with the circumference of the roll 16, the feed roller 70B is caused to contact the stencil laying guide surface of the peeler 12A. At the same time, the electromagnetic clutch is coupled to transfer the rotation of the platen motor to the feed roller 70B. As a result, the feed roller 70B is rotated clockwise, as viewed in FIGS. 28 and 29, for paying out the stencil 16*a*.

The stencil 16*a* paid out from the roll 16 is conveyed in the stencil pay-out direction T by the feed roller 70B with its leading edge guided by the guide surface of the peeler 12A. Hence, even if the stencil 16*a* is not sufficiently elastic, the embodiment is capable of surely paying out the leading edge of the stencil 16*a* separated by the peeler 12A from the roll 16, thereby obviating defective stencil feed.

If desired, the support arm 70A may be supported by the structure described in relation to the peeler 12A. In the alternative support structure, the support arm 70A is supported by the shaft 12B at its base end in such a manner a s to be rotatable over a predetermined angle. The base end of the support arm 70A is formed with a receiving surface. The inclined surface 12C1 and horizontal surface 12C2 of the peeler support member 12C are extended more outward than the receiving surface 12A5. In this condition, the support arm 70A allows the feed roller 70B to contact the stencil guide surface of the peeler 12A due to its own weight and the weight of the arm 70A.

Figure 30:
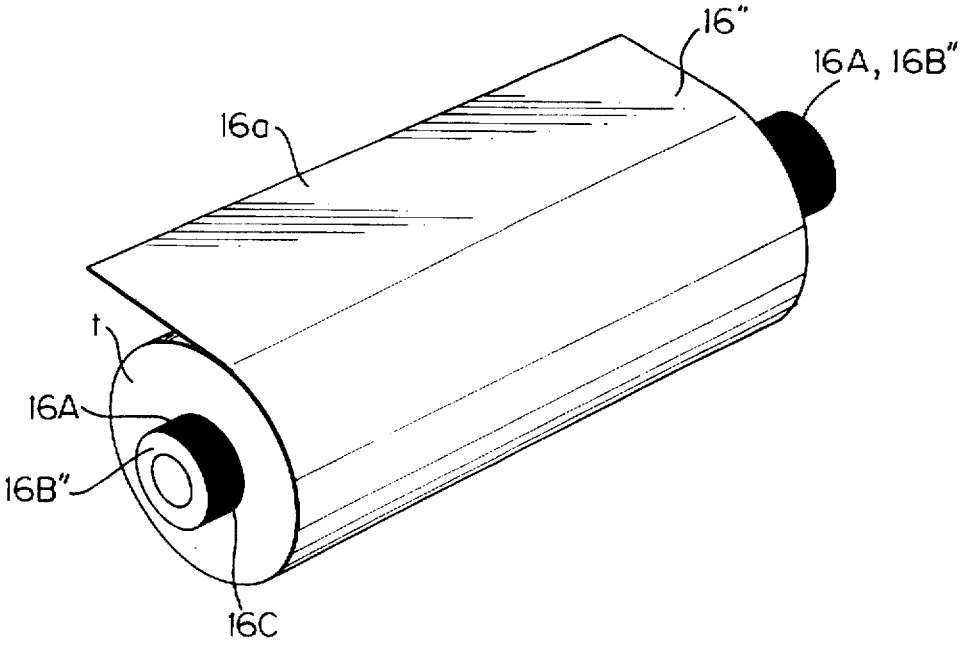
FIG. 30 is a perspective view of a stencil roll representative of a fourth embodiment of the present invention.

FIG. 30 shows a stencil representative of a fourth embodiment of the present invention. As shown, a roll 16" replacing the roll 16 of the first embodiment has a core 16B" in addition to the stencil 16*a*. The core 16B" includes a low reflectance portion 16A on its circumferential surface. The low reflectance portion 16A plays the role of sensing means for detecting the limit diameter of the roll 16".

Figure 31:
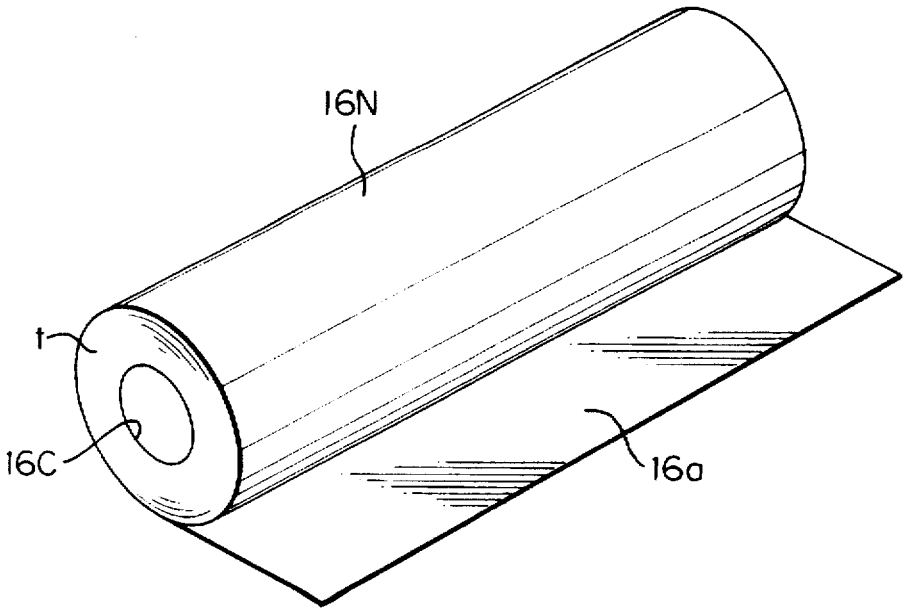
FIG. 31 is a perspective view showing a seventh modification of the fourth embodiment.

The roll 16" shown in FIG. 30 differs from the roll 16 shown in FIGS. 1–21 in that it has the configuration of the roll 16' of the third modification. Specifically, the core 16B" has an axial length or width greater than the width of the stencil 16*a* and protrudes from the opposite ends t of the roll 16". FIG. 31 shows a new stencil roll 16N having a through bore 16C. The inside diameter of the through bore 16C is constant throughout all the rolls without regard to their outside diameters. The operator can insert the core 16B" longer than the roll 16" or 16N into the through bore 16C by holding it. The core 16B" can therefore be shared by all the rolls which may be different in outside diameter from each other. The low reflectance portion 16A is implemented by a black paint like the low reflectance portion 16A of FIG. 10.

When the roll 16" reaches its limit diameter, the operator should only pull out the core 16B" from the roll 16" and then insert it into the through bore 16C of the new roll 16N. Recycling the core 16B" is significant in view of the limited resources. The previously stated stencil sensing means 60 senses the low reflectance portion 16A of the core 16B" through the stencil 16*a* when the roll 16" reaches its limit diameter, as stated earlier.

As described above, this embodiment allows the core 16B" to be shared by all the rolls. In addition, because the roll 16" does not have to be provided with the low reflectance portion 16A, the roll 16" can be formed by simply rolling a stencil. This reduces the production cost of the roll 16".

The roll 16N shown in FIG. 31 is representative of a seventh modification of the fourth embodiment at the same time. The roll 16N is formed simply by rolling the stencil 16*a* and lacks a core. To form the roll 16N, the stencil 16*a* is wound round, e.g., the core 16B" of FIG. 30, and then the core 16B" is pulled out from the resulting roll 16". The roll 16N, however, has a problem that the radially inner part of the stencil 16*a* is easy to loosen. In light of this, starch, for example, may be applied to at least one end t of the roll 16N so as to adhere the side faces and/or the side edges of the consecutive turns of the stencil 16*a*. Because the roll 16N does not need a core, the stencil 16*a* is available at a low cost as one of supplies.

Figure 32:
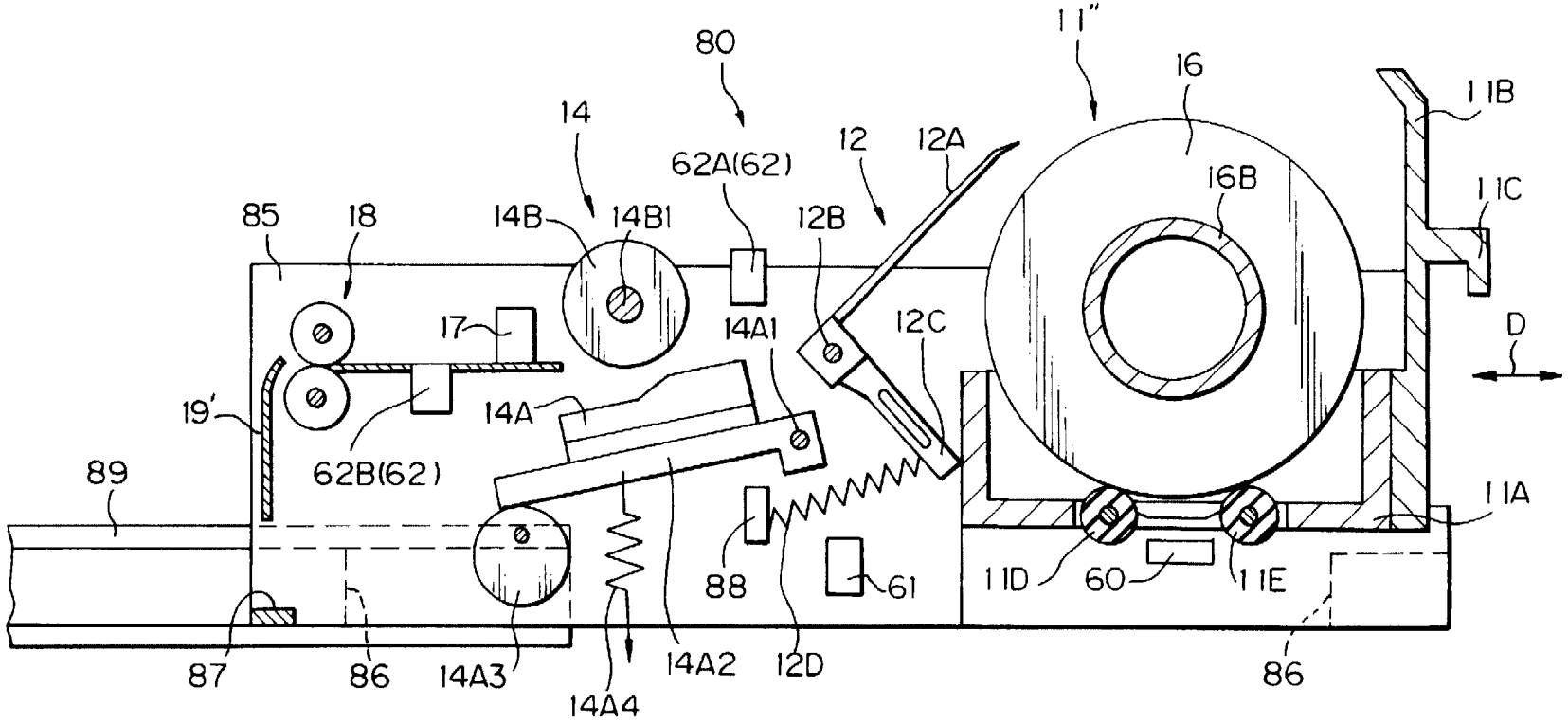
FIG. 32 is a sectional front view showing a fifth embodiment of the present invention.
Figure 33:
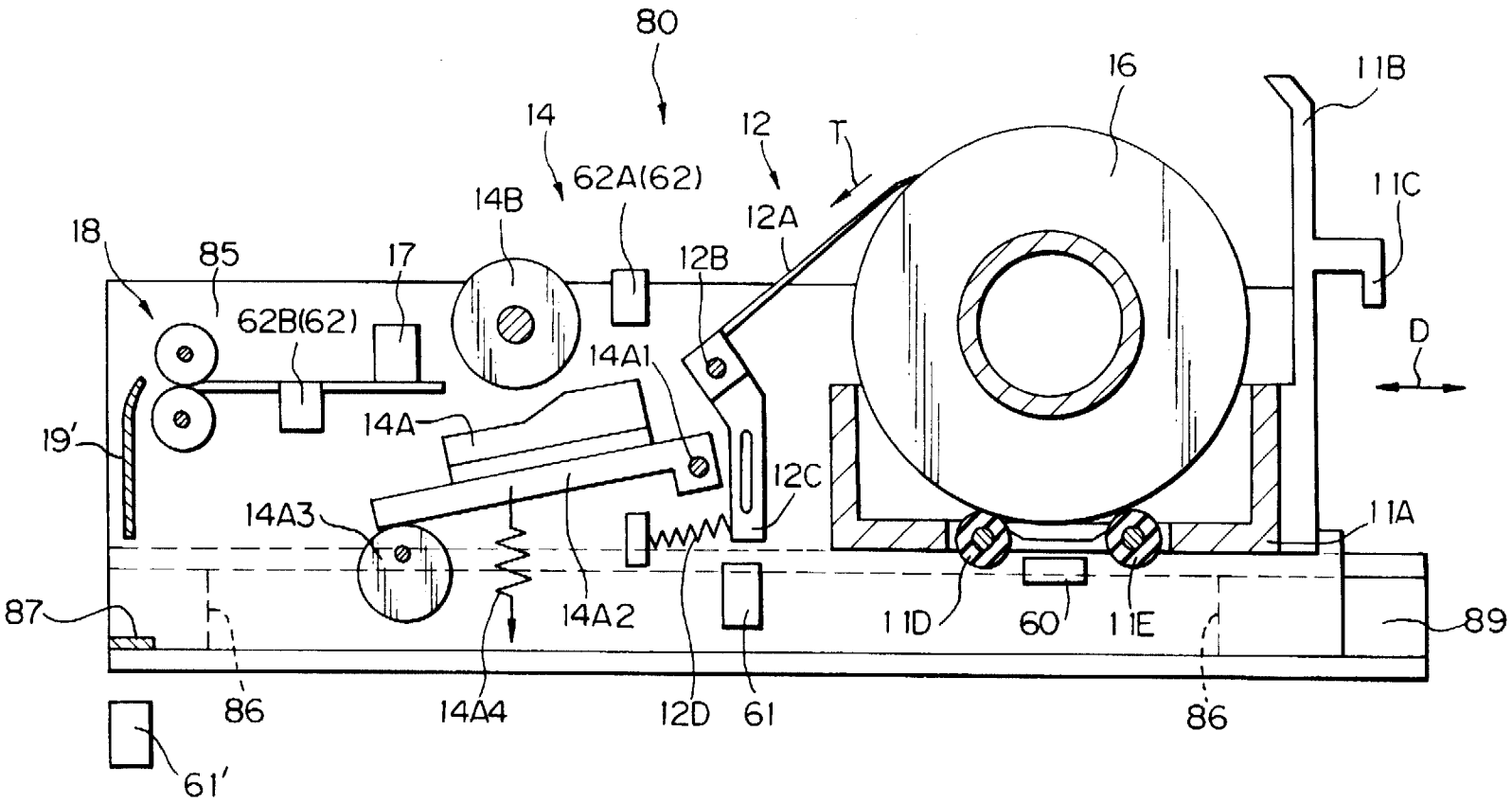
FIG. 33 is a sectional front view showing a master making unit included in the fifth embodiment and located at its operative position.
Figure 34:
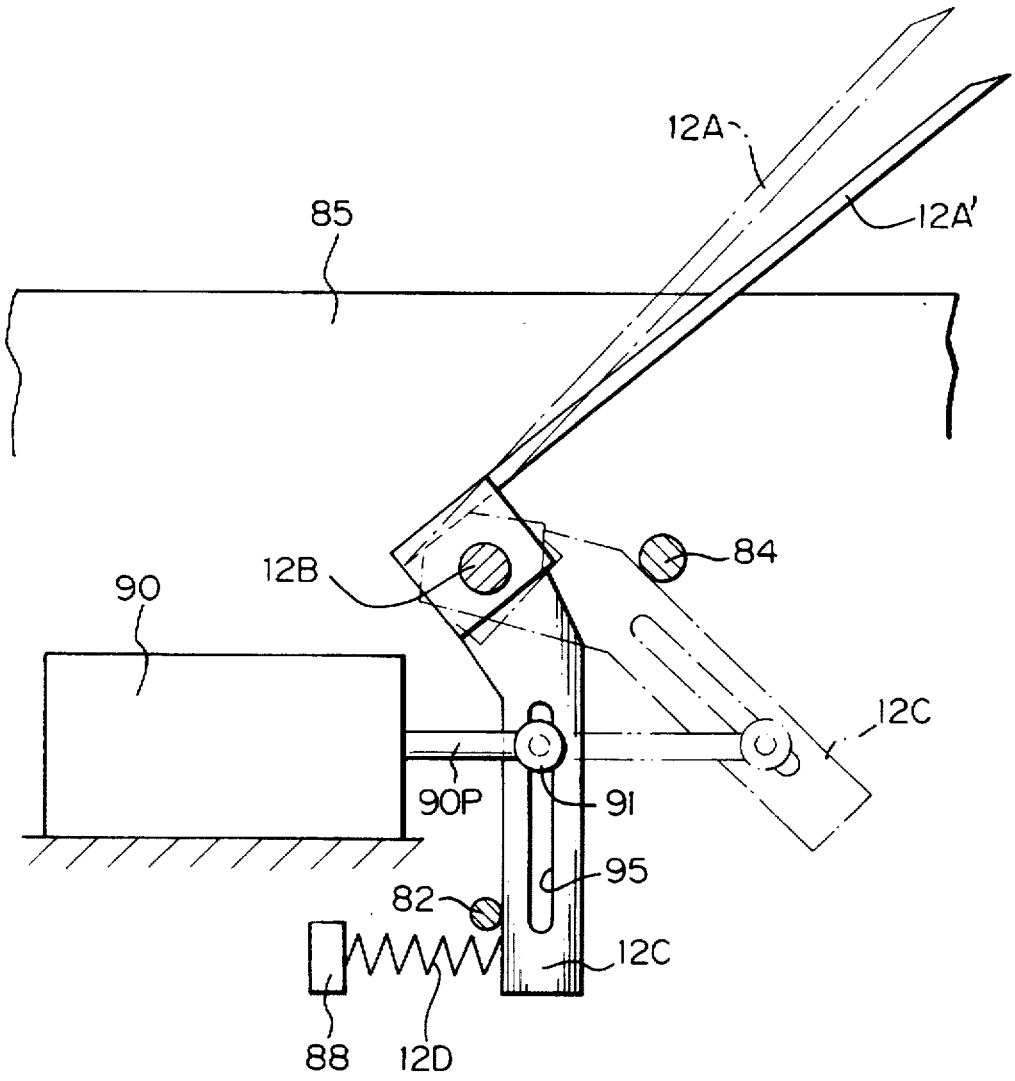
FIG. 34 is a fragmentary sectional front view of an electrically interlocked rotating mechanism applicable to the fifth embodiment.

Referring to FIGS. 32–34, a fifth embodiment of the present invention will be described. This embodiment differs from the first embodiment in that it has a master making unit 80, as distinguished from the master making device, removably mounted to the body of the stencil printer. As shown, the master making unit 80 has a roll holding section 11" in addition to the previously stated master making means and cutting means. The roll holding section 11", like the roll holding section 11, has stencil storing means and allows the roll 16 to be set therein, but the section 11" is not movable. In this embodiment, the so-to-speak mechanically interlocked mechanism for rotating the peeler support member 12C is replaced with an electrically interlocked mechanism.

The construction and operation of the fifth embodiment will be described specifically, concentrating on the differences between the first embodiment and the fifth embodiment.

The master making unit 80 has a right and a left side wall 85 supporting the right and left walls of the roll holder 11A of the roll holding section 11", shaft 14A1 of the head support arm 14A2, shaft 14B1 of the platen roller 14B, shaft of the eccentric cam 14A3, shafts of the rollers 18, mechanism for driving the cutting means, etc. The unit 80 is bodily movable in the right-and-left direction, as viewed in FIG. 32. Four rectangular projections 86 similar to the projections shown in, e.g., FIG. 3 protrude from the front and rear ends of the right and left side walls 85.

The roll holding section 11" differs from the roll holding section 11 in that its right and left side walls are respectively affixed to the right and left side walls 85 of the unit 80, and in that it does not have the presser portions 11G. The right side wall 85 is formed with holes, not shown, for allowing the shafts of the stencil drive rollers 11D and 11E to protrude to the outside.

A solenoid 90 is mounted on the right side wall 85 for selectively rotating the peeler support member 12C functioning in the same manner as the presser portions 11G. A stepped pin 91 is studded on the free end of a plunger 90*p* extending from the solenoid 90. The stepping pin 91 is loosely fitted in an elongate slot 95 formed in the peeler support member 12C in the up-and-down direction. Stops 82 each protrudes inward from the respective side wall 85 in order to stop the support member 12C at its upright position indicated by a solid line. Spring seats 88 each protrudes inward from the respective side wall 85. Compression springs 12D are each anchored at one end to the respective spring seat 88 and at the other end to the support member 12C. If desired, the compression springs 12D may be replaced with a similar compression spring loaded between the plunger 90*p* of the solenoid 90 and the side wall of the support member 12C.

The right and left side walls, not shown, of the printer body are respectively provided with channel-like guide rails 89 facing each other at their open ends. The projections 86 of the right and left unit side walls 85 are respectively slidably received in the right and left guide rails 89. Second stencil set sensing means 61' similar to the first stencil set sensing means 61 is positioned below and slightly inward of the front end of the right guide rail 89. A reflection surface 87 (indicated by hatching) similar to the reflection surface of the first embodiment is provided on the underside of the front end of the right side wall 85. A guide 19' is similar to the guide 19 except that it is elongate in order to surely feed the leading edge of the stencil 16*a* held in its stand-by condition to the damper 2D.

With the above configuration, the master making unit 80 is selectively movable to its operative position defined in the printer body or to its inoperative position remote from the operative position. At the operative position, the unit 80 allows the stencil 16*a* to be paid out from the roll 16. At the inoperative position, the unit 80 allows the roll 16 to be loaded in its roll holding section 11". The motor 13A included in the stencil drive section 13 is mounted on the right side wall of the printer body together with the other parts in the same manner as in the first embodiment.

The operation of the controller 50 unique to this embodiment is as follows. When the master making unit 80 is brought to the operative position, the second stencil set sensing means 61' senses the reflection surface 87 of the right side wall 85 and sends its output to the controller 50. In response, the controller 50 outputs a command signal for turning on the solenoid 90. The solenoid 90 pulls its plunger 90*p* against the action of the compression springs 12D. As a result, as shown in FIG. 34, the peeler support member 12C is rotated from its position indicated by a dash-and-dot line to its upright position indicated by a solid line. This causes the peeler 12A to rotate clockwise and contact the roll 16. This is followed by the same procedure as described in the first embodiment. Specifically, the motor 13A is energized to rotate the drive rollers 11D and 11E in order to peel off the stencil 16*a* from the roll 16. The stencil 16*a* is continuously paid out until its leading edge has been sensed by the first leading edge sensing means 62A. When the second leading edge sensing means 62B senses the leading edge and sends its output to the controller 50, the controller 50 drives the platen pressure control section 14 in order to cause the master making means to nip the stencil 16*a*.

When the master making unit 80 is moved from the operative position to the inoperative position, the controller 50 drives the platen pressure control section 14 in order to cause the master making means to release the stencil 16*a*.

As stated above, in the illustrative embodiment, the master making unit 80 is slidable between the operative position and the inoperative position. Assume that a non-slidable document reading section is arranged on the top of the printer. Then, when the stencil 16*a* jams the transport path at, e.g., the platen roller 14B, cutting device 17 or roller 18, the operator can move the unit 80 to the inoperative position and then deal with the jam surely and easily.

When the master making unit 80 is moved into the printer body as far as the operative position, the peeler 12A is caused to adjoin or contact the roll 16 and peel off the leading edge of the stencil 16*a*. The mechanism for so moving the peeler 12A may, of course, be implemented as a mechanically interlocked mechanism as in the first embodiment and as distinguished from the above electrically interlocked mechanism including the solenoid 90.

Figure 35:
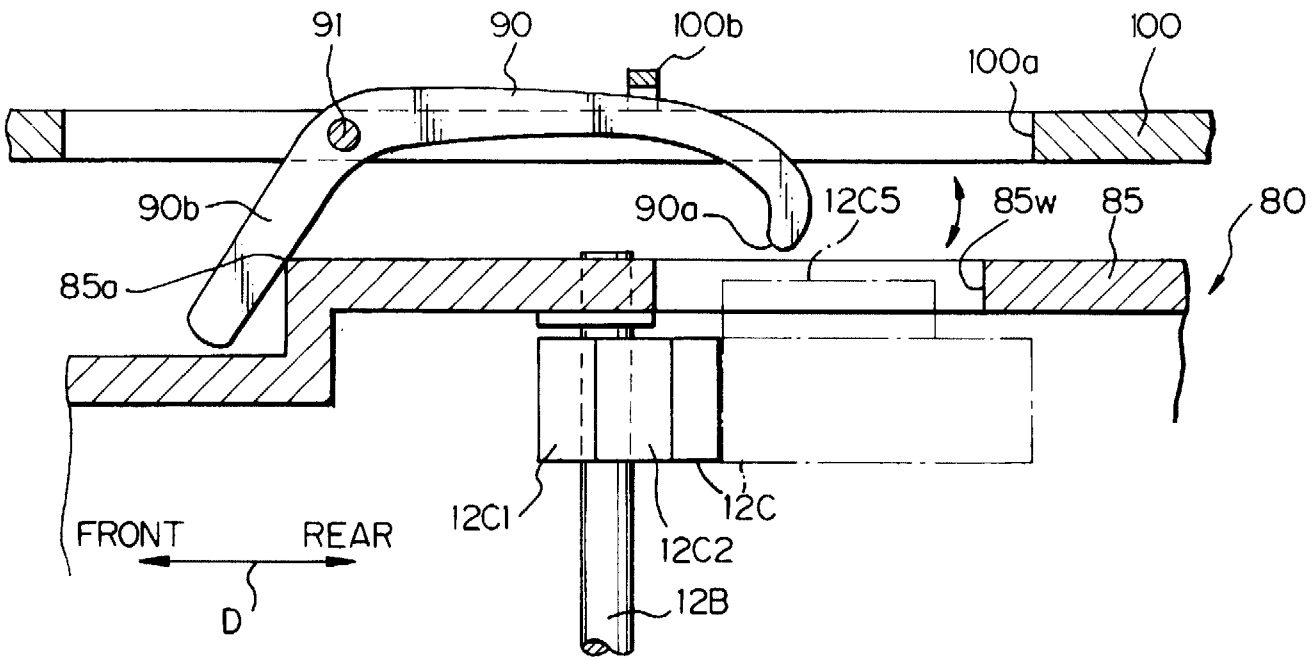
FIG. 35 is a fragmentary sectional plan view showing a mechanically interlocked rotating mechanism also applicable to the fifth embodiment.

FIG. 35 shows a specific configuration of the mechanically interlocked mechanism. In FIG. 35, the peeler 12A and its associated members are not shown for the sake of illustration. As shown, a lever 90 having an angled shape, as seen in a plan view, is mounted on the right side wall 100 of the printer body and rotatable about a shaft 91. The lever 90 has a greater leverage at its rear portion than at its front portion so as to be displaceable over a broad range. The rear wall of the peeler support member 12C partly protrudes to the right in the form of an abutment 12C5. The lever 90 has at its rear end a lug 90*a* protruding inward and allowing the lever 90 to easily contact the abutment 12C5. The right side wall 85 of the master making unit 80 has a stepped portion 85*a* at its downstream side. The stepped portion 85*a* is engageable with the front end 90*b* of the lever 90. The lug 90*a* of the lever 90 selectively contacts the abutment 12C5 or the rear wall of the peeler support member 12C.

In operation, when the master making unit 80 is brought to its operative position, the stepped portion 85*a* of the unit 80 abuts against the front end 90*b* of the lever 90 and causes the lever 90 to rotate clockwise, as seen in a plan view. Then, the lug 90*a* of the lever 90 pushes the rear wall of the peeler support member 12C held in the position shown in FIG. 32. As a result, the support member 12C is moved to the upright position shown in FIG. 33, causing the peeler 12A to contact the roll 16. A torsion coil spring, not shown, is anchored to the shaft 91 of the lever 90 and constantly biases the lever 90 counterclockwise, as seen in a plan view. Hence, when the unit 80 is moved away from the operative position, the lug 90*a* of the lever 90 is retracted and prevented from contacting the stepped portion 85*a* and other portions of the unit right wall 85. The right side wall 100 of the printer body is formed with an opening 100*a* for allowing the lever 90 to perform the above movement. The unit right side wall 85 is formed with a window 85*w* having the same function as the opening 100*a*. A stop 100*b* restricts the counterclockwise movement of the lever 90 ascribable to the torsion coil spring.

In the fifth embodiment and the specific arrangement shown in FIG. 35, the master making unit 80 consists of the roll holding section 11", master making means, and cutting device 17 including the cutting means. Alternatively, the cutting device 17 and rollers 18 may be mounted on the printer body. The crux is that the unit 80 has at least the roll holding section 11" and master making means. Of course, the master making device of the third embodiment and including the stencil feed roller 70B may be constructed into a master making unit. In addition, the arrangements shown in FIGS. 20–27 may be suitably combined with the master making device of the third embodiment in the form of a unit.

In the fifth embodiment and the arrangement of FIG. 35, the second stencil set sensing means 61' serves as one of the operation sensing means. If desired, the sensing means 61' may be replaced with a reflection type or transmission type photosensor or a microswitch mounted on the printer body and for sensing the upright position of the peeler support member 12C when the master making unit 80 is brought to the operative position. Alternatively, a microswitch or similar operation sensing means may be located upstream of the sensing means 61' in the stencil transport direction in order to sense the unit 80 arrived at a position slightly short of the operative position.

In the first to fifth embodiments and the first to seventh modifications, the platen roller 14B is rotated via, e.g., the drive transmission mechanism. Alternatively, the platen roller 14B may be driven by the stencil 16*a* being conveyed. For example, the rollers 18 located downstream of the platen roller 14B may pull the stencil 16*a* from the roll 16 such that the platen roller 14B is driven by the stencil 16*a* while contacting the thermal head 14A.

In the first to fifth embodiments and the first to seventh modifications, the stencil 16*a* may be replaced with a stencil in the form of a roll and consisting substantially only of a thermoplastic resin film which is as thin as 1 micron to 3 microns. It is to be noted that the stencil consisting substantially only of a thermoplastic resin film refers not only to a stencil implemented only by such a film, but also to a stencil implemented by a thermoplastic resin film containing a trace of an antistatic agent or similar additive or by a thermoplastic resin film having at least one overcoat layer or similar thin layer on at least one of its opposite major surfaces.

Moreover, the master making means using the thermal head 14A and platen roller 14B rotatable while pressing the stencil 16*a* against the head 14A may be replaced with, e.g., flash type or laser type master making means.

In addition, the master making device of the present invention is applicable not only to the stencil printer shown and described, but also to a printer of the type feeding ink from the outside of a print drum and taught in, e.g., Japanese Patent Laid-Open Publication No. 7-17013.

In summary, it will be seen that the present invention provides a master making device for a stencil printer and a stencil for use therewith which have various unprecedented advantages, as enumerated below.

(1) To load a roll holding section with a new stencil roll, the operator should only pull out the roll holding section from the body of the master making device. The operator sets the new roll in the roll holding section pushes the holding section into the device body as far as its operative position. Then, rotary drive means causes the roll to rotate in the direction for paying out the leading edge of a stencil. At the same time, peeling means adjoins or contacts the periphery of the roll in accordance with the varying diameter of the roll and automatically peels off the leading edge of the stencil from the roll. The leading edge of the stencil is paid out toward master making means. The stencil can therefore be surely paid out and brought to a stand-by position. This facilitates the loading of the stencil and allows it to be fully automatically paid out from the roll. The printing operation is simple and frees the operator from troublesome manipulation. The roll holding section can be moved into and out of the device body without requiring a document reading section provided on the top of the printer to be slid. The device is therefore simple, light weight, and low cost, compared to a printer having a conventional master making device.

(2) The above advantages (1) are achievable even when the master making device is constructed into a unit. In this case, the master making unit is movable into and out of the printer body. Even in a printer of the type having a non-slidable document reading section, the master making unit is movable away from its operative position. Hence, when the stencil jams a stencil transport path at, e.g., the master making means, the operator can deal with the jam surely and easily.

(3) The operator sets the roll in the roll holding section and pushes the holding section or the master making unit into the master making device or printer body. Then, the rotary drive means rotates the roll in the direction opposite to a stencil pay-out direction and then in the stencil pay-out direction. Therefore, whatever the current position of the leading edge of the stencil may be, the leading edge can be surely brought to a position where it faces the peeling means. This allows the leading edge of the stencil to be surely peeled off and separated from the roll.

(4) A thermal head and a platen roller contact each other as soon as the leading edge of the stencil arrives at a position where the head and roller face each other. Therefore, nothing obstructs the transport of the leading edge of the stencil to the above position where a platen pressure surely acts on the stencil.

(5) The thermal head and platen roller may be brought into contact with each other intermittently with the intermediary of the leading edge of the stencil. This successfully removes creases from the stencil before master making and thereby promotes desirable master making.

(6) A controller causes the rotary drive means to operate in response to an output signal of operation sensing means. The rotary drive means pays out the leading edge of the stencil until leading edge sensing means senses it. In response to an output signal of the leading edge sensing means, the controller causes a platen pressure control section to automatically set up a condition in which the master making means can nip the stencil. This makes it needless for the operator to pay out the leading edge of the stencil by hand and thereby facilitates the operation of the printer.

(7) When first stencil set sensing means determines that the roll holding section is moved away from its operative position, the controller drives the platen pressure control section to cancel the pressure of the master making means acting on the stencil. This cancels tension acting on the stencil and thereby allows the roll to be pulled out without any resistance. This is also true when the first stencil set sensing means is replaced with second stencil set sensing means responsive to the position of the master making unit.

(8) In response to an output signal of operation setting means, the controller causes the rotary drive means to continuously pay out the stencil until the leading edge sensing means senses the leading edge of the stencil. In response to an output signal of the leading edge sensing means, the controller drives the platen pressure control section to automatically set up the condition in which the master making means can press the stencil. The operator therefore can confirm the procedure up to the arrival of the roll holding section at the operative position without paying out the leading edge of the stencil by hand. The printing operation is simple and obviates troublesome manipulation at the time of stencil feed. This is also true when the roll holding section is replaced with the master making unit.

(9) The device differs from a conventional printer in that it makes it needless for the document reading section to be moved. This saves the costs for machining and assembling the structural parts in order to increase the mechanical strength of the document reading device.

(10) In response to the leading edge sensing means, the controller causes the platen pressure control section to exert a pressure on the stencil intermittently. As a result, tension repeatedly acts on the stencil being paid out from the roll, thereby smoothing the stencil.

(11) When the stencil is paid out from the roll by the rotary drive means, the peeling means and conveying means capable of contacting the peeling means nip and convey the stencil. It is therefore possible to surely pay out the stencil without regard to its elasticity, particularly when the elasticity is low and is apt to cause the leading edge to behave unstably. This obviates defective stencil feed.

(12) The peeling means adjoins or contacts the roll and peels off the leading edge of the stencil in interlocked relation to the movement of the roll holding section to its operative position. Hence, the end of the peeling means is prevented from abutting against the surface of a new stencil roll having the maximum diameter. This frees the insertion of the roll into the roll holding section from obstruction and protects the surface of the roll from damage. This is also true when the roll holding section is replaced with the master making unit.

(13) The master making means has the thermal head for selectively cutting the stencil by heat and the platen roller rotatable while pressing the stencil against the head. Therefore, the master making means is capable of surely conveying the cut stencil or master to the downstream side in the stencil transport direction while surely cutting the stencil.

(14) The peeling means is implemented as a pallet-like rotatable peeler capable of contacting the roll with its end due to its own weight. Hence, the peeling means can pay out the stencil from the roll without resorting to any special biasing means.

(15) The peeler has an elastic thin portion. When the peeler contacts the roll, the thin portion elastically deforms and prevents an unusual pressure from acting on the roll; otherwise, the unusual pressure would scratch or tear off the stencil.

(16) The peeler has a configuration, as seen in a plan view, sequentially flaring from the upstream side to the downstream side in the stencil transport direction. The peeler therefore peels off the leading edge of the stencil with its intermediate portion first and then sequentially peels off the stencil up to its opposite side edges in the widthwise direction of the stencil. This prevents the leading edge of the stencil from being caught by the peeling means and thereby prevents the stencil from jamming the transport path.

(17) The peeler has an inclined portion inclined toward the roll. The inclined portion reduces the area over which the peeler contacts the stencil in the event of peeling. This eliminates the excessive contact of the peeler with the stencil and facilitates the guide for the leading edge of the stencil.

(18) Master storing means has friction members capable of contacting the axially opposite ends of the roll in order to position the roll in the widthwise direction perpendicular to the stencil pay-out direction, and exerting resistance opposite in direction to the rotation for paying out the stencil from the roll. This allows the roll to be easily loaded in the roll holding section and prevents the stencil being paid out from creasing, thereby obviating defective printings ascribable to creases. In addition, because the friction members contact the opposite ends of the roll, use can b e made of a stencil roll lacking a core protruding from its opposite ends.

(19) The rotary drive means is implemented as drive rollers each consisting of roller elements spaced in the axial direction of the roll. The roll can therefore face the drive rollers only locally, i.e., not over the entire axial dimension thereof. This facilitates the alignment of the axis of the roll and the axis of the drive rollers and thereby insures even rotating forces acting on the roll. Even when the leading edge of the stencil is rotated together with the roll and bent without being paid out, it can elastically rise in a clearance between the roller elements. This prevents the leading edge of the stencil from jamming the transport path.

(20) The rotary drive means is implemented as drive rollers respectively located at the upstream side and downstream side in the stencil feed direction and arranged at a preselected center angle with respect to the axis of the roll. Therefore, even when the roll reaches its limit diameter due to the consumption of the stencil, it can be surely supported by the drive rollers and rotated in the stencil pay-out direction.

(21) The rotary drive means is implemented as driven rollers contacting and driven by the roll, and frictional drive means contacting the roll and causing it to rotate in the stencil pay-out direction. Because the frictional drive means directly rotates the roll, a drive transmission mechanism for paying out the stencil is simplified, and a miniature motor is usable.

(22) When the roll having the core protruding from it s opposite ends is loaded in the stencil storing means, the ends of the core are rotatably received in notches formed in the storing means. It is therefore possible to position the roll in the storing means while guiding the core.

(23) Frictional drive means respectively contact the circumferences of the opposite ends of the core. The drive means therefore do not contact the surface of the stencil, so that the surface of the stencil is free from damage.

(24) The core of the roll around which the stencil is wound is implemented as a tubular member. Mating drive means mates with the tubular core and causes the roll to rotate in the direction for paying out the leading edge of the stencil toward the master making means. This prevents the axis of rotation of the roll from being displaced and thereby reduces the oscillation of the roll. As a result, the frequency that the position of the peeling means must be adjusted relative to the circumference of the roll is reduced. This reduces the cost for assembling the peeling means, and in addition simplifies the roll drive mechanism.

(25) The core for winding the stencil thereround has a low reflectance portion on its circumference. The core can therefore be shared by different stencil rolls. This, coupled with the fact that the core is optically sensed, reduces the production cost by recycling. In addition, the time for replacing the stencil can be surely determined without regard to the diameter of the roll.

(26) The stencil is simply rolled on itself without using a core. This reduces the cost of the stencil roll belonging to a family of supplies.

Various modifications will become possible for those skilled in the art after receiving the teachings of the present disclosure without departing from the scope thereof.

What is claimed is:

1. A master making device comprising:

a body;

stencil storing means for storing a stencil in a form of a roll while allowing said stencil to be paid out from the roll;

master making means for making a master out of the stencil paid out from the roll;

cutting means for cutting off the master;

roll holding means movable into and out of said body and for setting the roll thereon;

rotary drive means for causing the roll set on said roll holding means to rotate in a stencil pay-out direction for paying out a leading edge of the stencil toward said master making means; and peeling means for peeling off the leading edge of the stencil from the roll by adjoining or contacting a circumference of the roll in accordance with a varying diameter of the roll.

2. A device as claimed in claim 1, further comprising:

a rotary drive means control device; and wherein said control device controls said rotary drive means when said roll holding means loaded with the roll is inserted into said body to initially rotate the roll in a direction opposite to the stencil pay-out direction and then in the stencil pay-out direction.

3. A device as claimed in claim 1, wherein said master making means comprises a thermal head for selectively cutting the stencil by heat, and a platen roller rotatable while pressing the stencil between said platen roller and said thermal head.

4. A device as claimed in claim 3, wherein one of said thermal head and said platen roller is spaced from the other and a spacing control device is provided along with a stencil leading edge detector and a moving mechanism, said spacing control device controlling said moving mechanism to move the thermal head and the platen roller into contact with one another when the leading edge of the stencil is detected by said leading edge detector to be in a position where said thermal head and said platen roller are located.

5. A device as claimed in claim 4, wherein when the leading edge of the stencil is detected by the stencil leading edge detector, the spacing control device causes the moving mechanism to move said thermal head and said platen roller together intermittently so as to press the stencil intermittently.

6. A device as claimed in claim 1, wherein said roll holding means includes means cooperating with said peeling means to cause said peeling means to peel off the leading edge of the stencil from the roll by adjoining or contacting the circumference of the roll in interlocked relation to a movement of said roll holding means into an operative position in said body.

7. A device as claimed in claim 1, wherein said peeling means comprises a rotatable peeler capable of contacting the circumference of the roll at a free end thereof due to a weight of said peeler.

8. A device as claimed in claim 7, wherein said peeler comprises an elastic thin portion.

9. A device as claimed in claim 7, wherein said peeler has a configuration, as viewed in a plan view, sequentially flaring from an upstream side to a downstream side in the stencil pay-out direction such that said peeler first peels off an intermediate portion of the leading edge of the stencil in a widthwise direction of the stencil, and then peels off side portions up to opposite side edges of said free end.

10. A device as claimed in claim 7, wherein said free end of said peeler has an inclined portion inclined toward the circumference of the roll.

11. A device as claimed in claim 1, wherein said stencil storing means comprises friction members capable of respectively contacting axially opposite ends of the roll to thereby position the roll in a widthwise direction of the roll perpendicular to the stencil pay-out direction, and for exerting resistance in a direction opposite to a direction in which said roll rotates for paying out the stencil.

12. A device as claimed in claim 1, wherein said rotary drive means comprises drive rollers each consisting of a plurality of roller elements spaced in an axial direction of the roll.

13. A device as claimed in claim 1, wherein said rotary drive means comprises drive rollers respectively located at an upstream side and a downstream side in the stencil pay-out direction and arranged at a preselected center angle with respect to an axis of rotation of the roll.

14. A device as claimed in claim 1, wherein said rotary drive means comprises driven rollers capable of contacting and being driven by the circumference of the roll, and frictional drive means for causing the roll to rotate in a direction for paying out the leading edge of the stencil.

15. A device as claimed in claim 1, further comprising notches formed in said stencil storing means for receiving and rotatably supporting, when the roll has the stencil wound round a core protruding from axially opposite ends of the roll, portions of the core protruding from the roll.

16. A device as claimed in claim 15, further comprising frictional drive means capable of frictionally contacting circumferences of opposite ends of the core.

17. A device as claimed in claim 15, further comprising mating drive means for mating, when the core is a tubular core, with inner periphery of the tubular core to thereby rotate the roll in a direction for paying out the leading edge of the stencil.

18. A device as claimed in claim 1, wherein the roll has at a center thereof a core for winding the stencil thereround, and wherein the core has a low reflectance portion on a circumference thereof.

19. A device as claimed in claim 1, wherein the stencil is wound round itself in the form of the roll.

20. A master making device for a stencil printer, comprising:

stencil storing means for storing a stencil in the form of a roll while allowing said stencil to be paid out from the roll;

master making means for making a master out of the stencil paid out from the roll;

cutting means for cutting off the master;

roll holding means for setting the roll thereon;

rotary drive means for causing the roll set on said roll holding means to rotate in a stencil pay-out direction for paying out a leading edge of the stencil toward said master making means; and peeling means for peeling off the leading edge of the stencil from the roll by adjoining or contacting a circumference of the roll in accordance with a varying diameter of the roll;

wherein said roll holding means and said master making means are constructed into a single master making unit, said unit cooperating with means associated with a body housing the stencil printer for providing unit movement into and out of the body housing the stencil printer.

21. A device as claimed in claim 20, further comprising:

a rotary drive means control device: and wherein said control device controls said rotary drive means when said master making unit loaded with the roll is inserted into said body to initially rotate the roll in a direction opposite to the stencil pay-out direction and then in the stencil pay-out direction.

22. A device as claimed in claim 20, wherein said master making means comprises a thermal head for selectively cutting the stencil by heat, and a platen roller rotatable while pressing the stencil between said platen roller and said thermal head.

23. A device as claimed in claim 22, wherein one of said thermal head and said platen roller is spaced from the other and a spacing control device is provided alone with a stencil leading edge detector and a moving mechanism, said spacing control device controlling said moving mechanism to move said thermal head and said platen roller into contact with one another when the leading edge of the stencil is detected by said leading edge detected to be in a position where said thermal head and said platen roller are located.

24. A device as claimed in claim 23, wherein when the leading edge of the stencil is detected by the leading edge detector, the spacing control device causes the moving mechanism to move said thermal head and said platen roller together intermittently so as to press the stencil intermittently.

25. A device as claimed in claim 20, wherein said roll holding means includes means cooperating with said peeling means to cause said peeling means to peel off the leading edge of the stencil from the roll by adjoining or contacting the circumference of the roll in interlocked relation to a movement of said master making unit into an operative position in said body.

26. A device as claimed in claim 20, wherein said peeling means comprises a rotatable peeler capable of contacting the circumference of the roll at a free end thereof due to a weight of said peeler.

27. A device as claimed in claim 26, wherein said peeler comprises an elastic thin portion.

28. A device as claimed in claim 26, wherein said peeler has a configuration, as viewed in a plan view, sequentially flaring from an upstream side to a downstream side in the stencil pay-out direction such that said peeler first peels off an intermediate portion of the leading edge of the stencil in a widthwise direction of the stencil, and then peels off side portions up to opposite side edges of said free end.

29. A device as claimed in claim 26, wherein said free end of said peeler has an inclined portion inclined toward the circumference of the roll.

30. A device as claimed in claim 20, wherein said stencil storing means comprises friction members capable of respectively contacting axially opposite ends of the roll to thereby position the roll in a widthwise direction of the roll perpendicular to the stencil pay-out direction, and for exerting resistance in a direction opposite to a direction in which said roll rotates for paying out the stencil.

31. A device as claimed in claim 20, wherein said rotary drive means comprises drive rollers each consisting of a plurality of roller elements spaced in an axial direction of the roll.

32. A device as claimed in claim 20, wherein said rotary drive means comprises drive rollers respectively located at an upstream side and a downstream side in the stencil pay-out direction.

33. A device as claimed in claim 20, wherein said rotary drive means comprises driven rollers capable of contacting and being driven by the circumference of the roll, and frictional drive means for causing the roll to rotate in a direction for paying out the leading edge of the stencil.

34. A device as claimed in claim 20, further comprising notches formed in said stencil storing means for receiving and rotatably supporting, when the roll has the stencil wound round a core protruding from axially opposite ends of the roll, portions of the core protruding from the roll.

35. A device as claimed in claim 34, further comprising frictional drive means capable of frictionally contacting circumferences of opposite ends of the core.

36. A device as claimed in claim 34, further comprising mating drive means for mating, when the core is a tubular core, with inner periphery of the tubular core to thereby rotate the roll in a direction for paying out the leading edge of the stencil.

37. A device as claimed in claim 20, wherein the roll has at a center thereof a core for winding the stencil thereround, and wherein the core has a low reflectance portion on a circumference thereof.

38. A device as claimed in claim 20, wherein the stencil is wound round itself in the form of the roll.

39. A master making device comprising:

a body;

stencil storing means for storing a stencil in a form of a roll while allowing said stencil to be paid out from the roll;

master making means for making a master out of the stencil paid out from the roll;

cutting means for cutting off the master;

roll holding means movable into and out of said body and for setting the roll thereon;

rotary drive means for causing the roll set on said roll holding means to rotate in a stencil pay-out direction for paying out a leading edge of the stencil toward said master making means;

peeling means for peeling off the leading edge of the stencil from the roll by adjoining or contacting a circumference of the roll in accordance with a varying diameter of the roll;

platen pressure control means for causing said master making means to selectively contact the stencil;

operation sensing means mounted on said body for determining a time for said rotary drive means to start operating;

leading edge sensing means located at a position toward which the leading edge of the stencil is paid out, and for sensing the leading edge of the stencil; and a controller connected at an input side to said operation sensing means and said leading edge sensing means and at an output side to said rotary drive means and said platen pressure control means;

wherein said controller causes, in response to an output signal of said operation sensing means, said rotary drive means to continuously pay out the leading edge of the stencil peeled off from the roll until said leading edge sensing means senses the leading edge, and then in response to an output signal of said leading edge sensing means, drives said platen pressure control means to set up a condition in which said master making means is capable of pressing the stencil.

40. A device as claimed in claim 39, wherein said operation sensing means comprises first stencil set sensing means for sensing said roll holding means inserted into said body as far as an operative position of said roll holding means, wherein said controller drives, when said first stencil set sensing means senses a movement of said roll holding means away from said operative position, said platen pressure control means to cancel a pressure being exerted by said master making means on the stencil.

41. A device as claimed in claim 39, wherein said controller causes said platen pressure control means to press the stencil intermittently in response to the output signal of said leading edge sensing means.

42. A device as claimed in claim 39, wherein said roll holding means includes means cooperating with said peeling means to cause said peeling means to peel off the leading edge of the stencil from the roll by adjoining or contacting the circumference of the roll in interlocked relation to a movement of said roll holding means into an operative position in said body.

43. A device as claimed in claim 39, wherein said peeling means comprises a rotatable peeler capable of contacting the circumference of the roll at a free end thereof due to a weight of said peeler.

44. A master making device for a stencil printer, comprising:

stencil storing means for storing a stencil in a form of a roll while allowing said stencil to be paid out from the roll;

master making means for making a master out of the stencil paid out from the roll;

cutting means for cutting off the master;

roll holding means for setting the roll thereon;

rotary drive means for causing the roll set on said roll holding means to rotate in a stencil pay-out direction for paying out a leading edge of the stencil toward said master making means;

peeling means for peeling off the leading edge of the stencil from the roll by adjoining or contacting a circumference of the roll in accordance with a varying diameter of the roll;

platen pressure control means for causing said master making means to selectively contact the stencil;

operation sensing means for determining a time for said rotary drive means to start operating;

leading edge sensing means located at a position towards which the leading edge of the stencil is paid out, and for sensing the leading edge of the stencil; and a controller connected at an input side to said operation sensing means and said leading edge sensing means and at an output side to said rotary drive means and said platen pressure control means;

wherein said roll holding means and said master making means are constructed into a single master making unit, said unit cooperating with means associated with a body housing the stencil printer for unit movement into and out of the body housing said stencil printer, and wherein said controller causes, in response to an output signal of said operation sensing means, said rotary drive means to continuously pay out the leading edge of the stencil peeled off from the roll until said leading edge sensing means senses the leading edge, and then in response to an output signal of said leading edge sensing means, drives said platen pressure control means to set up a condition in which said master making means is capable of pressing the stencil.

45. A device as claimed in claim 44, wherein said operation sensing means comprises stencil set sensing means for sensing said master making unit inserted into said body as far as an operative position of said master making unit, wherein said controller drives, when said stencil set sensing means senses a movement of said master making unit away from said operative position, said platen pressure control means to cancel a pressure being exerted by said master making means on the stencil.

46. A device as claimed in claim 44, wherein said controller causes said platen pressure control means to press the stencil intermittently in response to the output signal of said leading edge sensing means.

47. A device as claimed in claim 44, wherein said roll holding means includes means cooperating with said peeling means to cause said peeling means to peel off the leading edge of the stencil from the roll by adjoining or contacting the circumference of the roll in interlocked relation to a movement of said master making unit into an operative position in said body.

48. A device as claimed in claim 44, wherein said peeling means comprises a rotatable peeler capable of contacting the circumference of the roll at a free end thereof due to a weight of said peeler.

49. A master making device comprising:

a body;

stencil storing means for storing a stencil in a form of a roll while allowing said stencil to be paid out from the roll;

master making means for making a master out of the stencil paid out from the roll;

cutting means for cutting off the master;

roll holding means movable into and out of said body and for setting the roll thereon;

rotary drive means for causing the roll set on said roll holding means to rotate in a stencil pay-out direction for paying out a leading edge of the stencil toward said master making means;

peeling means for peeling off the leading edge of the stencil from the roll by adjoining or contacting a circumference of the roll in accordance with a varying diameter of the roll;

platen pressure control means for causing said master making means to selectively contact the stencil;

operation setting means for setting a time for said rotary drive means to start operating;

leading edge sensing means located at a position toward which the leading edge of the stencil is paid out, and for sensing the leading edge of the stencil; and a controller connected at an input side to said operation setting means and said leading edge sensing means and at an output side to said rotary drive means and said platen pressure control means;

wherein said controller causes, in response to an output signal of said operation setting means, said rotary drive means to continuously pay out the leading edge of the stencil peeled off from the roll until said leading edge sensing means senses the leading edge, and then in response to an output signal of said leading edge sensing means, drives said platen pressure control means to set up a condition in which said master making means is capable of pressing the stencil.

50. A device as claimed in claim 49, wherein said controller causes said platen pressure control means to press the stencil intermittently in response to the output signal of said leading edge sensing means.

51. A device as claimed in claim 49, wherein said roll holding means includes means cooperating with said peeling means to cause said peeling means to peel off the leading edge of the stencil from the roll by adjoining or contacting the circumference of the roll in interlocked relation to a movement of said roll holding means into an operative position in said body.

52. A device as claimed in claim 49, wherein said peeling means comprises a rotatable peeler capable of contacting the circumference of the roll at a free end thereof due to a weight of said peeler.

53. A master making device for a stencil printer, comprising:

stencil storing means for storing a stencil in a form of a roll while allowing said stencil to be paid out from the roll;

master making means for making a master out of the stencil paid out from the roll;

cutting means for cutting off the master;

roll holding means for setting the roll thereon;

rotary drive means for causing the roll set on said roll holding means to rotate in a stencil pay-out direction for paying out a leading edge of the stencil toward said master making means;

peeling means for peeling off the leading edge of the stencil from the roll by adjoining or contacting a circumference of the roll in accordance with a varying diameter of the roll;

platen pressure control means for causing said master making means to selectively contact the stencil;

operation setting means for setting a time for said rotary drive means to start operating;

leading edge sensing means located at a position towards which the leading edge of the stencil is paid out, and for sensing the leading edge of the stencil; and a controller connected at an input side to said operation setting means and said leading edge sensing means and at an output side to said rotary drive means and said platen pressure control means;

wherein said roll holding means and said master making means are constructed into a single master making unit, said unit cooperating with means associated with a body housing the stencil printer for unit movement into and out of the body housing the stencil printer, and wherein said controller causes, in response to an output signal of said operation setting means, said rotary drive means to continuously pay out the leading edge of the stencil peeled off from the roll until said leading edge sensing means senses the leading edge, and then in response to an output signal of said leading edge sensing means, drives said platen pressure control means to set up a condition in which said master making means is capable of pressing the stencil.

54. A device as claimed in claim 53, wherein said controller causes said platen pressure control means to press the stencil intermittently in response to the output signal of said leading edge sensing means.

55. A device as claimed in claim 53, wherein said roll holding means includes means cooperating with said peeling means to cause said peeling means to peel off the leading edge of the stencil from the roll by adjoining or contacting the circumference of the roll in interlocked relation to a movement of said master making unit into an operative position in said body.

56. A device as claimed in claim 53, wherein said peeling means comprises a rotatable peeler capable of contacting the circumference of the roll at a free end thereof due to a weight of said peeler.

57. A master making device comprising:

a body;

stencil storing means for storing a stencil in a form of a roll while allowing said stencil to be paid out from the roll;

master making means for making a master out of the stencil paid out from the roll;

cutting means for cutting off the master;

roll holding means movable into and out of said body and for setting the roll thereon;

rotary drive means for causing the roll set on said roll holding means to rotate in a stencil pay-out direction for paying out a leading edge of the stencil toward said master making means;

peeling means for peeling off the leading edge of the stencil from the roll by adjoining or contacting a circumference of the roll in accordance with a varying diameter of the roll; and stencil conveying means for conveying the leading edge of the stencil peeled off from the roll while contacting said peeling means.

58. A device as claimed in claim 57, wherein said roll holding means includes means cooperating with said peeling means to cause said peeling means to peel off the leading edge of the stencil from the roll by adjoining or contacting the circumference of the roll in interlocked relation to a movement of said roll holding means into an operative position in said body.

59. A device as claimed in claim 57, wherein said peeling means comprises a rotatable peeler capable of contacting the circumference of the roll at a free end thereof due to a weight of said peeler.

60. A device as claimed in claim 59, wherein said peeler comprises an elastic thin portion.

61. A device as claimed in claim 59, wherein said peeler has a configuration, as viewed in a plan view, sequentially flaring from an upstream side to a downstream side in the stencil pay-out direction such that said peeler first peels off an intermediate portion of the leading edge of the stencil in a widthwise direction of the stencil, and then peels off side portions up to opposite side edges of said free end.

62. A device as claimed in claim 59, wherein said free end of said peeler has an inclined portion inclined toward the circumference of the roll.

63. A device as claimed in claim 57, wherein said stencil storing means comprises friction members capable of respectively contacting axially opposite ends of the roll to thereby position the roll in a widthwise direction of the roll perpendicular to the stencil pay-out direction, and for exerting resistance in a direction opposite to a direction in which said roll rotates for paying out the stencil.

64. A device as claimed in claim 57, wherein said rotary drive means comprises drive rollers each consisting of a plurality of roller elements spaced in an axial direction of the roll.

65. A device as claimed in claim 57, wherein said rotary drive means comprises drive rollers respectively located at an upstream side and a downstream side in the stencil pay-out direction.

66. A device as claimed in claim 57, wherein said rotary drive means comprises driven rollers capable of contacting and being driven by the circumference of the roll, and frictional drive means for causing the roll to rotate in a direction for paying out the leading edge of the stencil.

67. A device as claimed in claim 57, further comprising notches formed in said stencil storing means for receiving and rotatably supporting, when the roll has the stencil wound round a core protruding from axially opposite ends of the roll, portions of the core protruding from the roll.

68. A device as claimed in claim 67, further comprising frictional drive means capable of frictionally contacting circumferences of opposite ends of the core.

69. A device as claimed in claim 67, further comprising mating drive means for mating, when the core is a tubular core, with inner periphery of the tubular core to thereby rotate the roll in a direction for paying out the leading edge of the stencil.

70. A device as claimed in claim 57, wherein the roll has at a center thereof a core for winding the stencil thereround, and wherein the core has a low reflectance portion on a circumference thereof.

71. A device as claimed in claim 57, wherein the stencil is wound round itself in the form of the roll.

72. A master making device for a stencil printer, comprising:

stencil storing means for storing a stencil in a form of a roll while allowing said stencil to be paid out from the roll;

master making means for making a master out of the stencil paid out from the roll;

cutting means for cutting off the master;

roll holding means for setting the roll thereon;

rotary drive means for causing the roll set on said roll holding means to rotate in a stencil pay-out direction for paying out a leading edge of the stencil toward said master making means;

peeling means for peeling off the leading edge of the stencil from the roll by adjoining or contacting a circumference of the roll in accordance with a varying diameter of the roll; and stencil conveying means for conveying the leading edge of the stencil peeled off from the roll while contacting said peeling means;

wherein said roll holding means and said master making means are constructed into a single unit, said unit cooperating with means associated with a body housing the stencil printer for unit movement into and out of the body housing said stencil printer.

73. A device as claimed in claim 72, wherein said roll holding means includes means cooperating with said peeling means to cause said peeling means to peel off the leading edge of the stencil from the roll by adjoining or contacting the circumference of the roll in interlocked relation to a movement of said master making unit into an operative position in said body.

74. A device as claimed in claim 72, wherein said peeling means comprises a rotatable peeler capable of contacting the circumference of the roll at a free end thereof due to a weight of said peeler.

75. A device as claimed in claim 74, wherein said peeler comprises an elastic thin portion.

76. A device as claimed in claim 74, wherein said peeler has a configuration, as viewed in a plan view, sequentially flaring from an upstream side to a downstream side in the stencil pay-out direction such that said peeler first peels off an intermediate portion of the leading edge of the stencil in a widthwise direction of the stencil, and then peels off side portions up to opposite side edges of said free end.

77. A device as claimed in claim 74, wherein said free end of said peeler has an inclined portion inclined toward the circumference of the roll.

78. A device as claimed in claim 72, wherein said stencil storing means comprises friction members capable of respectively contacting axially opposite ends of the roll to thereby position the roll in a widthwise direction of the roll perpendicular to the stencil pay-out direction, and for exerting resistance in a direction opposite to a direction in which said roll rotates for paying out the stencil.

79. A device as claimed in claim 72, wherein said rotary drive means comprises drive rollers each consisting of a plurality of roller elements spaced in an axial direction of the roll.

80. A device as claimed in claim 72, wherein said rotary drive means comprises drive rollers respectively located at an upstream side and a downstream side in the stencil pay-out direction.

81. A device as claimed in claim 72, wherein said rotary drive means comprises driven rollers capable of contacting and being driven by the circumference of the roll, and frictional drive means for causing the roll to rotate in a direction for paying out the leading edge of the stencil.

82. A device as claimed in claim 72, further comprising notches formed in said stencil storing means for receiving and rotatably supporting, when the roll has the stencil wound round a core protruding from axially opposite ends of the roll, portions of the core protruding from the roll.

83. A device as claimed in claim 82, further comprising frictional drive means capable of frictionally contacting circumferences of opposite ends of the core.

84. A device as claimed in claim 82, further comprising mating drive means for mating, when the core is a tubular core, with inner periphery of the tubular core to thereby rotate the roll in a direction for paying out the leading edge of the stencil.

85. A device as claimed in claim 72, wherein the roll has at a center thereof a core for winding the stencil thereround, and wherein the core has a low reflectance portion on a circumference thereof.

86. A device as claimed in claim 72, wherein the stencil is wound round itself in the form of the roll.

* * * * *

UNITED STATES PATENT AND TRADEMARK OFFICE

CERTIFICATE OF CORRECTION

PATENT NO. : 5,782,179

DATED : JULY 21, 1998

INVENTOR(S) : HIDEYUKI KAGAWA, ET AL.

It is certified that error appears in the above-indentified patent and that said Letters Patent is hereby corrected as shown below:

Column 7, line 14, change"damper" to --clamper--;
line 16, change"damper" to --clamper--.
Column 16, line 34, change "5A" to --50A--.
Column 17, line 38, change "damper" to --clamper--;
line 51, delete the space between "i s" and change to --is--.
Column 18, line 36, change "damper" to --clamper--.
Column 20, line 17, change "damper" to --clamper--.
Column 27, line 43, change "s hafts" to --shafts--;
line 44, change "166 B'" to --16B'--;
line 67, delete "to".
Column 29, line 26, change "a" (second occurrence) to --as--;
line 27, delete "s".
Column 31, line 14, change "damper" to --clamper--.
Column 35, line 47, delete space between "b e" and change to --be--.
Column 36, line 8, delete space between "it s" and change to --its--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*